US008968069B2

(12) United States Patent
Kato

(10) Patent No.: US 8,968,069 B2
(45) Date of Patent: Mar. 3, 2015

(54) GAMING SYSTEM HAVING A PLURALITY OF GAMING MACHINES LINKED BY NETWORK AND CONTROL METHOD THEREOF

(75) Inventor: Yoichi Kato, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 1046 days.

(21) Appl. No.: 12/543,105

(22) Filed: Aug. 18, 2009

(65) Prior Publication Data

US 2010/0069146 A1 Mar. 18, 2010

Related U.S. Application Data

(60) Provisional application No. 61/097,590, filed on Sep. 17, 2008, provisional application No. 61/097,720, filed on Sep. 17, 2008, provisional application No. 61/097,459, filed on Sep. 16, 2008.

(51) Int. Cl.
*A63F 13/00* (2014.01)
*G07F 17/32* (2006.01)

(52) U.S. Cl.
CPC ..... *G07F 17/3202* (2013.01); *G07F 17/32* (2013.01); *G07F 17/3258* (2013.01)
USPC ..... 463/16

(58) Field of Classification Search
CPC ... G07F 17/321; G07F 17/3258; G07F 17/32; G07F 17/3202; A63F 2009/2451; A63F 2011/0065
USPC ..... 463/16, 25, 31
See application file for complete search history.

(56) References Cited

U.S. PATENT DOCUMENTS

| | | | | |
|---|---|---|---|---|
| 6,068,553 | A | 5/2000 | Parker | |
| 6,210,275 | B1 | 4/2001 | Olsen | |
| 6,224,484 | B1 | 5/2001 | Okuda et al. | |
| 6,375,569 | B1 * | 4/2002 | Acres | 463/27 |
| 6,682,418 | B1 * | 1/2004 | Mendes et al. | 463/6 |
| 8,070,605 | B2 * | 12/2011 | Tien et al. | 463/42 |
| 2003/0236110 | A1 | 12/2003 | Beaulieu et al. | |
| 2004/0235552 | A1 * | 11/2004 | Gauselmann | 463/16 |
| 2004/0254012 | A1 * | 12/2004 | D'Amico et al. | 463/26 |
| 2005/0079911 | A1 | 4/2005 | Nakatsu | |
| 2005/0119044 | A1 | 6/2005 | Lim et al. | |
| 2005/0187014 | A1 | 8/2005 | Saffari et al. | |
| 2006/0073897 | A1 | 4/2006 | Englman et al. | |
| 2006/0094507 | A1 * | 5/2006 | Iwamoto | 463/42 |
| 2006/0166731 | A1 * | 7/2006 | Yoshimi et al. | 463/20 |
| 2006/0205468 | A1 | 9/2006 | Saffari et al. | |
| 2006/0287043 | A1 | 12/2006 | Englman et al. | |
| 2007/0087824 | A1 | 4/2007 | Ogiwara | |
| 2007/0167217 | A1 | 7/2007 | Kaminkow et al. | |
| 2007/0265066 | A1 * | 11/2007 | Curry et al. | 463/26 |
| 2008/0139305 | A1 * | 6/2008 | Vallejo et al. | 463/27 |

* cited by examiner

*Primary Examiner* — David L Lewis
*Assistant Examiner* — Robert Mosser
(74) *Attorney, Agent, or Firm* — Sheppard, Mullin, Richter & Hampton LLP

(57) ABSTRACT

According to a gaming system of the present invention, a part of the betted game media are cumulatively counted as the common-game cumulative value for the common game. When the common-game cumulative value has reached the specific value, the common game in which the game media in number corresponding to the specific value may be paid out is executed in each gaming machine. Based on the result of the common game in each gaming machine, a single gaming machine is determined and the game media in number corresponding to the specific value are paid out from the determined single gaming machine.

6 Claims, 56 Drawing Sheets

FIG.9

| | Left | Center | Right |
|---|---|---|---|
| Code No. | Symbol | Symbol | Symbol |
| 00 | BLUE 7 | BLUE 7 | BLUE 7 |
| 01 | BLANK | BLANK | BLANK |
| 02 | 3BAR | 3BAR | 3BAR |
| 03 | BLANK | BLANK | BLANK |
| 04 | 2BAR | 2BAR | 2BAR |
| 05 | BLANK | BLANK | BLANK |
| 06 | 1BAR | 1BAR | 1BAR |
| 07 | BLANK | BLANK | BLANK |
| 08 | WHITE 7 | WHITE 7 | WHITE 7 |
| 09 | BLANK | BLANK | BLANK |
| 10 | RED 7 | RED 7 | RED 7 |
| 11 | BLANK | BLANK | BLANK |
| 12 | WHITE 7 | WHITE 7 | WHITE 7 |
| 13 | BLANK | BLANK | BLANK |
| 14 | 3BAR | 3BAR | 3BAR |
| 15 | BLANK | BLANK | BLANK |
| 16 | 2BAR | 2BAR | 2BAR |
| 17 | BLANK | BLANK | BLANK |
| 18 | 1BAR | 1BAR | 1BAR |
| 19 | BLANK | BLANK | BLANK |
| 20 | RED 7 | RED 7 | RED 7 |
| 21 | BLANK | BLANK | BLANK |

FIG.10

| | Left | Center | Right |
|---|---|---|---|
| Code No. | Symbol | Symbol | Symbol |
| 00 | BLUE 7 | RED 7 | BLUE 7 |
| 01 | BLANK | BLANK | BLANK |
| 02 | 3BAR | 3BAR | 3BAR |
| 03 | BLANK | BLANK | BLANK |
| 04 | 2BAR | 2BAR | 2BAR |
| 05 | BLANK | BLANK | BLANK |
| 06 | 1BAR | 1BAR | 1BAR |
| 07 | BLANK | BLANK | BLANK |
| 08 | WHITE 7 | WHITE 7 | WHITE 7 |
| 09 | BLANK | BLANK | BLANK |
| 10 | RED 7 | RED 7 | RED 7 |
| 11 | BLANK | BLANK | BLANK |
| 12 | WHITE 7 | WHITE 7 | WHITE 7 |
| 13 | BLANK | BLANK | BLANK |
| 14 | 3BAR | 3BAR | 3BAR |
| 15 | BLANK | BLANK | BLANK |
| 16 | 2BAR | 2BAR | 2BAR |
| 17 | BLANK | BLANK | BLANK |
| 18 | 1BAR | 1BAR | 1BAR |
| 19 | BLANK | BLANK | BLANK |
| 20 | RED 7 | RED 7 | RED 7 |
| 21 | BLANK | BLANK | BLANK |

FIG.11A

| Payout table when number of bet is 1 | |
|---|---|
| Combination of symbols | Number of payouts |
| 3bar-3bar-3bar | 60 |
| 2bar-2bar-2bar | 40 |
| 1bar-1bar-1bar | 20 |
| anybar-anybar-anybar | 10 |

FIG.11B

| Payout table when number of bet is 2 | |
|---|---|
| Combination of symbols | Number of payouts |
| 3bar-3bar-3bar | 120 |
| 2bar-2bar-2bar | 80 |
| 1bar-1bar-1bar | 40 |
| anybar-anybar-anybar | 20 |

FIG.11C

| Payout table when number of bet is 3 | |
|---|---|
| Combination of symbols | Number of payouts |
| blue 7-blue 7-blue 7 | Solo progressive |
| red 7-red 7-red 7 | 100 |
| white 7-white 7-white 7 | 100 |

FIG.15

| Increment-rate storage area | |
|---|---|
| SPECIAL increment rate | 0.50% |
| NORMAL increment rate | 3% |
| Solo-progressive increment rate | 1% |

FIG.16

| Cumulative-value storage area |
|---|
| SPECIAL-cumulative-value storage area |
| NORMAL-cumulative-value storage area |
| Solo-progressive-cumulative-value storage area |

FIG.17

| Specific-value storage area | |
|---|---|
| SPECIAL specific value | 1000 |
| NORMAL specific value | 100 |
| Solo-progressive specific value | 150000 |

FIG.19

| Symbol | Number of points |
|---|---|
| red 7 -red 7 -red 7 | 7000 |
| blue 7 | 300 |
| red 7 | 150 |
| 3bar | 30 |
| 2bar | 20 |
| 1bar | 10 |

FIG.20A

| Number-of-lighting determination table for bent portions | | | | | | | |
|---|---|---|---|---|---|---|---|
| Number of points | Slot machine | | | | | | |
| | A | B | C | ・ | ・ | I | J |
| 1～5 | 5 | 8 | 10 | ・ | ・ | 8 | 5 |
| 6～10 | 10 | 16 | 20 | ・ | ・ | 16 | 10 |
| 11～15 | 15 | 24 | 30 | ・ | ・ | 24 | 15 |
| 16～20 | 20 | 32 | 40 | ・ | ・ | 32 | 20 |
| 21～25 | 25 | 40 | 50 | ・ | ・ | 40 | 25 |
| 30～ | 50 | 80 | 100 | ・ | ・ | 80 | 50 |

FIG.20B

| Number-of-lighting determination table for straight portions | | | | | | | |
|---|---|---|---|---|---|---|---|
| Number of points | Slot machine | | | | | | |
| | A | B | C | ・ | ・ | I | J |
| 1～5 | 5 | 5 | 5 | ・ | ・ | 5 | 5 |
| 6～10 | 10 | 10 | 10 | ・ | ・ | 10 | 10 |
| 11～15 | 15 | 15 | 15 | ・ | ・ | 15 | 15 |
| 16～20 | 20 | 20 | 20 | ・ | ・ | 20 | 20 |
| 21～25 | 25 | 25 | 25 | ・ | ・ | 25 | 25 |
| 30～ | 50 | 50 | 50 | ・ | ・ | 50 | 50 |

FIG.23A

1033

1600 About acquisition of coins in EVENT TIME

1601 EVENT TIME is generated when the cumulative value for EVENT TIME reaches the specific value!!

1602 LED is lighted in accordance with the number of acquired points during EVENT TIME.

1603 Coins are paid out to the machine where light of LED reaches the goal first.

FIG.23B

1033

1604 Number of LEDs from Start to Goal varies from machine to machine.

1605 But correspondence relationship of the number of acquired points and the number of LEDs also varies from machine to machine.

FIG.30

| | Left | Center | Right |
|---|---|---|---|
| Code No. | Symbol | Symbol | Symbol |
| 00 | BLUE 7 | BLUE 7 | BLUE 7 |
| 01 | BLANK | BLANK | BLANK |
| 02 | 3BAR | 3BAR | 3BAR |
| 03 | BLANK | BLANK | BLANK |
| 04 | 2BAR | 2BAR | 2BAR |
| 05 | BLANK | BLANK | BLANK |
| 06 | 1BAR | 1BAR | 1BAR |
| 07 | BLANK | BLANK | BLANK |
| 08 | WHITE 7 | WHITE 7 | WHITE 7 |
| 09 | BLANK | BLANK | BLANK |
| 10 | RED 7 | RED 7 | RED 7 |
| 11 | BLANK | BLANK | BLANK |
| 12 | WHITE 7 | WHITE 7 | WHITE 7 |
| 13 | BLANK | BLANK | BLANK |
| 14 | 3BAR | 3BAR | 3BAR |
| 15 | BLANK | BLANK | BLANK |
| 16 | 2BAR | 2BAR | 2BAR |
| 17 | BLANK | BLANK | BLANK |
| 18 | 1BAR | 1BAR | 1BAR |
| 19 | BLANK | BLANK | BLANK |
| 20 | RED 7 | RED 7 | RED 7 |
| 21 | BLANK | BLANK | BLANK |

FIG.31

| | Left | Center | Right |
|---|---|---|---|
| Code No. | Symbol | Symbol | Symbol |
| 00 | BLUE 7 | RED 7 | BLUE 7 |
| 01 | BLANK | BLANK | BLANK |
| 02 | 3BAR | 3BAR | 3BAR |
| 03 | BLANK | BLANK | BLANK |
| 04 | 2BAR | 2BAR | 2BAR |
| 05 | BLANK | BLANK | BLANK |
| 06 | 1BAR | 1BAR | 1BAR |
| 07 | BLANK | BLANK | BLANK |
| 08 | WHITE 7 | WHITE 7 | WHITE 7 |
| 09 | BLANK | BLANK | BLANK |
| 10 | RED 7 | RED 7 | RED 7 |
| 11 | BLANK | BLANK | BLANK |
| 12 | WHITE 7 | WHITE 7 | WHITE 7 |
| 13 | BLANK | BLANK | BLANK |
| 14 | 3BAR | 3BAR | 3BAR |
| 15 | BLANK | BLANK | BLANK |
| 16 | 2BAR | 2BAR | 2BAR |
| 17 | BLANK | BLANK | BLANK |
| 18 | 1BAR | 1BAR | 1BAR |
| 19 | BLANK | BLANK | BLANK |
| 20 | RED 7 | RED 7 | RED 7 |
| 21 | BLANK | BLANK | BLANK |

FIG.32A

| Payout table when number of bet is 1 | |
|---|---|
| Combination of symbols | Number of payouts |
| 3bar-3bar-3bar | 60 |
| 2bar-2bar-2bar | 40 |
| 1bar-1bar-1bar | 20 |
| anybar-anybar-anybar | 10 |

FIG.32B

| Payout table when number of bet is 2 | |
|---|---|
| Combination of symbols | Number of payouts |
| 3bar-3bar-3bar | 120 |
| 2bar-2bar-2bar | 80 |
| 1bar-1bar-1bar | 40 |
| anybar-anybar-anybar | 20 |

FIG.32C

| Payout table when number of bet is 3 | |
|---|---|
| Combination of symbols | Number of payouts |
| blue 7-blue 7-blue 7 | Solo progressive |
| red 7-red 7-red 7 | 100 |
| white 7-white 7-white 7 | 100 |

FIG.36

| Increment-rate storage area | |
|---|---|
| SPECIAL increment rate | 0.50% |
| NORMAL increment rate | 3% |
| Solo-progressive increment rate | 1% |

FIG.37

| Cumulative-value storage area |
|---|
| SPECIAL-cumulative-value storage area |
| NORMAL-cumulative-value storage area |
| Solo-progressive-cumulative-value storage area |

FIG.38

| Specific-value storage area | |
|---|---|
| SPECIAL specific value | 1000 |
| NORMAL specific value | 100 |
| Solo-progressive specific value | 150000 |

FIG.40

| Symbol | Number of points |
|---|---|
| red 7 -red 7 -red 7 | 7000 |
| blue 7 | 300 |
| red 7 | 150 |
| 3bar | 30 |
| 2bar | 20 |
| 1bar | 10 |

FIG.41A

| Number-of-lighting determination table for bent portions | | | | | | | |
|---|---|---|---|---|---|---|---|
| Number of points | Slot machine | | | | | | |
| | A | B | C | ・ | ・ | I | J |
| 1～5 | 5 | 8 | 10 | ・ | ・ | 8 | 5 |
| 6～10 | 10 | 16 | 20 | ・ | ・ | 16 | 10 |
| 11～15 | 15 | 24 | 30 | ・ | ・ | 24 | 15 |
| 16～20 | 20 | 32 | 40 | ・ | ・ | 32 | 20 |
| 21～25 | 25 | 40 | 50 | ・ | ・ | 40 | 25 |
| 30～ | 50 | 80 | 100 | ・ | ・ | 80 | 50 |

FIG.41B

| Number-of-lighting determination table for straight portions | | | | | | | |
|---|---|---|---|---|---|---|---|
| Number of points | Slot machine | | | | | | |
| | A | B | C | ・ | ・ | I | J |
| 1～5 | 5 | 5 | 5 | ・ | ・ | 5 | 5 |
| 6～10 | 10 | 10 | 10 | ・ | ・ | 10 | 10 |
| 11～15 | 15 | 15 | 15 | ・ | ・ | 15 | 15 |
| 16～20 | 20 | 20 | 20 | ・ | ・ | 20 | 20 |
| 21～25 | 25 | 25 | 25 | ・ | ・ | 25 | 25 |
| 30～ | 50 | 50 | 50 | ・ | ・ | 50 | 50 |

FIG.44

| SPECIAL-increment-rate candidates |
|---|
| 0.5% |
| 1% |
| 1.5% |
| 2% |
| 2.5% |
| 3% |

| NORMAL-increment-rate candidates |
|---|
| 0.5% |
| 1% |
| 1.5% |
| 2% |
| 2.5% |
| 3% |

| Solo-progressive-increment-rate candidates |
|---|
| 0.5% |
| 1% |
| 1.5% |
| 2% |
| 2.5% |
| 3% |

FIG.45

| SPECIAL-specific-value candidates |
|---|
| 500 |
| 800 |
| 1000 |

| NORMAL-specific-value candidates |
|---|
| 100 |
| 200 |
| 300 |

FIG.47A

2033

2600 About acquisition of coins in EVENT TIME

2601 EVENT TIME is generated when the cumulative value for EVENT TIME reaches the specific value!!

2602 LED is lighted in accordance with the number of acquired points during EVENT TIME.

2603 Coins are paid out to the machine where light of LED reaches the goal first.

FIG.47B

2033

2604 Number of LEDs from Start to Goal varies from machine to machine

2605 But correspondence relationship of the number of acquired points and the number of LEDs also varies from machine to machine.

2606 Solo progressive is not generated during EVENT TIME.

FIG.54

| | Left | Center | Right |
|---|---|---|---|
| Code No. | Symbol | Symbol | Symbol |
| 00 | BLUE 7 | BLUE 7 | BLUE 7 |
| 01 | BLANK | BLANK | BLANK |
| 02 | 3BAR | 3BAR | 3BAR |
| 03 | BLANK | BLANK | BLANK |
| 04 | 2BAR | 2BAR | 2BAR |
| 05 | BLANK | BLANK | BLANK |
| 06 | 1BAR | 1BAR | 1BAR |
| 07 | BLANK | BLANK | BLANK |
| 08 | WHITE 7 | WHITE 7 | WHITE 7 |
| 09 | BLANK | BLANK | BLANK |
| 10 | RED 7 | RED 7 | RED 7 |
| 11 | BLANK | BLANK | BLANK |
| 12 | WHITE 7 | WHITE 7 | WHITE 7 |
| 13 | BLANK | BLANK | BLANK |
| 14 | 3BAR | 3BAR | 3BAR |
| 15 | BLANK | BLANK | BLANK |
| 16 | 2BAR | 2BAR | 2BAR |
| 17 | BLANK | BLANK | BLANK |
| 18 | 1BAR | 1BAR | 1BAR |
| 19 | BLANK | BLANK | BLANK |
| 20 | RED 7 | RED 7 | RED 7 |
| 21 | BLANK | BLANK | BLANK |

FIG.55

| | Left | Center | Right |
|---|---|---|---|
| Code No. | Symbol | Symbol | Symbol |
| 00 | BLUE 7 | RED 7 | BLUE 7 |
| 01 | BLANK | BLANK | BLANK |
| 02 | 3BAR | 3BAR | 3BAR |
| 03 | BLANK | BLANK | BLANK |
| 04 | 2BAR | 2BAR | 2BAR |
| 05 | BLANK | BLANK | BLANK |
| 06 | 1BAR | 1BAR | 1BAR |
| 07 | BLANK | BLANK | BLANK |
| 08 | WHITE 7 | WHITE 7 | WHITE 7 |
| 09 | BLANK | BLANK | BLANK |
| 10 | RED 7 | RED 7 | RED 7 |
| 11 | BLANK | BLANK | BLANK |
| 12 | WHITE 7 | WHITE 7 | WHITE 7 |
| 13 | BLANK | BLANK | BLANK |
| 14 | 3BAR | 3BAR | 3BAR |
| 15 | BLANK | BLANK | BLANK |
| 16 | 2BAR | 2BAR | 2BAR |
| 17 | BLANK | BLANK | BLANK |
| 18 | 1BAR | 1BAR | 1BAR |
| 19 | BLANK | BLANK | BLANK |
| 20 | RED 7 | RED 7 | RED 7 |
| 21 | BLANK | BLANK | BLANK |

FIG.56A

| Payout table when number of bet is 1 | |
|---|---|
| Combination of symbols | Number of payouts |
| 3bar-3bar-3bar | 60 |
| 2bar-2bar-2bar | 40 |
| 1bar-1bar-1bar | 20 |
| anybar-anybar-anybar | 10 |

FIG.56B

| Payout table when number of bet is 2 | |
|---|---|
| Combination of symbols | Number of payouts |
| 3bar-3bar-3bar | 120 |
| 2bar-2bar-2bar | 80 |
| 1bar-1bar-1bar | 40 |
| anybar-anybar-anybar | 20 |

FIG.56C

| Payout table when number of bet is 3 | |
|---|---|
| Combination of symbols | Number of payouts |
| blue 7-blue 7-blue 7 | Solo progressive |
| red 7-red 7-red 7 | 100 |
| white 7-white 7-white 7 | 100 |

FIG.60

| Increment-rate storage area | |
|---|---|
| SPECIAL increment rate | 0.50% |
| NORMAL increment rate | 3% |
| Solo-progressive increment rate | 1% |

FIG.61

| Cumulative-value storage area |
|---|
| SPECIAL-cumulative-value storage area |
| NORMAL-cumulative-value storage area |
| Solo-progressive-cumulative-value storage area |

FIG.62

| Specific-value storage area | |
|---|---|
| SPECIAL specific value | 1000 |
| NORMAL specific value | 100 |
| Solo-progressive specific value | 150000 |

FIG.64

| Symbol | Number of points |
|---|---|
| red 7 -red 7 -red 7 | 7000 |
| blue 7 | 300 |
| red 7 | 150 |
| 3bar | 30 |
| 2bar | 20 |
| 1bar | 10 |

FIG.65A

| Number-of-lighting determination table for bent portions | | | | | | | |
|---|---|---|---|---|---|---|---|
| Number of points | Slot machine | | | | | | |
| | A | B | C | ・ | ・ | I | J |
| １～５ | 5 | 8 | 10 | ・ | ・ | 8 | 5 |
| ６～１０ | 10 | 16 | 20 | ・ | ・ | 16 | 10 |
| １１～１５ | 15 | 24 | 30 | ・ | ・ | 24 | 15 |
| １６～２０ | 20 | 32 | 40 | ・ | ・ | 32 | 20 |
| ２１～２５ | 25 | 40 | 50 | ・ | ・ | 40 | 25 |
| ３０～ | 50 | 80 | 100 | ・ | ・ | 80 | 50 |

FIG.65B

| Number-of-lighting determination table for straight portions | | | | | | | |
|---|---|---|---|---|---|---|---|
| Number of points | Slot machine | | | | | | |
| | A | B | C | ・ | ・ | I | J |
| １～５ | 5 | 5 | 5 | ・ | ・ | 5 | 5 |
| ６～１０ | 10 | 10 | 10 | ・ | ・ | 10 | 10 |
| １１～１５ | 15 | 15 | 15 | ・ | ・ | 15 | 15 |
| １６～２０ | 20 | 20 | 20 | ・ | ・ | 20 | 20 |
| ２１～２５ | 25 | 25 | 25 | ・ | ・ | 25 | 25 |
| ３０～ | 50 | 50 | 50 | ・ | ・ | 50 | 50 |

GAMING SYSTEM HAVING A PLURALITY OF GAMING MACHINES LINKED BY NETWORK AND CONTROL METHOD THEREOF

CROSS-REFERENCE TO RELATED APPLICATIONS

This application claims benefit of priority based on U.S. Provisional Patent Application No. 61/097,590 filed on Sep. 17, 2008, U.S. Provisional Patent Application No. 61/097,720 filed on Sep. 17, 2008 and U.S. Provisional Patent Application No. 61/097,459 filed on Sep. 16, 2008. The contents of this application are incorporated herein by reference in their entirety.

BACKGROUND OF THE INVENTION

1. Field of the Invention

The present invention relates to a gaming system having a plurality of gaming machines linked by a network and a control method thereof.

2. Discussion of the Background Art

Conventionally, there exists a gaming system having a plurality of gaming machines linked by network as disclosed in: U.S. Pat. No. 6,068,553, U.S. Pat. No. 6,210,275, U.S. Pat. No. 6,224,484, US 2003/0236110-A1, US 2005/0079911-A1, US 2005/0119044-A1, US 2006/0205468-A1, US 2005/0187014-A1, US 2006/0287043-A1, US 2006/0073897-A1, US 2007/0087824-A1, US 2007/0167217-A1. In this kind of a gaming system, a game medium inserted into each gaming machine is pooled in one place and the pooled game media are paid out to the gaming machine having won a progressive jackpot.

A player playing a game in the aforementioned gaming system is playing the game for the sake of acquiring pooled game media. However, gaming systems as described above are monotonous, since payout of pooled game media is conducted to a gaming machine, for example, determined through a lottery, and the method itself for paying out the pooled game media lacks an interesting aspect. Therefore, there has been a problem that the player easily gets tired of the game.

The present invention was made in view of the aforementioned problem and an object thereof is to provide a gaming system that the player hardly gets tired of the game and a control method thereof.

The contents of U.S. Pat. No. 6,068,553, U.S. Pat. No. 6,210,275, U.S. Pat. No. 6,224,484, US 2003/0236110-A1, US 2005/0079911-A1, US 2005/0119044-A1, US 2006/0205468-A1, US 2005/0187014-A1, US 2006/0287043-A1, US 2006/0073897-A1, US 2007/0087824-A1 and US 2007/0167217-A1 are incorporated herein by reference in their entirety.

SUMMARY OF THE INVENTION

The present invention provides a gaming system having the following configuration.

Namely, the gaming system comprises: a plurality of gaming machines each including a controller; a control device including a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media as a common-game cumulative value for a common game, triggered by a receipt of the number-of-game-media information from the gaming machine; (B) determining whether or not the common-game cumulative value cumulatively counted in the processing (A) has reached a specific value; and (C) transmitting a common-game execution signal to the gaming machine, when determining the common-game cumulative value has reached the specific value in the processing (B). The controller is further programmed to execute processing of: (b) executing the common game when receiving the common-game execution signal from the control device; and (c) transmitting common-game result information determined based on a result of the common game executed in the processing (b), to the control device. The processor is further programmed to execute processing of: (D) determining a single gaming machine out of the plurality of the gaming machines, based on the common-game result information transmitted from the gaming machines; and (E) paying out game media in number corresponding to the specific value from the single gaming machine determined in the processing (D).

According to the gaming system, a part of the betted game media are cumulatively counted as the common-game cumulative value for the common game. When the common-game cumulative value has reached the specific value, the common game in which the game media in number corresponding to the specific value may be paid out is executed in each gaming machine. Based on the result of the common game in each gaming machine, a single gaming machine is determined and the game media in number corresponding to the specific value are paid out from the determined single gaming machine. As a result, it is possible to provide a new-type gaming system capable of having a player absorbed in the game.

The present invention provides a gaming system having the following configuration.

Namely, the gaming system comprises: a plurality of gaming machines each including a controller; a control device including a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media in a percentage predetermined for each of a plurality of common games, as an individual cumulative value for each of the common games, triggered by a receipt of the number-of-game-media information from the gaming machine; (B) determining whether or not any of the individual cumulative values cumulatively counted in the processing (A) has reached a specific value set for each of the plurality of the common games; and (C) transmitting a common-game execution signal to the gaming machine, when determining any of the individual cumulative values has reached the specific value in the processing (B). The controller is further programmed to execute processing of: (b) executing the common game when receiving the common-game execution signal from the control device; and (c) transmitting common-game result information determined based on a result of the common game executed in the processing (b), to the control device. The processor is further programmed to execute processing of: (D) determining a single gaming machine out of the plurality of the gaming machines, based on the common-game result information transmitted from the gaming machines; and (E) paying out game media in number corresponding to the specific value to which the individual cumulative value has reached in the processing (B), from the single gaming machine determined in the processing (D).

According to the gaming system, a plurality of common games are provided and the individual cumulative value is counted for each common game. When the individual cumulative value has reached the specific value, the common game is executed, in which the game media in number corresponding to the specific value may be paid out. Since the individual cumulative value is counted individually, each of the plurality of common games is generated independently of each other. Accordingly, since the respective individual cumulative values accumulated in the plurality of common games and the specific values are independent of each other, it becomes harder to predict which common game will be generated at which timing. As a result, it is possible to provide a new-type gaming system capable of having a player absorbed in the game.

The present invention further provides a gaming system having the following configuration.

Namely, the gaming system comprises: a plurality of gaming machines each including a controller; a control device including a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media in a first predetermined percentage as a first individual cumulative value, and cumulatively counting a part of the number of betted game media in a second predetermined percentage smaller than the first predetermined percentage, as a second individual cumulative value, triggered by a receipt of the number-of-game-media information from the gaming machine; (B) determining whether or not the first individual cumulative value cumulatively counted in the processing (A) has reached a first specific value as a comparable figure of the first individual cumulative value, or the second individual cumulative value has reached a second specific value as a comparable figure of the second individual cumulative value and being larger than the first specific value; and (C) transmitting a common-game execution signal to the gaming machine, when determining the first individual cumulative value has reached the first specific value or the second individual cumulative value has reached the second specific value, in the processing (B). The controller is further programmed to execute processing of: (b) executing the common game when receiving the common-game execution signal from the control device; and (c) transmitting common-game result information determined based on a result of the common game executed in the processing (b) to the control device. The processor is further programmed to execute processing of: (D) determining a single gaming machine out of the plurality of the gaming machines, based on the result information transmitted from the gaming machines; (E) paying out game media in number corresponding to the first specific value from the single gaming machine determined in the processing (D), when determining the first individual cumulative value has reached the first specific value in the processing (B); and (F) paying out the game media in number corresponding to the second specific value from the single gaming machine determined in the processing (D), when determining the second individual cumulative value has reached the second specific value in the processing (B).

According to the gaming system, two common games are provided and the individual cumulative value (the first individual cumulative value, the second individual cumulative value) is counted for each common game. When the first individual cumulative value has reached the first specific value, or when the second individual cumulative value has reached the second specific value, the common game is executed, in which the game media in number corresponding to the specific value may be paid out. Since the individual cumulative value is counted individually, respective two common games are generated independently of each other. Accordingly, since the respective individual cumulative values accumulated in the two common games and the specific values are independent of each other, it becomes harder to predict which common game will be generated at which timing. As a result, it is possible to provide a new-type gaming system capable of having a player absorbed in the game.

Further, a part of the betted game media in the first predetermined percentage (e.g. 3%) are cumulatively counted, as the first individual cumulative value, and a part of the betted game media in the second predetermined percentage (e.g. 0.5%) are cumulatively counted, as the second individual cumulative value. When the first individual cumulative value is determined to have reached the first specific value (e.g. 100), the common game is executed, in which the game media in number corresponding to the first specific value may be paid out. On the other hand, when the second individual cumulative value has reached the second specific value (e.g. 1000) that is larger than the first specific value, the common game is executed, in which the game media in number corresponding to the second specific value may be paid out. Namely, for the larger specific value, the smaller percentage for accumulating the cumulative value until reaching the specific value is set. Accordingly, it is possible to have the common game with the large number of payouts be harder to be generated, so that a profit of a recreation facility providing a game by using the gaming system can be ensured. Further, though the common game with the large number of payouts is hard to be generated, the common game with the comparatively smaller number of payouts is generated relatively frequently, so that it becomes possible to prevent the player from getting bored and the player can enjoy the game for a long time.

The present invention further provides a game control method having the following configuration.

Namely, the game control method comprises steps of: (a) a gaming machine transmitting number-of-game-media information relating to a number of betted game media to a control device; (A) the control device cumulatively counting a part of the number of betted game media in a percentage predetermined for each of a plurality of common games, as an individual cumulative value for each of the common games, triggered by a receipt of the number-of-game-media information from the gaming machine; (B) the control device determining whether or not any of the individual cumulative values cumulatively counted in the step (A) has reached a specific value set for each of the plurality of the common games; (C) the control device transmitting a common-game execution signal to the gaming machine, when determining any of the individual cumulative values has reached the specific value in the step (B); (b) the gaming machine executing the common game when receiving the common-game execution signal from the control device; (c) the gaming machine transmitting common-game result information determined based on a result of the common game executed in the step (b), to the control device; (D) the control device determining a single gaming machine out of the plurality of the gaming machines, based on the common-game result information transmitted from the gaming machines; and (E) the control device paying out game media in number corresponding to the specific value to which the individual cumulative value has reached in the step (B), from the single gaming machine determined in the step (D).

According to the game control method, a plurality of common games are provided and the individual cumulative value is counted for each common game. When the individual cumulative value has reached the specific value, the common game is executed, in which the game media in number corresponding to the specific value may be paid out. Since the individual cumulative value is counted individually, each of the plurality of common games is generated independently of each other. Accordingly, since the respective individual cumulative values accumulated in the plurality of common games and the specific values are independent of each other, it becomes harder to predict which common game will be generated at which timing. As a result, it is possible to provide a new-type game control method capable of having a player absorbed in the game.

The present invention further provides a game control method having the following configuration.

Namely, the game control method comprises steps of: (a) a gaming machine transmitting number-of-game-media information relating to a number of betted game media to a control device; (A) the control device cumulatively counting a part of the number of betted game media in a first predetermined percentage as a first individual cumulative value, and cumulatively counting a part of the number of betted game media in a second predetermined percentage smaller than the first predetermined percentage, as a second individual cumulative value, triggered by a receipt of the number-of-game-media information from the gaming machine; (B) the control device determining whether or not the first individual cumulative value cumulatively counted in the step (A) has reached a first specific value as a comparable figure of the first individual cumulative value, or the second individual cumulative value has reached a second specific value as a comparable figure of the second individual value and being larger than the first specific value; (C) the control device transmitting a common-game execution signal to the gaming machine, when determining the first individual cumulative value has reached the first specific value or the second individual cumulative value has reached the second specific value, in the step (B); (b) the gaming machine executing the common game when receiving the common-game execution signal from the control device; (c) the gaming machine transmitting common-game result information determined based on a result of the common game executed in the step (b) to the control device; (D) the controller determining a single gaming machine out of the plurality of the gaming machines, based on the result information transmitted from the gaming machines; (E) the controller paying out game media in number corresponding to the first specific value from the single gaming machine determined in the step (D), when determining the first individual cumulative value has reached the first specific value in the step (B); and (F) the controller paying out the game media in number corresponding to the second specific value from the single gaming machine determined in the step (D), when determining the second individual cumulative value has reached the second specific value in the step (B).

According to the game control method, two common games are provided and the individual cumulative value (the first individual cumulative value, the second individual cumulative value) is counted for each common game. When the first individual cumulative value has reached the first specific value, or when the second individual cumulative value has reached the second specific value, the common game is executed, in which the game media in number corresponding to the specific value may be paid out. Since the individual cumulative value is counted individually, respective two common games are generated independently of each other. Accordingly, since the respective individual cumulative values accumulated in the two common games and the specific values are independent of each other, it becomes harder to predict which common game will be generated at which timing. As a result, it is possible to provide a new-type gaming system capable of having a player absorbed in the game.

Further, a part of the betted game media in the first predetermined percentage (e.g. 3%) are cumulatively counted, as the first individual cumulative value, and a part of the betted game media in the second predetermined percentage (e.g. 0.5%) are cumulatively counted, as the second individual cumulative value. When the first individual cumulative value is determined to have reached the first specific value (e.g. 100), the common game is executed, in which the game media in number corresponding to the first specific value may be paid out. On the other hand, when the second individual cumulative value has reached the second specific value (e.g. 1000) that is larger than the first specific value, the common game is executed, in which the game media in number corresponding to the second specific value may be paid out. Namely, for the larger specific value, the smaller percentage for accumulating the cumulative value until reaching the specific value is set. Accordingly, it is possible to have the common game with the large number of payouts be harder to be generated, so that a profit of a recreation facility providing a game by using the gaming system can be ensured. Further, though the common game with the large number of payouts is hard to be generated, the common game with the comparatively smaller number of payouts is generated relatively frequently, so that it becomes possible to prevent the player from getting bored and the player can enjoy the game for a long time.

The present invention provides a gaming system having the following configuration.

Namely, the gaming system comprises: a plurality of gaming machines each including a controller; a control device including an input device and a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media in a percentage determined for each of a plurality of common games, as an individual cumulative value for each of the common games, triggered by a receipt of the number-of-game-media information from the gaming machine; (B) determining whether or not any of the individual cumulative values cumulatively counted in the processing (A) has reached a specific value set for each of the plurality of the common games; and (C) transmitting a common-game execution signal to the gaming machine, when determining any of the individual cumulative values has reached the specific value in the processing (B). The controller is further programmed to execute processing of: (b) executing the common game when receiving the common-game execution signal from the control device; and (c) transmitting common-game result information determined based on a result of the common game executed in the processing (b), to the control device. The processor is further programmed to execute processing of: (D) determining a single gaming machine out of the plurality of the gaming machines, based on the common-game result information transmitted from the gaming machines; (E) paying out game media in number corresponding to the specific value to which the individual cumulative value has reached in the processing (B), from the single gaming machine determined in the processing (D); and (F) changing the percentage and/or the specific value in accordance with an input from the input device.

According to the gaming system, a plurality of common games are provided and the individual cumulative value is counted for each common game. When the individual cumulative value has reached the specific value, the common game is executed, in which the game media in number corresponding to the specific value may be paid out. Since the individual cumulative value is counted individually, each of the plurality of common games is generated independently of each other. Accordingly, since the respective individual cumulative values accumulated in the plurality of common games and the specific values are independent of each other, it becomes harder to predict which common game will be generated at which timing. As a result, it is possible to provide a gaming system including a new-type common game capable of having a player absorbed in the game.

Further, in accordance with an input from the input device provided in the control device, the percentage and/or the specific value can be changed. As a result, by setting the percentage to a lower value or the specific value to a higher value, a generation frequency of the common game can be lowered. Further, by setting the percentage to a higher value or the specific value to a lower value, the generation frequency of the common game can be raised. Furthermore, by changing the specific value, it is possible to increase or decrease the number of game media to be paid out after the common game.

The present invention further provides a gaming system having the following configuration.

Namely, the gaming system comprises: a plurality of gaming machines each including an input device and a controller; a control device including a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media in a percentage determined for each of a plurality of common games, as an individual cumulative value for each of the common games, triggered by a receipt of the number-of-game-media information from the gaming machine; (B) determining whether or not any of the individual cumulative values cumulatively counted in the processing (A) has reached a specific value set for each of the plurality of the common games; and (C) transmitting a common-game execution signal to the gaming machine, when determining any of the individual cumulative values has reached the specific value in the processing (B). The controller is further programmed to execute processing of: (b) executing the common game when receiving the common-game execution signal from the control device; and (c) transmitting common-game result information determined based on a result of the common game executed in the processing (b), to the control device. The processor is further programmed to execute processing of: (D) determining a single gaming machine out of the plurality of the gaming machines, based on the common-game result information transmitted from the gaming machines; and (E) paying out game media in number corresponding to the specific value to which the individual cumulative value has reached in the processing (B), from the single gaming machine determined in the processing (D). The controller is further programmed to execute processing of (d) changing the percentage and/or the specific value in accordance with an input from the input device.

According to the gaming system, a plurality of common games are provided and the individual cumulative value is counted for each common game. When the individual cumulative value has reached the specific value, the common game is executed, in which the game media in number corresponding to the specific value may be paid out. Since the individual cumulative value is counted individually, each of the plurality of common games is generated independently of each other. Accordingly, since the respective individual cumulative values accumulated in the plurality of common games and the specific values are independent of each other, it becomes harder to predict which common game will be generated at which timing. As a result, it is possible to provide a new-type gaming system capable of having a player absorbed in the game.

Further, in accordance with an input from the input device provided in the gaming machine, the percentage and/or the specific value can be changed. As a result, by setting the percentage to a lower value or the specific value to a higher value, a generation frequency of the common game can be lowered. Further, by setting the percentage to a higher value or the specific value to a lower value, the generation frequency of the common game can be raised. Furthermore, by changing the specific value, it is possible to increase or decrease the number of game media to be paid out after the common game.

The present invention further provides a game control method having the following configuration.

Namely, the game control method comprising steps of: (a) a gaming machine transmitting number-of-game-media information relating to a number of betted game media to a control device; (A) the control device cumulatively counting a part of the number of betted game media in a percentage determined for each of a plurality of common games, as an individual cumulative value for each of the common games, triggered by a receipt of the number-of-game-media information from the gaming machine; (B) the control device determining whether or not any of the individual cumulative values cumulatively counted in the step (A) has reached a specific value set for each of the plurality of the common games; (C) the control device transmitting a common-game execution signal to the gaming machine, when determining any of the individual cumulative values has reached the specific value in the step (B); (b) the gaming machine executing the common game when receiving the common-game execution signal from the control device; (c) the gaming machine transmitting common-game result information determined based on a result of the common game executed in the step (b), to the control device; (D) the control device determining a single gaming machine out of the plurality of the gaming machines, based on the common-game result information transmitted from the gaming machines; (E) the control device paying out game media in number corresponding to the specific value to which the individual cumulative value has reached in the step (B), from the single gaming machine determined in the step (D); and (F) the control device changing the percentage and/or the specific value in accordance with an input from the input device.

According to the game control method, a plurality of common games are provided and the individual cumulative value is counted for each common game. When the individual cumulative value has reached the specific value, the common game is executed, in which the game media in number corresponding to the specific value may be paid out. Since the individual cumulative value is counted individually, each of the plurality of common games is generated independently of each other. Accordingly, since the respective individual cumulative values accumulated in the plurality of common games and the specific values are independent of each other, it becomes harder to predict which common game will be generated at which timing. As a result, it is possible to provide a game control method including a new-type common game capable of having a player absorbed in the game.

Further, in accordance with an input from the input device provided in the control device, the percentage and/or the specific value can be changed. As a result, by setting the percentage to a lower value or the specific value to a higher value, a generation frequency of the common game can be lowered. Further, by setting the percentage to a higher value or the specific value to a lower value, the generation frequency of the common game can be raised. Furthermore, by changing the specific value, it is possible to increase or decrease the number of game media to be paid out after the common game.

The present invention further provides a game control method having the following configuration.

Namely, the game control method comprising steps of: (a) a gaming machine transmitting number-of-game-media information relating to a number of betted game media to a control device; (A) the control device cumulatively counting a part of the number of betted game media in a percentage determined for each of a plurality of common games, as an individual cumulative value for each of the common games, triggered by a receipt of the number-of-game-media information from the gaming machine; (B) the control device determining whether or not any of the individual cumulative values cumulatively counted in the step (A) has reached a specific value set for each of the plurality of the common games; (C) the control device transmitting a common-game execution signal to the gaming machine, when determining any of the individual cumulative values has reached the specific value in the step (B); (b) the gaming machine executing the common game when receiving the common-game execution signal from the control device; (c) the gaming machine transmitting common-game result information determined based on a result of the common game executed in the step (b), to the control device; (D) the control device determining a single gaming machine out of the plurality of the gaming machines, based on the common-game result information transmitted from the gaming machines; (E) the control device paying out game media in number corresponding to the specific value to which the individual cumulative value has reached in the step (B), from the single gaming machine determined in the step (D); and (d) the control device changing the percentage and/or the specific value in accordance with an input from the input device.

According to the game control method, a plurality of common games are provided and the individual cumulative value is counted for each common game. When the individual cumulative value has reached the specific value, the common game is executed, in which the game media in number corresponding to the specific value may be paid out. Since the individual cumulative value is counted individually, each of the plurality of common games is generated independently of each other. Accordingly, since the respective individual cumulative values accumulated in the plurality of common games and the specific values are independent of each other, it becomes harder to predict which common game will be generated at which timing. As a result, it is possible to provide a new-type gaming system capable of having a player absorbed in the game.

Further, in accordance with an input from the input device provided in the gaming machine, the percentage and/or the specific value can be changed. As a result, by setting the percentage to a lower value or the specific value to a higher value, a generation frequency of the common game can be lowered. Further, by setting the percentage to a higher value or the specific value to a lower value, the generation frequency of the common game can be raised. Furthermore, by changing the specific value, it is possible to increase or decrease the number of game media to be paid out after the common game.

The present invention provides a gaming system having the following configuration.

Namely, the gaming system comprises: a plurality of gaming machines each including a symbol display capable of variably displaying symbols, and a controller; a control device including a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media as a common-game cumulative value for a common game and cumulatively counting an other part of the number of betted game media as a solo-game cumulative value for a solo game, triggered by a receipt of the number-of-game-media information from the gaming machine; (B) determining whether or not the common-game cumulative value cumulatively counted in the processing (A) has reached a first specific value; and (C) transmitting a common-game execution signal to the gaming machine, when determining the common-game cumulative value has reached the first specific value in the processing (B). The controller is further programmed to execute processing of: (b) executing the solo game for stop-displaying the symbols to the symbol display after variably displaying the symbols, based on a solo-game program; (c) paying out game media in number corresponding to a second specific value larger than the first specific value, when the solo-game cumulative value has reached the second specific value and the symbols are stop-displayed in a specific state in the solo game; (d) executing the common game for stop-displaying the symbols to the symbol display after variably displaying the symbols, based on a common-game program programmed not to stop-display the symbols in the specific state, when receiving the common-game execution signal from the control device; and (e) transmitting common-game result information determined based on a result of the common game executed in the processing (d), to the control device. The processor is further programmed to execute processing of: (D) determining a single gaming machine out of the plurality of the gaming machines, based on the common-game result information transmitted from the gaming machines; and (E) paying out game media in number corresponding to the first specific value from the single gaming machine determined in the processing (D).

According to the gaming system, a part of the betted game media are cumulatively counted as the common-game cumulative value for the common game and another part of the betted game media are cumulatively counted as the solo-game cumulative value for the solo game. When the solo-game cumulative value has reached the second specific value, the game media in number corresponding to the second specific value are paid out, on condition that the symbols are stop-displayed in the specific state in the solo game. On the other hand, when the common-game cumulative value has reached the first specific value, the common game in which the game media in number corresponding to the first specific value may be paid out is executed in each gaming machine. Based on the result of the common game in each gaming machine, a single gaming machine is determined and the game media in number corresponding to the first specific value are paid out from the determined single gaming machine. Here, the second specific value is larger than the first specific value. Accordingly, in a case where it is possible that the symbols are stop-displayed in the specific state, the player becomes more conscious of whether or not the symbols are stop-displayed in the specific state, than the common game. However, according to the gaming system, the common game is executed by the common-game program programmed not to stop-display the symbols in the specific state. Accordingly, in the common game, payout of the game media based on the symbols stop-displayed in the specific state is not to be conducted. As a result, it is possible to provide a new-type gaming system capable of having the player more concentrated on the common game.

The present invention provides a gaming system having the following configuration.

Namely, the gaming system comprises: a plurality of gaming machines each including a symbol display capable of variably displaying symbols, and a controller; a control device including a processor; and a network enabling communication between the plurality of gaming machines and the control device. The controller is programmed to execute processing of (a) transmitting number-of-game-media information relating to a number of betted game media to the control device. The processor is programmed to execute processing of: (A) cumulatively counting a part of the number of betted game media as a common-game cumulative value for a common game and cumulatively counting an other part of the number of betted game media as a solo-game cumulative value for a solo game, triggered by a receipt of the number-of-game-media information from the gaming machine; (B) determining whether or not the common-game cumulative value cumulatively counted in the processing (A) has reached a specific value; and (C) transmitting a common-game execution signal to the gaming machine, when determining the common-game cumulative values has reached the specific value in the processing (B). The controller is further programmed to execute processing of: (b) executing the solo game for stop-displaying the symbols to the symbol display after variably displaying the symbols, based on a solo-game program; (c) paying out game media in number corresponding to the solo-game cumulative value, when the symbols are stop-displayed in a specific state in the solo game; (d) executing the common game for stop-displaying the symbols to the symbol display after variably displaying the symbols, based on a common-game program programmed not to stop-display the symbols in the specific state, when receiving the common-game execution signal from the control device; and (e) transmitting common-game result information determined based on a result of the common game executed in the processing (d), to the control device. The processor is further programmed to execute processing of: (D) determining a single gaming machine out of the plurality of the gaming machines, based on the common-game result information transmitted from the gaming machines; and (E) paying out game media in number corresponding to the specific value from the single gaming machine determined in the processing (D).

According to the gaming system, a part of the betted game media are cumulatively counted as the common-game cumulative value for the common game and another part of the betted game media are cumulatively counted as the solo-game cumulative value for the solo game. When the solo-game cumulative value has reached the second specific value, the game media in number corresponding to the second specific value are paid out, on condition that the symbols are stop-displayed in the specific state in the solo game. On the other hand, when the common-game cumulative value has reached the first specific value, the common game in which the game media in number corresponding to the first specific value may be paid out is executed in each gaming machine. Based on the result of the common game in each gaming machine, a single gaming machine is determined and the game media in number corresponding to the first specific value are paid out from the determined single gaming machine. Here, the common game is executed by the common-game program programmed not to stop-display the symbols in the specific state. Accordingly, in the common game, payout of the game media based on the symbols stop-displayed in the specific state is not to be conducted. As a result, it is possible to provide a new-type gaming system capable of having the player more concentrated on the common game.

The present invention further provides a game control method having the following configuration.

Namely, the game control method comprises steps of: (a) a gaming machine transmitting number-of-game-media information relating to a number of betted game media to a control device, (A) the control device cumulatively counting a part of the number of betted game media as a common-game cumulative value for a common game and cumulatively counting an other part of the number of betted game media as a solo-game cumulative value for a solo game, triggered by a receipt of the number-of-game-media information from the gaming machine; (B) the control device determining whether or not the common-game cumulative value cumulatively counted in the step (A) has reached a first specific value; (C) the control device transmitting a common-game execution signal to the gaming machine, when determining the common-game cumulative value has reached the first specific value in the step (B); (b) the gaming machine executing the solo game for stop-displaying the symbols to a symbol display after variably displaying the symbols, based on a solo-game program; (c) the gaming machine paying out game media in number corresponding to a second specific value larger than the first specific value, when the solo-game cumulative value has reached the second specific value and the symbols are stop-displayed in a specific state in the solo game; (d) the gaming machine executing the common game for stop-displaying the symbols to the symbol display after variably displaying the symbols, based on a common-game program programmed not to stop-display the symbols in the specific state, when receiving the common-game execution signal from the control device; (e) the gaming machine transmitting common-game result information determined based on a result of the common game executed in the step (d), to the control device; (D) the control device determining a single gaming machine out of the plurality of the gaming machines, based on the common-game result information transmitted from the gaming machines; and (E) the control device paying out game media in number corresponding to the first specific value from the single gaming machine determined in the step (D).

According to the game control method, a part of the betted game media are cumulatively counted as the common-game cumulative value for the common game and another part of the betted game media are cumulatively counted as the solo-game cumulative value for the solo game. When the solo-game cumulative value has reached the second specific value, the game media in number corresponding to the second specific value are paid out, on condition that the symbols are stop-displayed in the specific state in the solo game. On the other hand, when the common-game cumulative value has reached the first specific value, the common game in which the game media in number corresponding to the first specific value may be paid out is executed in each gaming machine. Based on the result of the common game in each gaming machine, a single gaming machine is determined and the game media in number corresponding to the first specific value are paid out from the determined single gaming machine. Here, the second specific value is larger than the first specific value. Accordingly, in a case where it is possible that the symbols are stop-displayed in the specific state, the player becomes more conscious of whether or not the symbols are stop-displayed in the specific state, than the common game. However, according to the gaming system, the common game is executed by the common-game program programmed not to stop-display the symbols in the specific state. Accordingly, in the common game, payout of the game media based on the symbols stop-displayed in the specific state is not to be conducted. As a result, it is possible to provide a new-type gaming system capable of having the player more concentrated on the common game.

The present invention further provides a game control method having the following configuration.

Namely, the game control method comprising steps of: (a) a gaming machine transmitting number-of-game-media information relating to a number of betted game media to a control device, (A) the control device cumulatively counting a part of the number of betted game media as a common-game cumulative value for a common game and cumulatively counting an other part of the number of betted game media as a solo-game cumulative value for a solo game, triggered by a receipt of the number-of-game-media information from the gaming machine; (B) the control device determining whether or not the common-game cumulative value cumulatively counted in the step (A) has reached a specific value; (C) the control device transmitting a common-game execution signal to the gaming machine, when determining the common-game cumulative values has reached the specific value in the step (B); (b) the gaming machine executing the solo game for stop-displaying the symbols to the symbol display after variably displaying the symbols, based on a solo-game program; (c) the gaming machine paying out game media in number corresponding to the solo-game cumulative value, when the symbols are stop-displayed in a specific state in the solo game; (d) the gaming machine executing the common game for stop-displaying the symbols to the symbol display after variably displaying the symbols, based on a common-game program programmed not to stop-display the symbols in the specific state, when receiving the common-game execution signal from the control device; (e) the gaming machine transmitting common-game result information determined based on a result of the common game executed in the step (d), to the control device; (D) the control device determining a single gaming machine out of the plurality of the gaming machines, based on the common-game result information transmitted from the gaming machines; and (E) the control device paying out game media in number corresponding to the specific value from the single gaming machine determined in the step (D).

According to the game control method, a part of the betted game media are cumulatively counted as the common-game cumulative value for the common game and another part of the betted game media are cumulatively counted as the solo-game cumulative value for the solo game. When the solo-game cumulative value has reached the second specific value, the game media in number corresponding to the second specific value are paid out, on condition that the symbols are stop-displayed in the specific state in the solo game. On the other hand, when the common-game cumulative value has reached the first specific value, the common game in which the game media in number corresponding to the first specific value may be paid out is executed in each gaming machine. Based on the result of the common game in each gaming machine, a single gaming machine is determined and the game media in number corresponding to the first specific value are paid out from the determined single gaming machine. Here, the common game is executed by the common-game program programmed not to stop-display the symbols in the specific state. Accordingly, in the common game, payout of the game media based on the symbols stop-displayed in the specific state is not to be conducted. As a result, it is possible to provide a new-type gaming system capable of having the player more concentrated on the common game.

BRIEF DESCRIPTION OF THE DRAWINGS

FIG. 9 is a view illustrating a symbol array table A in the first embodiment.

FIG. 10 is a view illustrating a symbol array table B in the first embodiment.

FIG. 11A is a view illustrating a relation between a combination of symbols and a number of coin-outs in the first embodiment.

FIG. 11B is a view illustrating the relation between the combination of symbols and the number of coin-outs in the first embodiment.

FIG. 11C is a view illustrating the relation between the combination of symbols and the number of coin-outs in the first embodiment.

FIG. 15 is a view illustrating an increment-rate storage area in the first embodiment.

FIG. 16 is a view illustrating a cumulative-value storage area in the first embodiment.

FIG. 17 is a view illustrating a specific-value storage area in the first embodiment.

FIG. 19 is a view illustrating a number-of-points determination table in the first embodiment.

FIG. 20A is a view illustrating a number-of-lighting determination table in the first embodiment.

FIG. 20B is a view illustrating a number-of-lighting determination table in the first embodiment.

FIG. 23A is a view illustrating an exemplary image displayed to an upper image display panel included in a slot machine forming a gaming system according to the second embodiment.

FIG. 23B is a view illustrating an exemplary image displayed to the upper image display panel included in the slot machine forming the gaming system according to the second embodiment.

FIG. 30 is a view illustrating a symbol array table A in the second embodiment.

FIG. 31 is a view illustrating a symbol array table B in the second embodiment.

FIG. 32A is a view illustrating a relation between a combination of symbols and a number of coin-outs in the second embodiment.

FIG. 32B is a view illustrating the relation between the combination of symbols and the number of coin-outs in the second embodiment.

FIG. 32C is a view illustrating the relation between the combination of symbols and the number of coin-outs in the second embodiment.

FIG. 36 is a view illustrating an increment-rate storage area in the second embodiment.

FIG. 37 is a view illustrating a cumulative-value storage area in the second embodiment.

FIG. 38 is a view illustrating a specific-value storage area in the second embodiment.

FIG. 40 is a view illustrating a number-of-points determination table in the second embodiment.

FIG. 41A is a view illustrating a number-of-lighting determination table in the second embodiment.

FIG. 41B is a view illustrating a number-of-lighting determination table in the second embodiment.

FIG. 44 is a view illustrating an increment-rate-candidates storage table in the second embodiment.

FIG. 45 is a view illustrating a specific-value-candidates storage table in the second embodiment.

FIG. 47A is a view illustrating an exemplary image displayed to an upper image display panel included in a slot machine forming a gaming system according to the third embodiment.

FIG. 47B is a view illustrating an exemplary image displayed to the upper image display panel included in the slot machine forming the gaming system according to the third embodiment.

FIG. 54 is a view illustrating a symbol array table A in the third embodiment.

FIG. 55 is a view illustrating a symbol array table B in the third embodiment.

FIG. 56A is a view illustrating a relation between a combination of symbols and a number of coin-outs in the third embodiment.

FIG. 56B is a view illustrating the relation between the combination of symbols and the number of coin-outs in the third embodiment.

FIG. 56C is a view illustrating the relation between the combination of symbols and the number of coin-outs in the third embodiment.

FIG. 60 is a view illustrating an increment-rate storage area in the third embodiment.

FIG. 61 is a view illustrating a cumulative-value storage area in the third embodiment.

FIG. 62 is a view illustrating a specific-value storage area in the third embodiment.

FIG. 64 is a view illustrating a number-of-points determination table in the third embodiment.

FIG. 65A is a view illustrating a number-of-lighting determination table in the third embodiment.

FIG. 65B is a view illustrating a number-of-lighting determination table in the third embodiment.

DESCRIPTION OF THE EMBODIMENTS (First Embodiment)

A First embodiment of the present invention is described based on the drawings.

At first, with reference to FIG. 1, there will be given a general description of the present embodiment.

Figure 1:
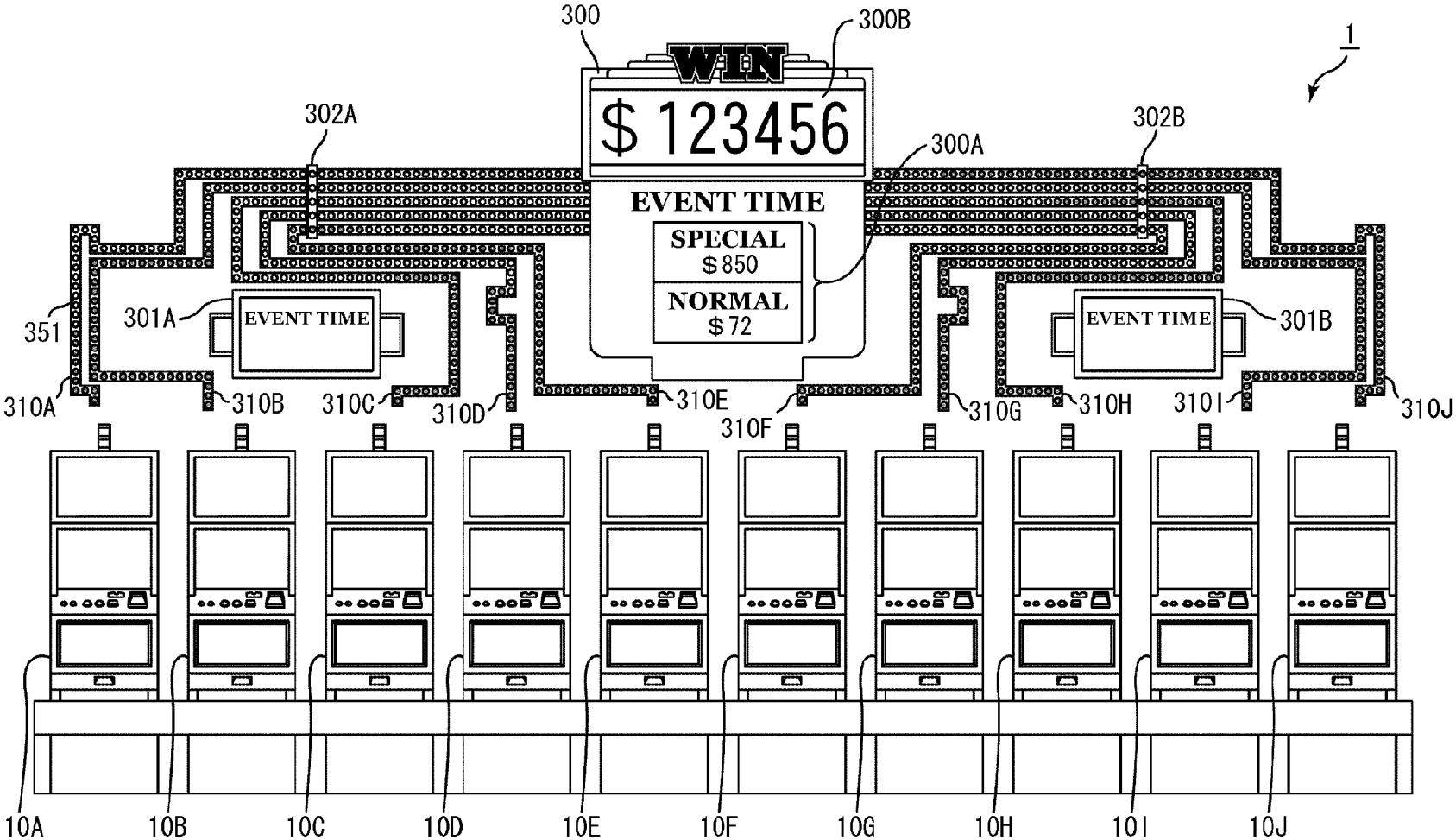
FIG. 1 is a front view schematically illustrating a gaming system according to a first embodiment of a present invention.

FIG. 1 is a front view schematically illustrating a gaming system according to a first embodiment of a present invention.

As illustrated in FIG. 1, a gaming system 1 includes a plurality of slot machines 10 (a slot machine 10A, a slot machine 10B, a slot machine 10C, a slot machine 10D, a slot machine 10E, a slot machine 10F, a slot machine 10G, a slot machine 10H, a slot machine 10I, and a slot machine 10J), a control device 200 (see FIG. 5), a common large display 300, and a plurality of common compact displays 301 (a common compact display 301A and a common compact display 301B), which are interconnected through a network.

Further, for the respective slot machines 10, there are provided coupling illumination lines 310 (a coupling illumination line 310A, a coupling illumination line 310B, a coupling illumination line 310C, a coupling illumination line 310D, a coupling illumination line 310E, a coupling illumination line 310F, a coupling illumination line 310G, a coupling illumination line 310H, a coupling illumination line 310I, and a coupling illumination line 310J) which include a plurality of LEDs 351 arranged from the common large display 300 to the respective slot machines 10. The coupling illumination lines 310 are each formed by a straight portion extending from the common large display 300 to one of boundary plates 302 (a boundary plate 302A and a boundary plate 302B), and a bent portion extending from one of the boundary plates 302 to the slot machine 10.

The slot machines 10 correspond to the gaming machines of the present invention.

In the gaming system 1 according to the present embodiment, a common game and a normal game are executed. There are two kinds of common games. One is a SPECIAL common game and the other is a NORMAL common game. In the gaming system 1, a part of coins betted in each slot machine 10 are cumulatively counted as a cumulative value. More specifically, 0.5% of the betted coins are cumulatively counted as a NORMAL cumulative value. Further, 3% of the betted coins are cumulatively counted as a SPECIAL cumulative value.

It is to be noted that the NORMAL cumulative value corresponds to the first individual cumulative value of the present invention. The SPECIAL cumulative value corresponds to the second individual cumulative value of the present invention. Further, the NORMAL cumulative value and the SPECIAL cumulative value respectively correspond to the individual cumulative values of the present invention.

Then, an image 300A showing the NORMAL cumulative value and the SPECIAL cumulative value which have been counted are displayed to the common large display 300. In FIG. 1, "SPECIAL 850" and "NORMAL 72" are displayed to the common large display 300. "SPECIAL 850" indicates that the SPECIAL cumulative value is 850. Further, "NORMAL 72" indicates that the NORMAL cumulative value is 72. When the SPECIAL cumulative value has reached a SPECIAL specific value (1000, in the present embodiment), the SPECIAL common game is executed and coins in number corresponding to the SPECIAL specific value are paid out to any of the slot machines 10. Further, when the NORMAL cumulative value has reached a NORMAL specific value, the NORMAL common game is executed and coins in number corresponding to the NORMAL specific value is paid out to any of the slot machines 10.

It is to be noted that the NORMAL specific value corresponds to the first specific value of the present invention. The SPECIAL specific value corresponds to the second specific value of the present invention. Further, the NORMAL specific value and the SPECIAL specific value respectively correspond to the specific values of the present invention.

As above described, in the gaming system 1, parts of the betted coins are accumulated in association with the respective two common games individually. When the cumulative value (SPECIAL cumulative value, NORMAL cumulative value) has reached the specific value (SPECIAL specific value, NORMAL specific value), the common game is generated. Accordingly, generation timing of the two common games are independent of each other. Consequently, it is possible to provide a new-type common game which can make the player have an expectation about which game will be generated at which timing.

Further, in the gaming system 1, 1% of the betted coins are cumulatively counted as a solo-progressive cumulative value, in addition to the NORMAL cumulative value and the SPECIAL cumulative value. Furthermore, an image 300B indicative of the counted solo-progressive cumulative value is displayed to the common large display 300. In FIG. 1, "123456" is displayed to the common large display 300, indicating that the solo-progressive cumulative value is 123456. When the solo-progressive cumulative value has reached a solo-progressive specific value, the normal game in each slot machine 10 goes into a state that a solo progressive may be generated. In a case where the solo progressive is generated in any of the slot machines 10, coins are paid out to the slot machine 10 as a jackpot.

Figure 2A:
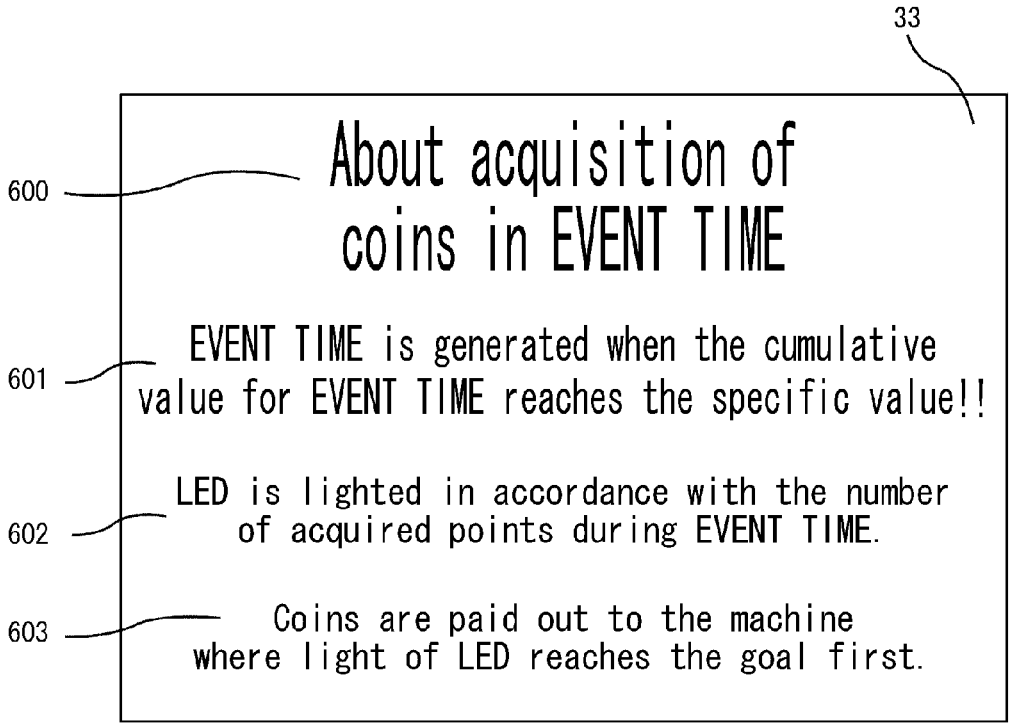
FIG. 2A is a view illustrating an exemplary image displayed to an upper image display panel included in a slot machine forming a gaming system according to the first embodiment.
Figure 2B:
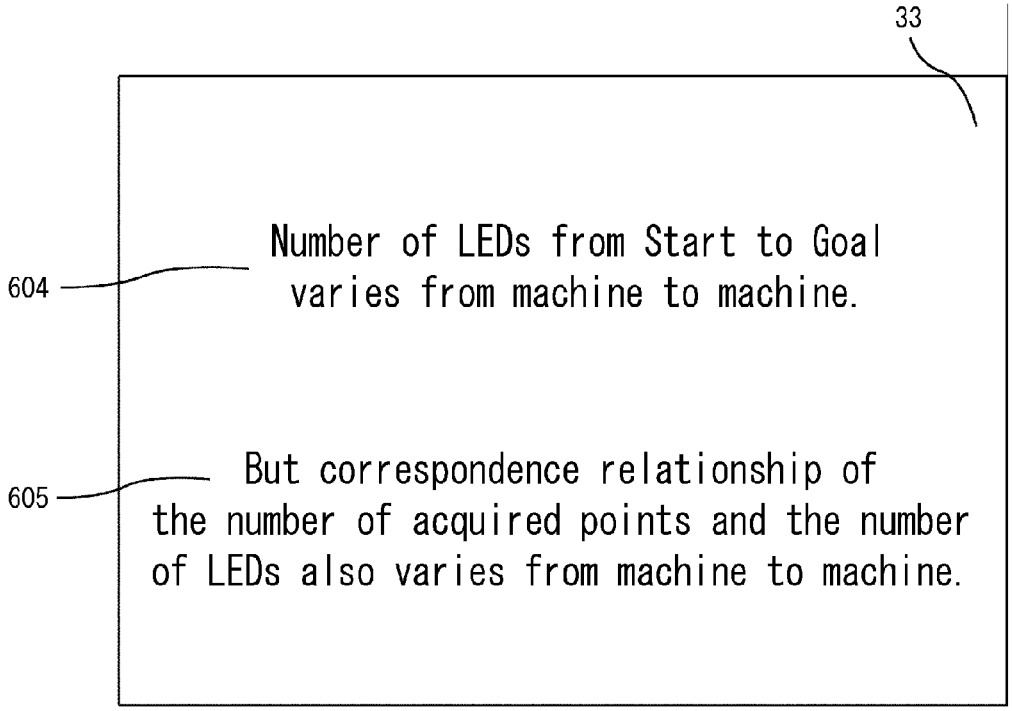
FIG. 2B is a view illustrating an exemplary image displayed to the upper image display panel included in the slot machine forming the gaming system according to the first embodiment.

Next, with reference to FIGS. 2A to 2B, there is described a method for determining the slot machine 10 to which the payout of coins is conducted in the common game.

FIGS. 2A to 2B are views each illustrating an exemplary image displayed to an upper image display panel included in a slot machine forming a gaming system according to the first embodiment.

In the following, when simply "the common game" is referred, both of the SPECIAL common game and the NORMAL common game are included.

As illustrated in FIG. 2A, text images indicative of precautions for an acquisition of the coins in EVENT TIME (the common game) are displayed to an upper image display panel 33.

A text image 601 indicates that EVENT TIME (the common game) is generated triggered by the cumulative value for the common game (the NORMAL cumulative value or the SPECIAL cumulative value) having reached the specific value (the SPECIAL specific value or the NORMAL specific value).

A text image 602 indicates that the LEDs 351 will be lighted according to the number of points acquired in each slot machine 10 during EVENT TIME (the common game). It is to be noted that the acquisition of points will be later described by using FIG. 19 and the like.

A text image 603 indicates that coins in number corresponding to the cumulative value for the common game will be paid out to the slot machine 10 provided with the coupling illumination line 310 with all the LEDs 351 having been lighted.

In the present embodiment, the LEDs 351 are lighted according to the number of acquired points, in an order starting from the LED 351 closest to the slot machines 10. Accordingly, the lines of the lighted LEDs 351 appear to gradually extend toward the common large display 300.

FIG. 2B further illustrates lighting of the LEDs 351.

In the present embodiment, the upper image display panel 33 is configured to switch the text images displayed thereto from the text images illustrated in FIG. 2A to the text images illustrated in FIG. 2B, triggered by a touch on a predetermined position on a touch panel (not illustrated) provided in the upper image display panel 33.

A text image 604 indicates that a number of LEDs included in the coupling illumination line 310 may be different among the coupling illumination lines 310.

In the present embodiment, the same number of LEDs 351 are included in two coupling illumination lines 310 listed in each of the following groups (I) to (V):

(I) the coupling illumination line 310A and the coupling illumination line 310J;

(II) the coupling illumination line 310B and the coupling illumination line 310I;

(III) the coupling illumination line 310C and the coupling illumination line 310H;

(IV) the coupling illumination line 310D and the coupling illumination line 310G; and (V) the coupling illumination line 310E and the coupling illumination line 310F.

However, the numbers of LEDs 351 included in the coupling illumination lines listed in the respective groups (I) to (V) are different from each other.

This difference is caused by the difference in the numbers of LEDs 351 in the bent portions.

The numbers of LEDs 351 in the straight portions are same in all the coupling illumination lines 310.

Further, FIG. 1 merely illustrates the gaming system according to the present embodiment schematically, and the number of LEDs 351 illustrated in FIG. 1 is not related to the number of LEDs 351 according to the present embodiment.

A text image 605 indicates that the correspondence relationship between the number of acquired points and the number of LEDs 351 to be lighted may be different in accordance with the coupling illumination line 310. More specifically, the correspondence relationships between the number of acquired points and the number of LEDs 351 to be lighted are different among the respective groups (I) to (V) (see FIGS. 20A and 20B).

Next, a configuration of the slot machine 10 is described.

Figure 3:
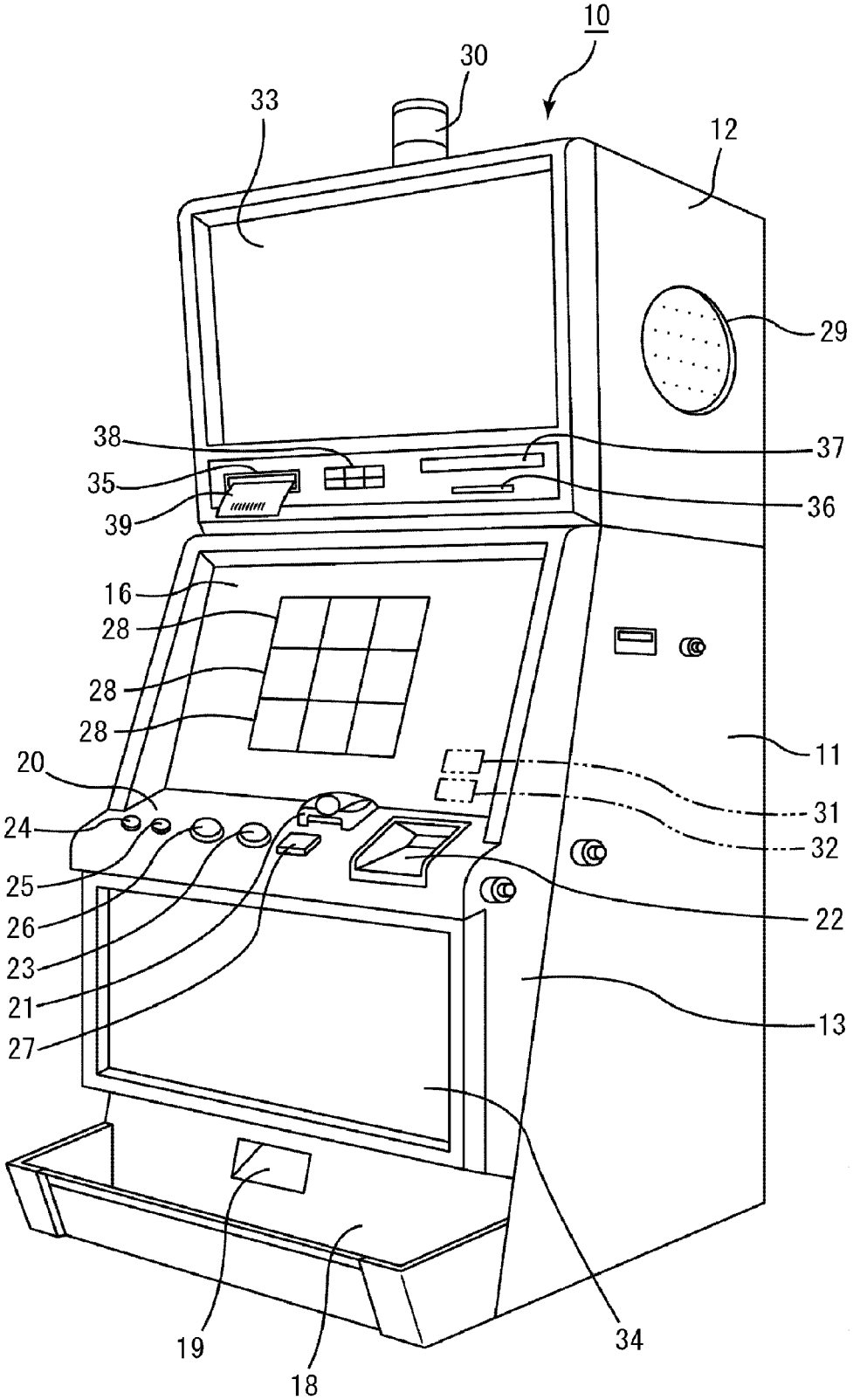
FIG. 3 is a perspective view illustrating an external view of a slot machine forming a gaming system according to the first embodiment.

FIG. 3 is a perspective view illustrating an external view of a slot machine forming the gaming system according to the first embodiment.

In the slot machine 10, a coin, a bill, or electronic valuable information corresponding to those is used as a game medium. However, in the present invention, the game medium is not particularly limited. Examples of the game medium may include a medal, a token, electronic money and a ticket. It is to be noted that the ticket is not particularly limited, and examples thereof may include a ticket with a barcode as described later.

The slot machine 10 comprises a cabinet 11, a top box 12 installed on the upper side of the cabinet 11, and a main door 13 provided at the front face of the cabinet 11.

On the main door 13, there is provided a lower image display panel 16. The lower image display panel 16 includes a transparent liquid crystal panel which displays nine display blocks 28 along three columns and three rows. A single symbol is displayed in each display block 28.

Further, although not illustrated, various types of images relating to an effect, as well as the aforementioned images, are displayed to the lower image display panel 16.

Further, a number-of-credits display portion 31 and a number-of-payouts display portion 32 are provided on the lower image display panel 16. The number-of-credits display portion 31 displays an image indicative of the number of credited coins. The number-of-payouts display portion 32 displays an image indicative of the number of coins to be paid out.

Moreover, although not shown, a touch panel 69 is provided at the front face of the lower image display panel 16. The player can operate the touch panel 69 to input a variety of commands.

Below the lower image display panel 16, there are provided a control panel 20 including a plurality of buttons 23 to 27 with each of which a command according to game progress is inputted by the player, a coin receiving slot 21 through which a coin is accepted into the cabinet 11, and a bill validator 22.

The control panel 20 is provided with a start button 23, a change button 24, a CASHOUT button 25, a 1-BET button 26 and a maximum BET button 27. The start button 23 is for inputting a command to start scrolling of symbols. The change button 24 is used for making a request of staff in the recreation facility for exchange. The CASHOUT button 25 is used for inputting a command to pay out credited coins to a coin tray 18.

The 1-BET button 26 is used for inputting a command to bet one coin on a game out of credited coins. The maximum BET button 27 is used for inputting a command to bet the maximum number of coins that can be bet on one game (3 coins in the present embodiment) out of credited coins.

The bill validator 22 not only discriminates a regular bill from a false bill, but also accepts the regular bill into the cabinet 11. It is to be noted that the bill validator 22 may be configured so as to be capable of reading a later-described ticket 39 with a barcode. At the lower front of the main door 13, namely, below the control panel 20, there is provided a belly glass 34 on which a character or the like of the slot machine 10 is drawn.

On the front surface of the top box 12, there is provided the upper image display panel 33. The upper image display panel 33 includes a liquid crystal panel, which displays, for example, images indicative of introductions of the contents of games and explanations about the rules of games as illustrated in FIGS. 2A and 2B.

Further, a speaker 29 is provided in the top box 12. Under the upper image display panel 33, there are provided a ticket printer 35, a card reader 36, a data display 37, and a key pad 38. The ticket printer 35 prints on a ticket a barcode as coded data of the number of credits, a date, an identification number of the slot machines 10, and the like, and outputs the ticket as the ticket 39 with a barcode. The player can make another slot machine read the ticket 39 with a barcode to play a game thereon, or exchange the ticket 39 with a barcode with a bill or the like at a predetermined place in the recreation facility (e.g. a cashier in a casino).

The card reader 36 reads data from a smart card and writes data into the smart card. The smart card is a card owned by the player, and for example, data for identifying the player and data concerning a history of games played by the player are stored therein. Data corresponding to a coin, a bill or a credit may be stored in the smart card. Further, a magnetic stripe card may be adopted in place of the smart card. The data display 37 includes a fluorescent display and the like, and displays, for example, data read by the card reader 36 or data inputted by the player via the key pad 38. The key pad 38 is used for inputting a command and data concerning issuing of a ticket, and the like.

Figure 4:
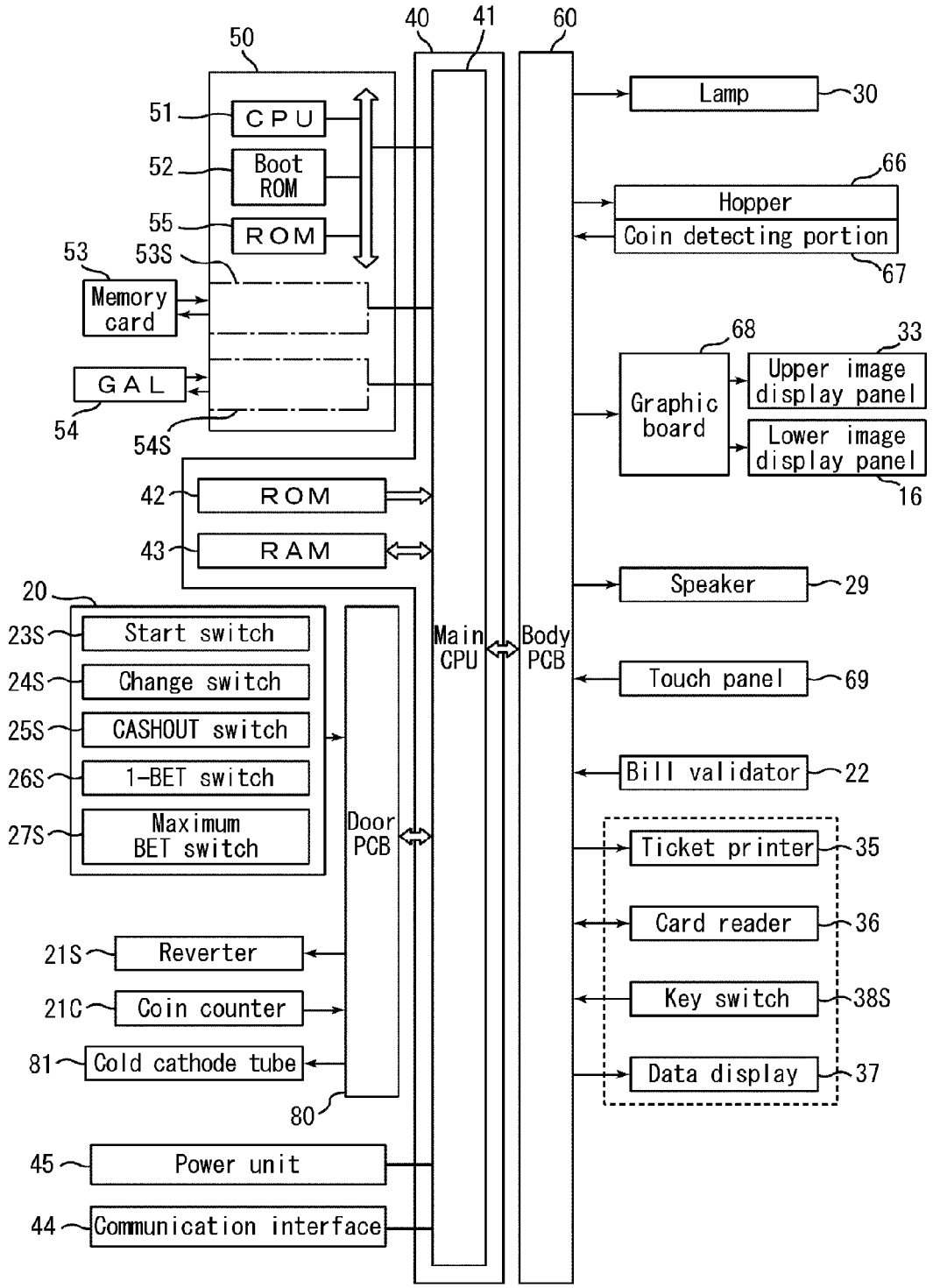
FIG. 4 is a block diagram illustrating an internal configuration of the slot machine shown in FIG. 3.

FIG. 4 is a block diagram showing an internal configuration of the slot machine shown in FIG. 3.

A gaming board 50 is provided with a CPU (Central Processing Unit) 51, a ROM 55, and a boot ROM 52 which are interconnected to one another by an internal bus, a card slot 53S corresponding to a memory card 53, and an IC socket 54S corresponding to a GAL (Generic Array Logic) 54.

The memory card 53 includes a nonvolatile memory such as CompactFlash (registered trade mark), and stores a game program. The game program includes a symbol determination program. The symbol determination program is a program for determining symbols to be rearranged in the display blocks 28. The symbol determination program includes a symbol determination program for the normal game and a symbol determination program for the common game.

In the normal game, the symbol determination program for the normal game is read and executed. At this time, when the solo-progressive cumulative value has reached the solo-progressive specific value, rearrangement of the symbols is to be conducted based on a later-described symbol array table A (see FIG. 9). When the solo-progressive cumulative value has not reached the solo-progressive specific value, rearrangement of the symbols is to be conducted based on a later-described symbol array table B (see FIG. 10). In the present embodiment, when the number of bets is 3 and "BLUE 7-BLUE 7-BLUE 7" are rearranged along a winning line WL (see FIG. 12), the solo progressive is established (see FIG. 11C). However, according to the symbol array table B, "BLUE 7" is not to be displayed to a center display block. Namely, in the present embodiment, the solo progressive is not to be generated by using the symbol array table B.

Further, in the common game, the symbol determination program for the common game is read and executed. At this time, rearrangement of the symbols is to be conducted based on the symbol array table B. In the present embodiment, a common symbol array table, that is, the symbol array table B is used in the normal game, both in the case where the cumulative value for the solo progressive has not reached the solo-progressive specific value and in the case of the common game. However, in the present invention, different symbol array tables may be used in the case where the solo-progressive cumulative value has not reached the solo-progressive specific value and in the case of the common game.

Further, the game program includes odds data indicative of the correspondence relationship between combinations of the symbols to be rearranged along the winning line WL and the number of coin-outs (see FIGS. 11A to 11C).

Further, the card slot 53S is configured so as to allow the memory card 53 to be inserted thereinto or removed therefrom, and is connected to the mother board 40 by an IDE bus. Therefore, the memory card 53 can be removed from the card slot 53S, and then another game program is written into the memory card 53, and the memory card 53 can be inserted into the card slot 53S, to change the type and contents of a game played on the slot machine 10. The game program includes a program according to progress of the game. Further, the game program includes image data and sound data to be outputted during the game.

The CPU 51, the ROM 55 and the boot ROM 52 interconnected to one another by an internal bus are connected to the mother board 40 through the PCI bus. The PCI bus not only conducts signal transmission between the mother board 40 and the gaming board 50, but also supplies power from the mother board 40 to the gaming board 50.

The mother board 40 is configured using a commercially available general-purpose mother board (a print wiring board on which fundamental components of a personal computer are mounted), and provided with a main CPU 41, a ROM (Read Only Memory) 42, a RAM (Random Access Memory) 43, and a communication interface 44. The mother board 40 corresponds to the controller of the present invention.

The ROM 42 comprises a memory device such as a flash memory, and stores a program such as a BIOS (Basic Input/Output System) executed by the main CPU 41 and permanent data. When the BIOS is executed by the main CPU 41, processing for initializing a predetermined peripheral device is conducted, concurrently with start of processing for loading the game program stored in the memory card 53 via the gaming board 50. It is to be noted that, in the present invention, the ROM 42 may or may not be data rewritable one.

The RAM 43 stores data and a program to be used at the time of operation of the main CPU 41. Further, the RAM 43 is capable of storing a game program.

Moreover, the RAM 43 stores data of the number of credits, the numbers of coin-ins and coin-outs in one game, and the like.

Moreover, the mother board 40 is connected with a later-described body PCB (Printed Circuit Board) 60 and a door PCB 80 through respective USBs. Further, the mother board 40 is connected with a power supply unit 45 and the communication interface 44.

The body PCB 60 and the door PCB 80 are connected with an equipment and a device that generate an input signal to be inputted into the main CPU 41 and an equipment and a device operations of which are controlled by a control signal outputted from the main CPU 41. The main CPU 41 executes the game program stored in the RAM 43 based on the input signal inputted into the main CPU 41, and thereby executes the predetermined arithmetic processing and stores the result thereof into the RAM 43, or transmits a control signal to each equipment and device as processing for controlling each equipment and device.

The body PCB 60 is connected with a lamp 30, a hopper 66, a coin detecting portion 67, a graphic board 68, the speaker 29, the touch panel 69, the bill validator 22, the ticket printer 35, the card reader 36, a key switch 38S and the data display 37. The lamp 30 is lighted in a predetermined pattern based on control signals outputted from the main CPU 41.

The hopper 66 is installed inside the cabinet 11, and pays out a predetermined number of coins based on the control signal outputted from the main CPU 41, from a coin payout exit 19 to the coin tray 18. The coin detecting portion 67 is provided inside the coin payout exit 19, and outputs an input signal to the main CPU 41 in the case of detecting payout of the predetermined number of coins from the coin payout exit 19.

The graphic board 68 controls image display to the upper image display panel 33 and the lower image display panel 16 based on the control signal outputted from the main CPU 41. In the respective display blocks 28 on the lower image display panel 16, symbols are displayed in a scrolling manner or in a stopped state. The number of credits stored in the RAM 43 is displayed to the number-of-credits display portion 31 of the lower image display panel 16. Further, the number of coin-outs is displayed to the number-of-payouts display portion 31 of the lower image display panel 16.

The graphic board 68 comprises a VDP (Video Display Processor) for generating image data based on the control signal outputted from the main CPU 41, a video RAM for temporarily storing image data generated by the VDP, and the like. It is to be noted that image data used in generation of the image data by the VDP is included in the game program read from the memory card 53 and stored into the RAM 43.

The bill validator 22 not only discriminates a regular bill from a false bill, but also accepts the regular bill into the cabinet 11. Upon acceptance of the regular bill, the bill validator 22 outputs an input signal to the main CPU 41 based on a face amount of the bill. The main CPU 41 stores in the RAM 43 the number of credits corresponding to the face amount of the bill transmitted with the input signal.

The ticket printer 35, based on the control signal outputted from the main CPU 41, prints on a ticket a barcode as coded data of the number of credits stored in the RAM 43, a date, an identification number of the slot machine 10, and the like, and outputs the ticket as the ticket 39 with a barcode.

The card reader 36 reads data from the smart card and transmits the read data to the main CPU 41, and writes data onto the smart card based on the control signal from the main CPU 41. The key switch 38S is provided on the key pad 38, and outputs a predetermined input signal to the main CPU 41 when the key pad 38 is operated by the player. The data display 37 displays data read by the card reader 36 and data inputted by the player via the key pad 38, based on the control signal outputted from the main CPU 41.

The door PCB 80 is connected with the control panel 20, a reverter 21S, a coin counter 21C, and a cold cathode tube 81. The control panel 20 is provided with a start switch 23S corresponding to the start button 23, a change switch 24S corresponding to the change button 24, a CASHOUT switch 25S corresponding to the CASHOUT button 25, a 1-BET switch 26S corresponding to the 1-BET button 26, and a maximum BET switch 27S corresponding to the maximum BET button 27. Each of the switches 23S to 27S outputs an input signal to the main CPU 41 when each of the buttons 23 to 27 corresponding thereto is operated by the player.

The coin counter 21C is provided inside the coin receiving slot 21, and discriminates a regular coin from a false coin inserted into the coin receiving slot 21 by the player. Coins other than the regular coin are discharged from the coin payout exit 19. Further, the coin counter 21C outputs an input signal to the main CPU 41 in detection of the regular coin.

The reverter 21S operates based on the control signal outputted from the main CPU 41, and distributes a coin recognized by the coin counter 21C as the regular coin into a cash box (not shown) or the hopper 66, which are disposed in the slot machine 10. Namely, when the hopper 66 is filled with coins, the regular coin is distributed into the cash box by the reverter 21S. On the other hand, when the hopper 66 is not filled with coins, the regular coin is distributed into the hopper 66. The cold cathode tube 81 functions as a back light installed on the rear face side of the lower image display panel 16 and the upper image display panel 33, and lighted up based on the control signal outputted from the main CPU 41.

Figure 5:
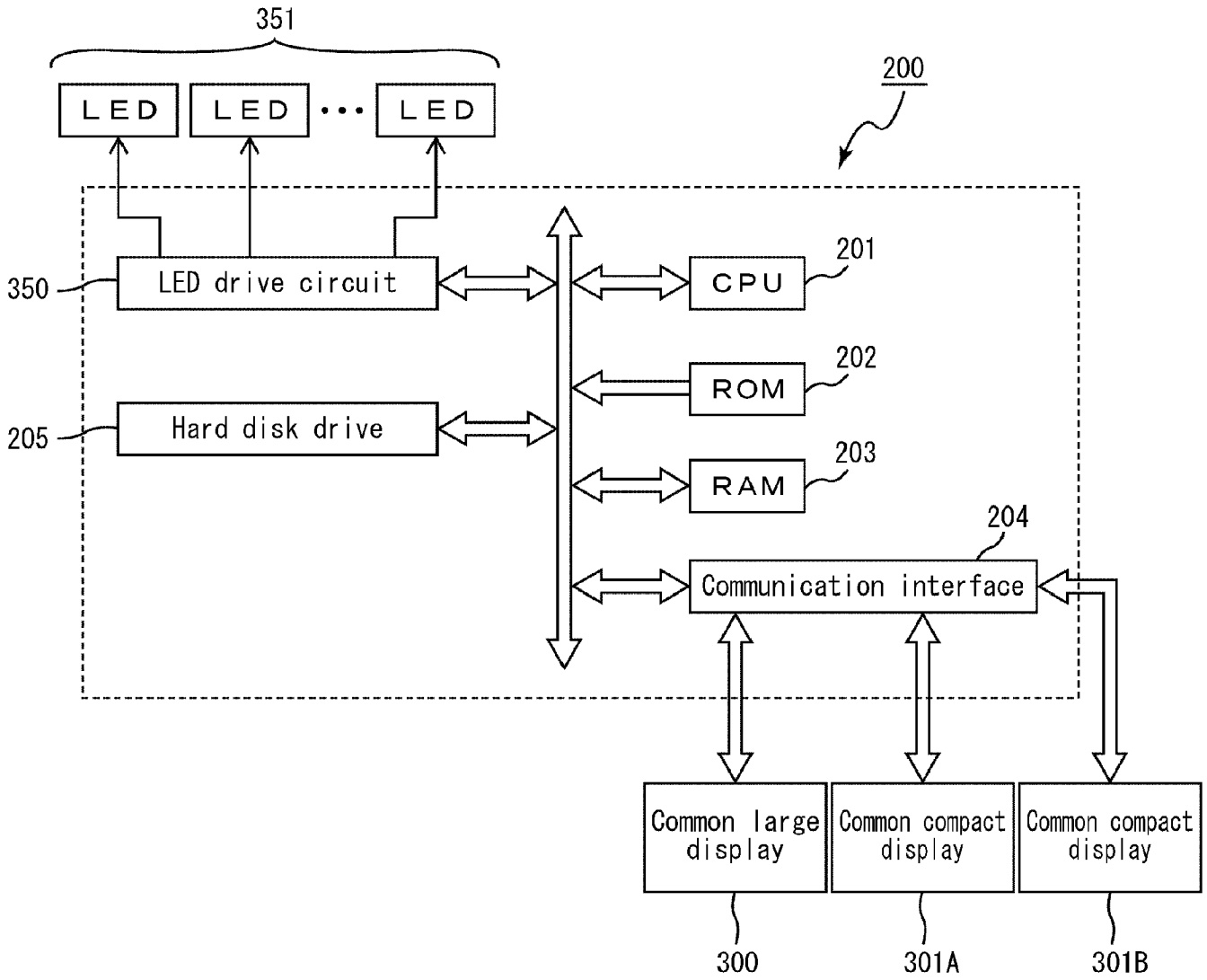
FIG. 5 is a block diagram illustrating an internal configuration of a control device forming the gaming system according to the first embodiment.

FIG. 5 is a block diagram illustrating an internal configuration of a control device forming the gaming system according to the first embodiment.

The control device 200 includes a CPU 201, a ROM 202, a RAM 203, a communication interface 204, a LED drive circuit 350 and a hard disk drive 205. The communication interface 204 is connected, through communication lines 101, to the communication interfaces 44 in the respective slot machines 10 and also is connected to the common large display 300 and the common compact displays 301 through communication lines 102. The ROM 202 stores a system program for controlling the operation of a processor, permanent data, and the like.

The RAM 203 temporarily stores data received from each slot machine 10. The RAM 203 is provided with an increment-rate storage area (see FIG. 15), a cumulative-value storage area (see FIG. 16), a specific-value storage area (see FIG. 17), a number-of-lighting determination table storage area (see FIGS. 20A and 20B), and a number-of-lights storage area.

The increment-rate storage area stores a SPECIAL increment rate, a NORMAL increment rate, and a solo-progressive increment rate.

The cumulative-value storage area stores the SPECIAL cumulative value, the NORMAL cumulative value, and the solo-progressive cumulative value.

The number-of-lighting determination table storage area stores number-of-lighting determination table data to be referred in determining the number of LEDs 351 to be lighted during the common game, in association with the identification numbers of the slot machines 10.

The number-of-lights storage area stores number-of-lights data indicative of the numbers of LEDs 351 which have been lighted, out of the LEDs 351 included in the coupling illumination lines 310 provided for the respective slot machines 10, in association with the identification numbers of the slot machines 10 provided with the corresponding coupling illumination line 310.

The hard disk drive 205 stores number-of-lighting determination table data showing a plurality of types of number-of-lighting determination tables (a number-of-lighting determination table for bent portions and a number-of-lighting determination table for straight portions).

Further, the hard disk drive 205 stores number-of-points determination table data to be referred to in determining the number of points in the common game.

The plurality of LEDs 351 are connected to the LED drive circuit 350. The LEDs 351 are associated with respective identification numbers, and the LED drive circuit 350 turns on and turns off the LEDs 351 based on a signal received from the CPU 201.

Next, there is described processing executed in the slot machines 10.

The main CPU 41 proceeds with a slot machine game by reading and executing the game program.

Figure 6:
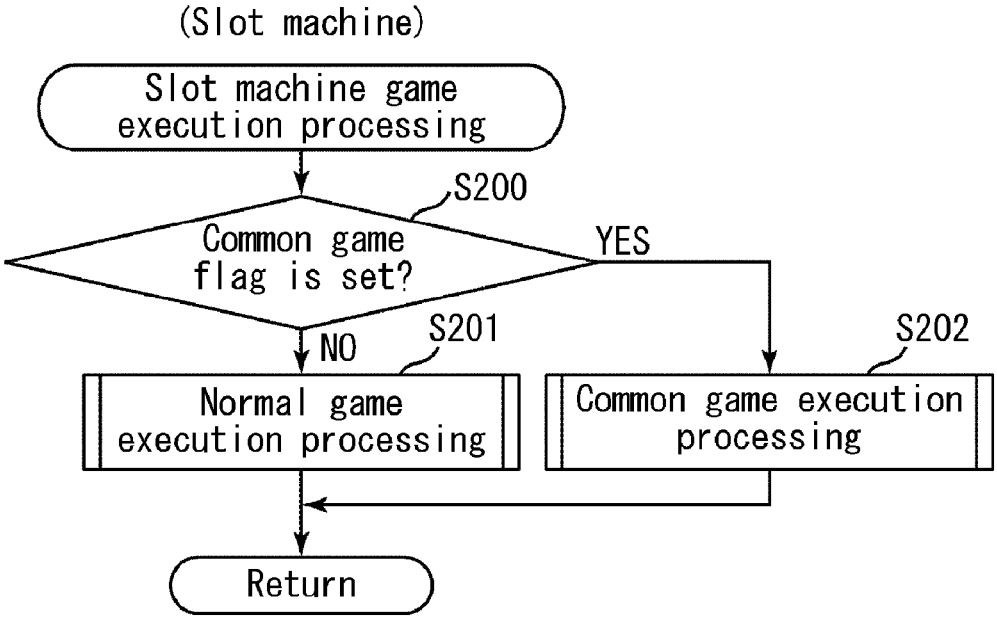
FIG. 6 is a flowchart illustrating slot-machine game execution processing executed in a slot machine in the first embodiment.

FIG. 6 is a flowchart illustrating slot-machine game execution processing executed in the slot machines 10 in the first embodiment.

At first, the main CPU 41 determines whether or not a common-game flag is set (step S200). The common-game flag is a flag to be set when the common-game execution signal is received, which is to be transmitted from the control device 200 triggered by the cumulative value (the NORMAL cumulative value or the SPECIAL cumulative value) having reached the common-game specific value (the NORMAL specific value or the SPECIAL specific value).

When determining in step S200 that the common-game flag is not set, the main CPU 41 executes normal game execution processing (step S201). The normal game execution processing will be described in more detail later with reference to FIG. 8. After executing the processing of step S201, the main CPU 41 completes the present subroutine.

On the other hand, when determining that the common-game flag is set, the main CPU 41 executes common game execution processing (step S202). The common game execution processing will be described in more detail later with reference to FIG. 13. After executing the processing of step S202, the main CPU 41 completes the present subroutine.

Figure 7:
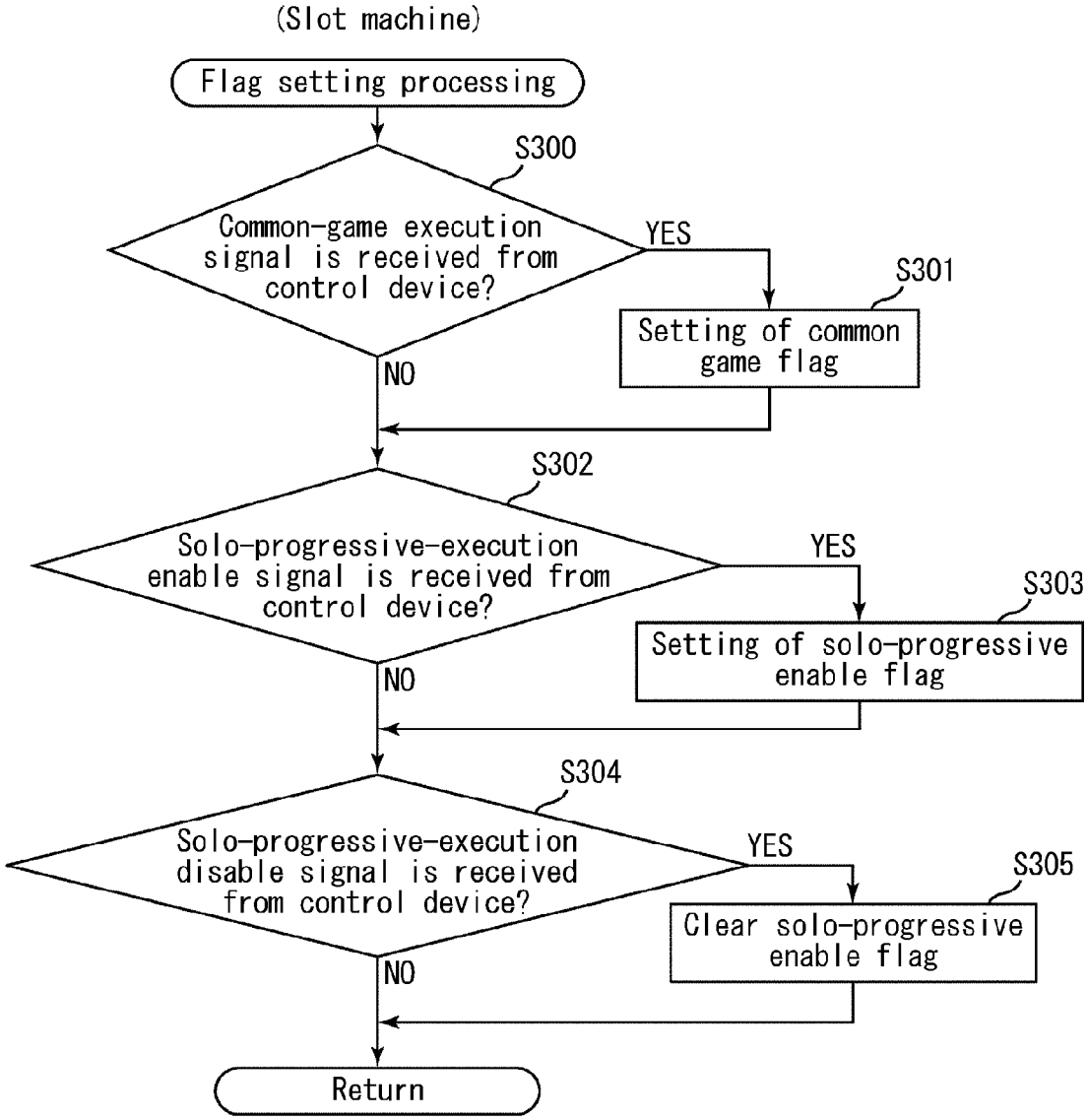
FIG. 7 is a flowchart illustrating a subroutine of flag setting processing in the first embodiment.

FIG. 7 is a flowchart illustrating a subroutine of flag setting processing in the first embodiment.

At first, the main CPU 41 determines whether or not to have received a common-game execution signal (step S300). The common-game execution signal is a signal transmitted from the control device 200 triggered by the common-game cumulative value having reached the common-game specific value (see steps S104 and S105 in FIG. 14).

When determining to have received the common-game execution signal, the main CPU 41 sets the common-game flag in a predetermined area of the RAM 43 (step S301).

When determining not to have received the common-game execution signal in step S300, or after the processing of step S301, the main CPU 41 determines whether or not to have received a solo-progressive-execution enable signal from the control device 200 (step S302). The solo-progressive-execution enable signal is a signal to be transmitted from the control device 200 triggered by the solo-progressive cumulative value having reached the solo-progressive specific value (see steps S107 and S108 in FIG. 14).

When determining to have received the solo-progressive-execution enable signal from the control device 200, the main CPU 41 sets the solo-progressive enable flag in a predetermined area of the RAM 43 (step S303).

When determining not to have received the solo-progressive-execution enable signal from the control device 200, or after the processing of step S303, the main CPU 41 determines whether or not to have received a solo-progressive-execution disable signal from the control device 200 (step S304). The solo-progressive-execution disable signal is the signal to be transmitted from the control device 200 when the solo progressive is generated in any of the slot machines 10 and the solo-progressive cumulative value becomes smaller than the solo-progressive specific value (see steps S163 and S164 in FIG. 21).

When determining to have received the solo-progressive-execution disable signal from the control device 200, the main CPU 41 clears the solo-progressive enable flag set in the RAM 43 and completes the present subroutine. On the other hand, when determining not to have received the solo-progressive-execution disable signal from the control device 200 in step S304, the main CPU 41 completes the present subroutine.

Figure 8:
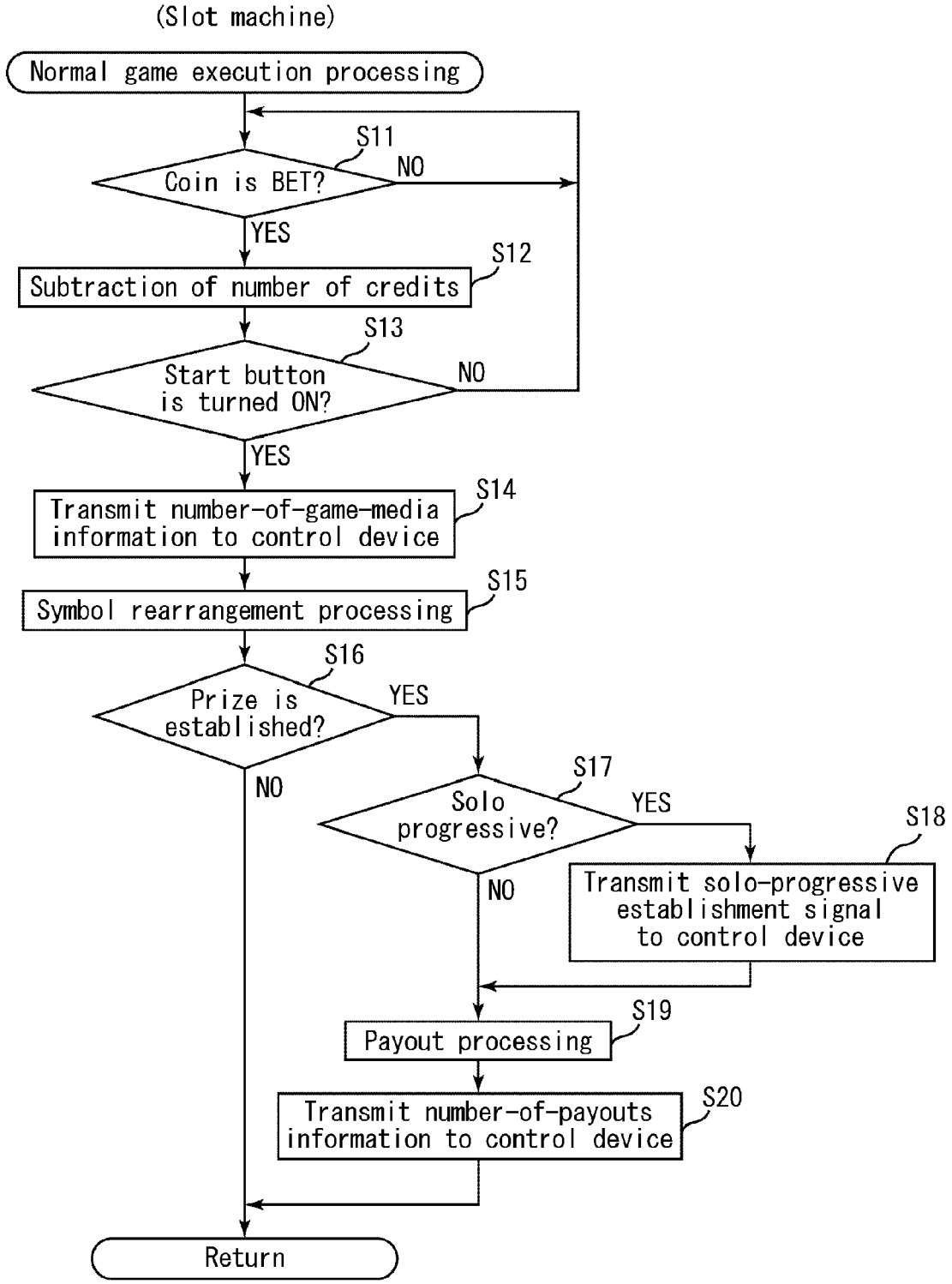
FIG. 8 is a flowchart illustrating a subroutine of normal game execution processing in the first embodiment.

FIG. 8 is a flowchart illustrating a subroutine of normal game execution processing in the first embodiment.

First, the main CPU 41 determines whether or not a coin has been betted (step S11). In this processing, the main CPU 41 determines whether or not to have received an input signal that is outputted from the 1-BET switch 26S when the 1-BET button 26 is operated, or an input signal that is outputted from the maximum BET switch 27S when the maximum BET button 27 is operated. When the main CPU 41 determines that the coin has not been betted, the processing is returned to step S11.

On the other hand, when determining that the coin has been betted in step S11, the main CPU 41 conducts processing for making a subtraction from the number of credits stored in the RAM 43 according to the number of betted coins (step S12). It is to be noted that, when the number of coins to be betted is larger than the number of credits stored in the RAM 43, the main CPU 41 does not conduct the processing for making a subtraction from the number of credits stored in the RAM 43, and the processing is returned to step S11. Further, when the number of coins to be betted exceeds the upper limit of the number of coins that can be betted in one game (3 coins in the present embodiment), the main CPU 41 does not conduct the processing for making a subtraction from the number of credits stored in the RAM 43, and the processing is proceeded to step S13.

Next, the main CPU 41 determines whether or not the start button 23 has been turned ON (step S13). In this processing, the main CPU 41 determines whether or not to have received an input signal that is outputted from the start switch 23S when the start button 23 is pressed.

When the main CPU 41 determines that the start button 23 has not been turned on, the processing is returned to step S11. It is to be noted that, when the start button 23 is not turned ON (e.g. when the start button 23 is not turned ON and a command to end the game is inputted), the main CPU 41 cancels a subtraction result in step S12.

On the other hand, when determining in step S13 that the start button 23 has been turned on, the main CPU 41 transmits number-of-game-media information indicative of the number of betted coins to the control device 200 (step S14). The number-of-game-media information includes information indicative of the identification number of the slot machine 10.

Next, the main CPU 41 executes symbol rearrangement processing (step S15). In this processing, at first, the main CPU 41 starts scrolling-display of normal symbols in the display blocks 28. Then, the main CPU 41 executes the aforementioned symbol determination program for the normal game, so as to determine the symbols to be rearranged, and then rearranges the symbols in the display blocks 28. At this time, when the solo-progressive enable flag is set in the RAM 43, the symbols are rearranged based on a symbol array table A (see FIG. 9). When the solo-progressive enable flag is not set in the RAM 43, the symbols are rearranged based on the symbol array table B (see FIG. 10).

FIG. 9 is a view illustrating the symbol array table A in the first embodiment.

FIG. 10 is a view illustrating the symbol array table B in the first embodiment.

In the array tables A and B, symbol columns to be arranged in a left column, a center column, and a right column of the display blocks 28 are determined. In the array table B, since there is no "BLUE 7" in the symbol column in the center column, "BLUE 7-BLUE 7-BLUE 7" is not to be established. On the other hand, in the array table A, since there are "BLUE 7" in all symbol columns in the left column, the center column, and the right column, it is possible that "BLUE 7-BLUE 7-BLUE 7"is established.

FIGS. 11A to 11C are views each illustrating a corresponding relationship between a combination of symbols and an amount of payout in the first embodiment.

As shown in FIGS. 11A to 11C, in the present embodiment, the relation between the combination of symbols and the number of coin-outs is varied according to the cases where the number of betted coins is one, two, and three.

It is to be noted that in the drawings, "any bar" refers to any symbol among "3 bar", "2 bar", and "1 bar". As shown in FIG. 11C, in the case where the number of betted coins is three and "BLUE 7-BLUE 7-BLUE 7" is established, the solo progressive is generated.

Figure 12:
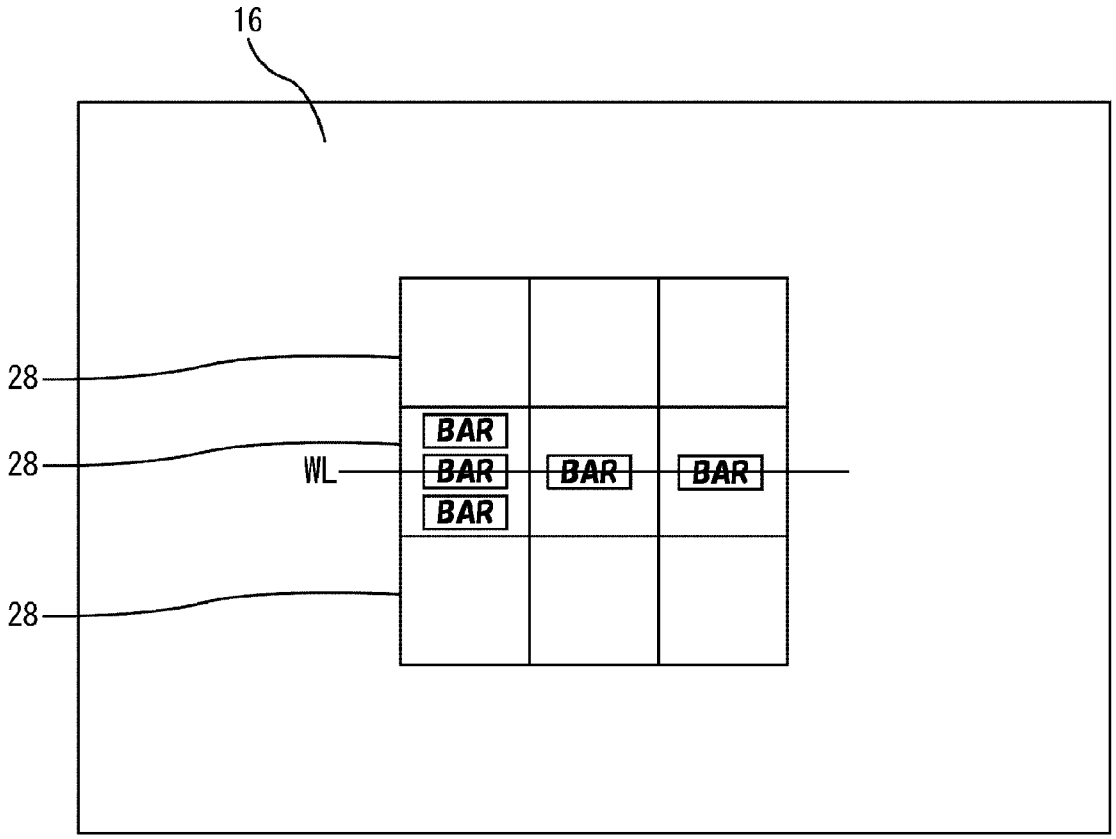
FIG. 12 is an exemplary view illustrating symbols rearranged in display blocks in the first embodiment.

FIG. 12 is an exemplary view illustrating symbols rearranged in display blocks in the first embodiment.

As shown in FIG. 12, the winning line WL is set on the center row of the display blocks 28. When the symbols in a predetermined combination are rearranged on the winning line WL, a payout of coins is conducted.

After the processing of step S15 (see FIG. 8), the main CPU 41 determines whether or not a prize has been established (step S16). Here, the establishment of the prize refers to an establishment of any combinations of symbols shown in FIGS. 11A to 11C.

When determining that the prize has been established, the main CPU 41 determines whether or not the prize of the solo progressive is established (step S17). When determining that the prize of the solo progressive is established, the main CPU 41 transmits a solo-progressive establishment signal to the control device 200 (step S18).

When determining that the prize of the solo progressive has not been established in step S17, or after the processing of step S18, the main CPU 41 executes processing relating to the payout of coins (step S19). In the processing, the main CPU 41 determines the amount of payout based on the rearranged symbols with reference to the odds data stored in the RAM 43. The odds data is data indicative of the correspondence relationship between the symbols rearranged in the display blocks 28 and the amount of payouts (see FIGS. 11A to 11C). Here, in the case where the prize is the solo progressive, the coins are paid out in number corresponding to the solo-progressive specific value (150000, in the present embodiment).

In the case of accumulating coins, the main CPU 41 conducts processing for adding the number of credits corresponding to the determined amount of payout to the number of credits stored in the RAM 43. On the other hand, in the case of paying out coins, the main CPU 41 transmits a control signal to the hopper 66 in order to pay out coins in an amount corresponding to the determined amount of payout.

Then, the main CPU 41 transmits number-of-payout information indicative of the determined amount of payout, that is, the number of paid out coins to the control device 200 (step S20).

When determining in step S16 that no prize has been established, or after executing the processing of step S20, the main CPU 41 completes the present subroutine.

Subsequently, the common game execution processing is described.

Figure 13:
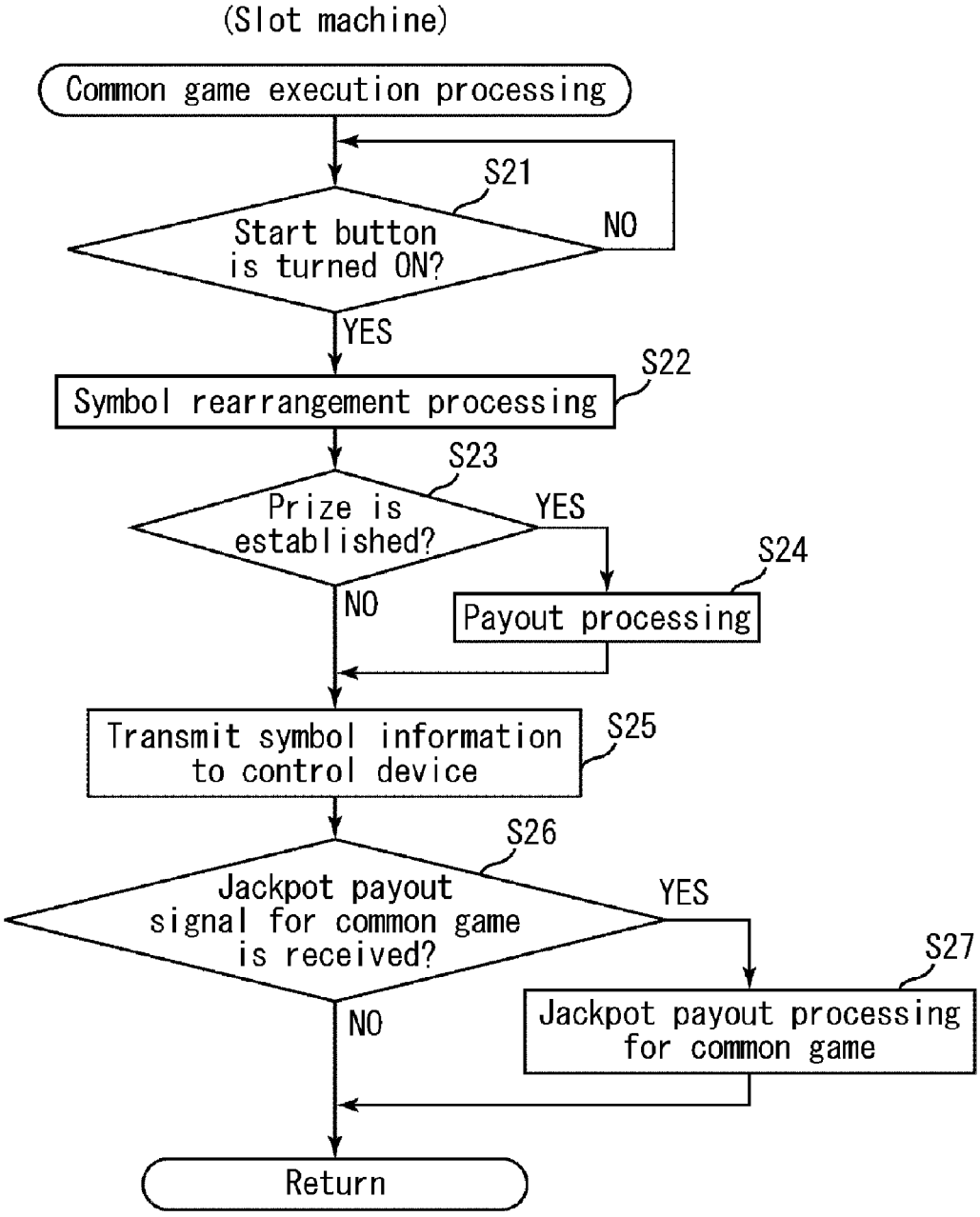
FIG. 13 is a flowchart illustrating a subroutine of common game execution processing in the first embodiment.

FIG. 13 is a flowchart illustrating a subroutine of the common game execution processing in the first embodiment.

At first, the main CPU 41 executes processing of steps S21 to S24, and these processing are substantially the same as the processing of step S13 and steps S15 to S17 in FIG. 8. Here, only a part different from step S13 and steps S15 to S17 in FIG. 8 is described.

There has been described a case where the main CPU 41 executes the symbol determination program for the normal game in step S15 in FIG. 8 for determining symbols to be rearranged, and then, rearranges the symbols in the display blocks 28. On the contrary, in step S22 in FIG. 13, the main CPU 41 executes the symbol determination program for the common game for determining symbols to be rearranged, and then, rearranges the symbols in the display blocks 28.

When determining in step S23 that no prize has been established or after executing the processing of step S24, the main CPU 41 transmits symbol information to the control device 200 (step S25). The symbol information is information indicative of the common-game symbols rearranged in step S22. The symbol information corresponds to common-game result information according to the present invention.

Next, the main CPU 41 determines whether or not to have received a jackpot payout signal for the common game (step S26). The jackpot payout signal for the common game is a signal transmitted from the control device 200 to the slot machine 10 triggered by all the LEDs 351 included in the coupling illumination line 310 provided in any of the slot machines 10 having been lighted (see steps S125 to S126 in FIG. 18). The jackpot payout signal for the common game includes information indicative of the NORMAL specific value or the SPECIAL specific value.

When determining to have received the jackpot payout signal for the common game, the main CPU 41 executes jackpot payout processing for the common game (step S27). In this processing, the main CPU 41 pays out coins in number corresponding to the NORMAL specific value or the SPECIAL specific value, based on the information indicative of the cumulative value which is included in the jackpot payout signal for the common game. In the present embodiment, the number corresponding to the NORMAL specific value is 100 and the number corresponding to the SPECIAL specific value is 1000.

The processing executed by the main CPU 41 in step S27 includes output of an annunciation sound from the speaker 29, lighting of the lamp 30, print of the ticket 39 with a barcode indicative of the number of payouts printed thereon, and the like.

When determining not to have received a jackpot payout signal for the common game in step S26 or after executing the processing of step S27, the main CPU 41 completes the present subroutine.

As above, there has been described the processing which is executed in the slot machines 10.

Subsequently, processing executed by the control device 200 is described.

Figure 14:
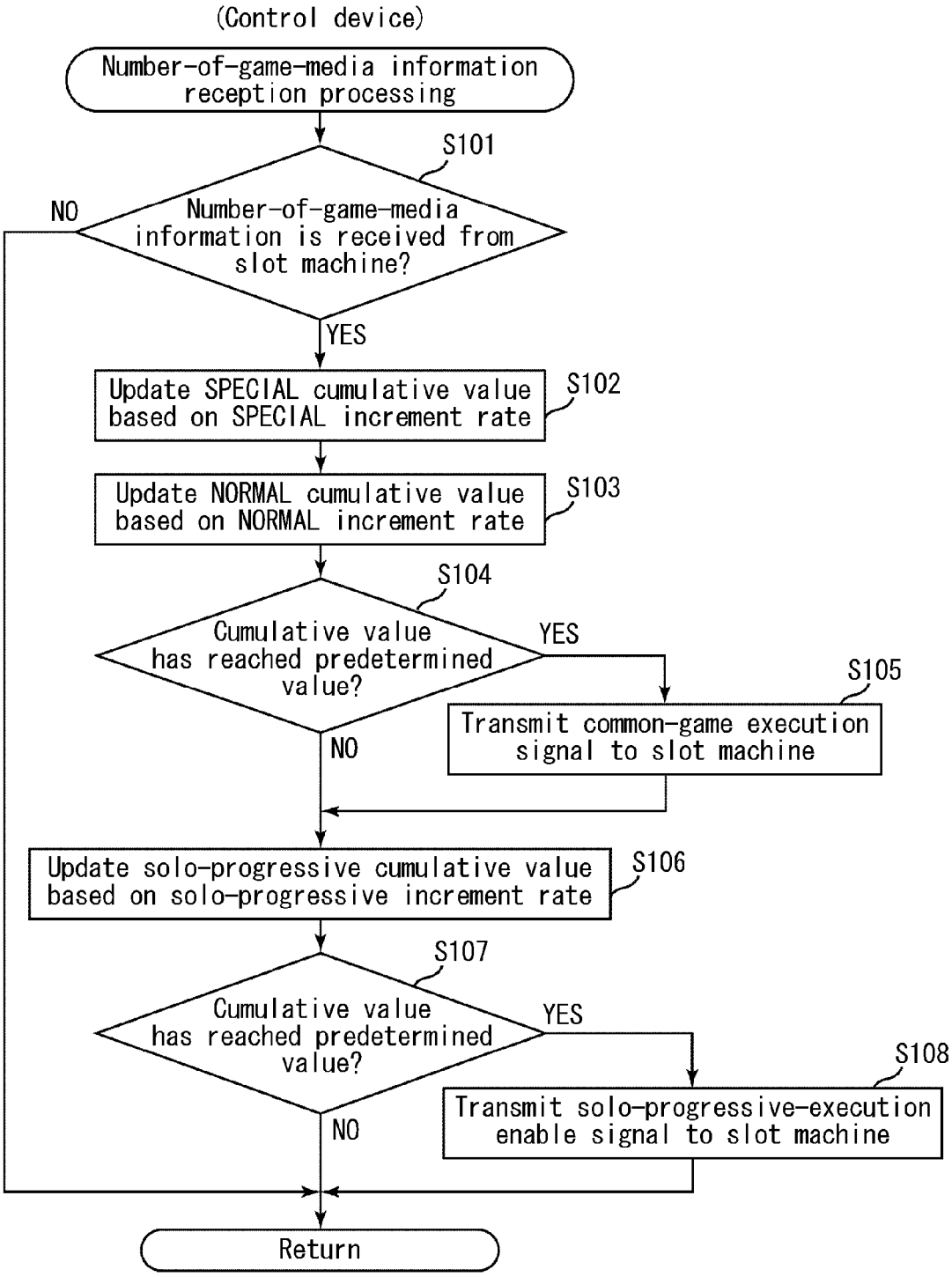
FIG. 14 is a flowchart illustrating a subroutine of number-of-game-media information reception processing in the first embodiment.

FIG. 14 is a flowchart illustrating a subroutine of number-of-game-media information reception processing in the first embodiment.

At first, the CPU 201 determines whether or not to have received the number-of-game-media information from the slot machine 10 at a predetermined timing (step S101). In the present embodiment, the number-of-game-media information is information indicative of the number of coins which have been betted in the slot machine 10 (see step S14 in FIG. 8). When determining not to have received the number-of-game-media information, the CPU 201 completes the present subroutine.

When determining to have received the number-of-game-media information, the CPU 201 updates the SPECIAL cumulative value based on the SPECIAL increment rate stored in the RAM 203 (step S102).

FIG. 15 is a view illustrating an increment-rate storage area in the first embodiment.

As shown in FIG. 15, the RAM 203 in the control device 200 is provided with the increment-rate storage area, which stores an increment rate for the SPECIAL common game (SPECIAL increment rate), an increment rate for the NORMAL common game (NORMAL increment rate), and an increment rate for the solo progressive (solo-progressive increment rate). In the present embodiment, 0.5% as the SPECIAL increment rate, 3% as the NORMAL increment rate, and 1% as the solo-progressive increment rate are stored.

Here, the NORMAL increment rate corresponds to the first predetermined percentage of the present invention. The SPECIAL increment rate corresponds to the second predetermined percentage of the present invention. Further, the NORMAL increment rate and the SPECIAL increment rate correspond to the predetermined percentages of the present invention.

FIG. 16 is a view illustrating the cumulative-value storage area in the first embodiment.

As shown in FIG. 16, the RAM 203 in the control device 200 is provided with the cumulative-value storage area which stores the SPECIAL cumulative value, the NORMAL cumulative value, and the solo-progressive cumulative value.

In the processing of step S102, the CPU 201 adds 0.5% of the number of coins shown by the number-of-game-media information to the SPECIAL cumulative value and stores the resulting value. For example, when the number of coins shown by the number-of-game-media information is 3, the CPU 201 adds 0.015 to the SPECIAL cumulative value and stores the resulting value.

Next, in step S103, the CPU 201 updates the NORMAL cumulative value based on the NORMAL increment rate stored in the RAM 203 (step S103). In the processing of step S103, the CPU 201 adds 3% of the number of coins shown by the number-of-game-media information to the NORMAL cumulative value and stores the resulting value. For example, when the number of coins shown by the number-of-game-media information is 3, the CPU 201 adds 0.09 to the NORMAL cumulative value and stores the resulting value.

Next, the CPU 201 determines whether or not the SPECIAL cumulative value has reached the SPECIAL specific value, or the NORMAL cumulative value has reached the NORMAL specific value, with reference to the cumulative-value storage area and the specific-value storage area of the RAM 203 (see FIG. 17).

FIG. 17 is a view illustrating the specific-value storage area in the first embodiment.

As shown in FIG. 17, the RAM 203 in the control device 200 is provided with the specific-value storage area which stores the SPECIAL specific value and the NORMAL specific value and the solo-progressive specific value. In the present embodiment, 1000 as the SPECIAL specific value, 100 as the NORMAL specific value, and 150000 as the solo-progressive specific value are stored.

When determining that the SPECIAL cumulative value has reached the SPECIAL specific value or that the NORMAL cumulative value has reached the NORMAL specific value, the CPU 201 transmits the common-game execution signal to the slot machines 10 (step S105). The common-game execution signal is a signal which triggers the execution of the common game in the slot machines 10. Further, in this processing, the slot machines 10 to which the common-game execution signal is transmitted from the CPU 201 are the slot machines 10 having transmitted number-of-game-media information in a predetermined time.

When determining that the SPECIAL cumulative value has not reached the SPECIAL specific value and that the NORMAL cumulative value has not reached the NORMAL specific value in step S104, or after the processing of step S105, the CPU 201 shifts the processing to step S106.

In step S106, the CPU 201 updates the solo-progressive cumulative value, based on the solo-progressive increment rate stored in the RAM 203 (step S102). In the present embodiment, the solo-progressive increment rate is set to be 1% (see FIG. 15).

Next, in step S107, the CPU 201 determines whether or not the solo-progressive cumulative value has reached the solo-progressive specific value, with reference to the cumulative-value storage area and the specific value storage area in the RAM 203 (see FIG. 17). When determining that the solo-progressive cumulative value has reached the solo-progressive specific value, the CPU 201 transmits the solo-progressive-execution enable signal to the slot machine 10 (step S108). The solo-progressive-execution enable signal is the signal for notifying approval of the generation of the solo progressive in the slot machine 10. When determining that the solo-progressive cumulative value has not reached the solo-progressive specific value in step S107, or after the processing of step S108, the CPU 201 completes the present subroutine.

Figure 18:
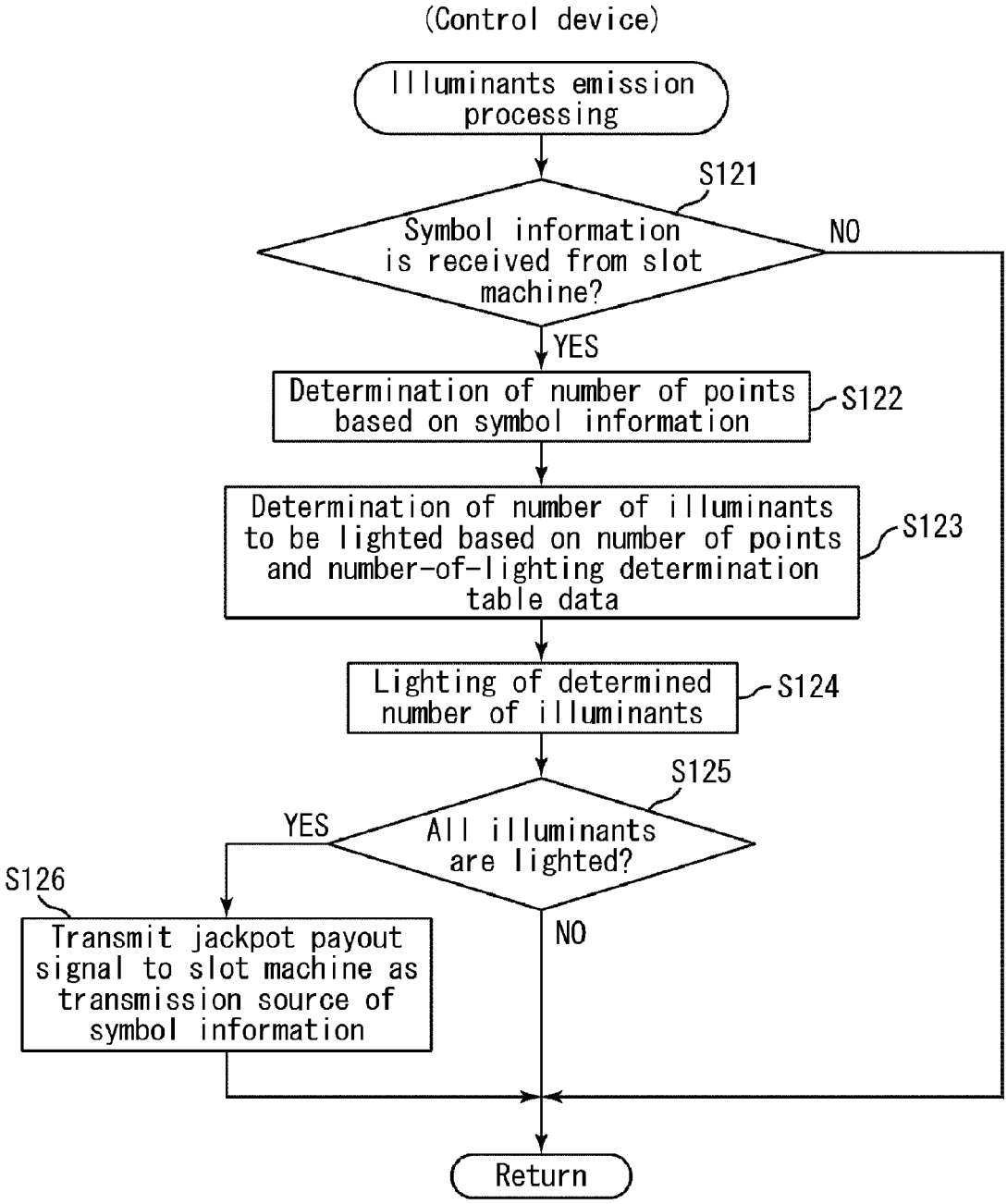
FIG. 18 is a flowchart illustrating a subroutine of illuminants emission processing in the first embodiment.

FIG. 18 is a flowchart illustrating a subroutine of illuminants emission processing in the first embodiment.

At first, the CPU 201 determines whether or not to have received the symbol information (see step S25 in FIG. 13) from the slot machine 10 at a predetermined timing (step S121).

When determining not to have received the symbol information, the CPU 201 completes the present subroutine.

On the other hand, when determining to have received the symbol information, the CPU 201 determines the number of points, based on the symbol information and the number-of-points determination table data stored in the hard disk drive 205 (step S122).

FIG. 19 is a view illustrating a number-of-points determination table in the first embodiment.

As shown in FIG. 19, a correspondence relationship between the combination of symbols and the number of points is determined in the number-of-points determination table. When the combination of the symbols rearranged along the winning line WL is the combination of symbols determined in the number-of-points determination table, points corresponding to the combination of the symbols are offered. The number-of-points determination table data is stored in the hard disk drive 205 in the control device 200. For example, as shown in FIG. 12, when "3 BAR-1 BAR-1 BAR" are rearranged along the winning line WL in the common game played on a single slot machine 10, the number of points is determined to be 50 as a total of 30 based on "3 BAR" and 20 (=10+10) based on two of "1 BAR".

Next, the CPU 201 determines the number of LEDs 351 (illuminants) to be lighted (emit light) based on the determined number of points and the number-of-lighting determination table data (step S123).

FIGS. 20A and 20B are views each illustrating the number-of-lighting determination table in the first embodiment.

The number-of-lighting determination table is a table in which the possible range of the number of points and the number of LEDs 351 to be lighted are associated with each other. Further, in the number-of-lighting determination tables, the correspondence relationship between the number of points and the number of LEDs 351 to be lighted is associated with each slot machine 10.

The number-of-lighting determination table includes the number-of-lighting determination table for bent portions (see FIG. 20A) and the number-of-lighting determination table for straight portions (see FIGS. 20B).

In the number-of-lighting determination table for bent portions, correspondence relationships between the number of points and the number of LEDs 351 to be lighted may be different in accordance with the slot machines 10.

In the number-of-lighting determination table for straight portions, the correspondence relationships between the number of points and the number of LEDs 351 to be lighted are the same with respect to all the slot machines 10.

In the processing of step S123, at first, the CPU 201 determines whether or not the number of lights indicated by the number-of-lights data stored in association with the identification number of the slot machine 10 as a transmission source of the symbol information received in step S121 is equal to or more than a predetermined number (the number of LEDs 351 included in the bent portion of the coupling illumination line 310).

When determining that the number of lights is equal to or more than the predetermined number, the CPU 201 determines the number of LEDs 351 to be lighted based on the number-of-lighting determination table for straight portions. On the other hand, when determining that the number of lights is less than the predetermined number, the CPU 201 determines the number of LEDs 351 to be lighted based on the number-of-lighting determination table for bent portions.

Next, the CPU 201 makes the LEDs 351 (illuminants) in number determined in step S123 be lighted (emit light) in the coupling illumination line 310 provided for the slot machine 10 as a transmission source of the symbol information received in step S121 (step S124).

In this processing, the CPU 201 identifies the identification numbers of the LEDs 351 to be lighted, based on the number determined in step S123 and the number of lights indicated by the number-of-lights data stored in the number-of-lights storage area in the RAM 203 in association with the identification number of the slot machine 10. Further, the CPU 201 transmits to the LED drive circuit 350 a signal including information indicative of the identified identification numbers. On receiving this signal, the LED drive circuit 350 lights the LEDs 351 associated with the identification numbers included in the signal.

Further, after transmitting the signal, the CPU 201 adds the number determined in step S123 to the number of lights indicated by the number-of-lights data stored in the number-of-lights storage area in the RAM 203 in association with the identification number of the slot machine 10.

Next, the CPU 201 determines whether or not all the LEDs 351 (illuminants) included in the coupling illumination line 310 provided for the slot machine 10 as a transmission source of the symbol information received in step S121 have been lighted (emit light) (step S125). In the processing, the CPU 201 determines whether or not the number of lights after the addition of the number determined in step S123 has reached a predetermined number (the number of LEDs 351 included in the coupling illumination line 310), based on the number-of-lights data stored in the RAM 203.

When determining that all the LEDs 351 included in the coupling illumination line 310 provided for the slot machine 10 as a transmission source of the symbol information received in step S121 have been lighted, the CPU 201 transmits the jackpot payout signal for the common game to the slot machine 10 (step S126). It is to be noted that the jackpot payout signal for the common game includes information relating to the type of the common game (SPECIAL or NORMAL) and information relating to the specific value (NORMAL specific value or SPECIAL specific value).

On receiving the jackpot payout signal for the common game, the slot machine 10 executes jackpot payout processing for the common game (see step S27 in FIG. 13).

When determining in step S125 that not all the LEDs 351 have been lighted or after executing the processing of step S126, the CPU 201 completes the present subroutine.

Figure 21:
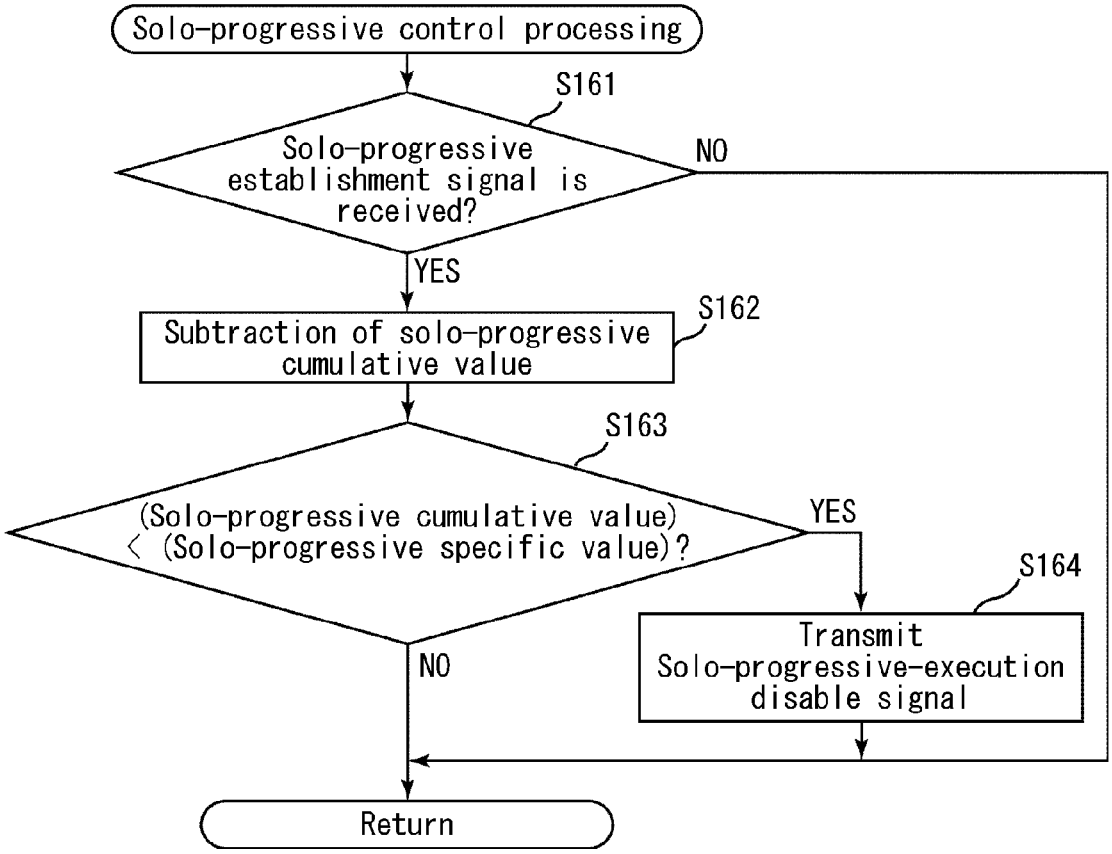
FIG. 21 is a flowchart illustrating a subroutine of solo-progressive control processing in the first embodiment.

FIG. 21 is a flowchart illustrating a subroutine of solo-progressive control processing in the first embodiment.

First, the CPU 201 determines whether or not to have received the solo-progressive establishment signal from the slot machine 10 (step S161). When determining to have received the solo-progressive establishment signal, the CPU 201 subtracts the solo-progressive specific value from the solo-progressive cumulative value (step S162).

Next, the CPU 201 determines whether or not the solo-progressive cumulative value is smaller than the solo-progressive specific value (step S163). When determining that the solo-progressive cumulative value is smaller than the solo-progressive specific value, the CPU 201 transmits the solo-progressive-execution disable signal to the slot machine 10 (step S164).

When determining not to have received the solo-progressive establishment signal in step S161, or when determining that the solo-progressive cumulative value is not smaller than the solo-progressive specific value in step S163, or after the processing of step S164, the main CPU 201 completes the present subroutine.

As above, according to the gaming system 1 and the above-described game control method, two common games (the SPECIAL common game and the NORMAL common game) are provided and the individual cumulative value (the first individual cumulative value, the second individual cumulative value) is counted for each common game. When the NORMAL cumulative value (the first individual cumulative value) has reached the NORMAL specific value (the first specific value), or when the SPECIAL cumulative value (the second individual cumulative value) has reached the SPECIAL specific value (the second specific value), the common game is executed, in which coins in number corresponding to the specific value may be paid out. Since the individual cumulative value is counted individually, respective two common games are generated independently of each other. Accordingly, since the respective individual cumulative values accumulated in the two common games and the specific values are independent of each other, it becomes harder to predict which common game will be generated at which timing. As a result, it is possible to provide a new-type gaming system capable of having a player absorbed in the game.

Further, a part of the betted coins are cumulatively counted at the NORMAL increment rate (the first predetermined percentage (3%, in the present embodiment)), as the NORMAL cumulative value (the first individual cumulative value), and a part of the betted coins are cumulatively counted at the SPECIAL increment rate (the second predetermined percentage (0.5%, in the present embodiment)), as the SPECIAL cumulative value (the second individual cumulative value). When the NORMAL cumulative value (the first individual cumulative value) is determined to have reached the NORMAL specific value (the first specific value (100 in the present embodiment)), the common game is executed, in which coins in number corresponding to the NORMAL specific value (the first specific value) may be paid out. On the other hand, when the SPECIAL cumulative value (the second individual cumulative value) has reached the SPECIAL specific value (the second specific value (1000 in the present embodiment)) that is larger than the NORMAL specific value (the first specific value), the common game is executed, in which coins in number corresponding to the SPECIAL specific value (the second specific value) may be paid out. Namely, for the larger specific value, the smaller percentage for accumulating the cumulative value until reaching the specific value is set. Accordingly, it is possible to have the common game with the large number of payouts be harder to be generated, so that a profit of a recreation facility providing a game by using the gaming system 1 can be ensured. Further, though the common game with the large number of payouts is hard to be generated, the common game with the comparatively smaller number of payouts is generated relatively frequently, so that it becomes possible to prevent the player from getting bored and the player can enjoy the game for a long time.

In the present embodiment, there has been described a case where, in conducting the payout of the jackpot for the common game, 100 coins corresponding to the NORMAL specific value are paid out when the NORMAL common game is played, and 1000 coins corresponding to the SPECIAL specific value are paid out when the SPECIAL common game is played. However, in the present invention, the game media in number corresponding to the first specific value, which are to be paid out from the gaming machine, are not limited to this, and may be the game media in number corresponding to the first individual cumulative value which is cumulatively counted, or the game media in number obtained by subtracting a fixed value from the first specific value.

Further, the game media in number corresponding to the second specific value is not limited to this, and may be the game media in number corresponding to the second individual cumulative value which is cumulatively counted, or the game media in number obtained by subtracting a fixed value from the second specific value.

In the present embodiment, there has been described a case where information indicative of the number of betted coins is transmitted from the slot machine 10 to the control device 200 and the number is multiplied by the increment rate in the control device. However, the present invention is not limited to this example, and the number of betted coins may be multiplied by a percentage (e.g. the first predetermined percentage, the second predetermined percentage) and the result may be transmitted to the control device as the number-of-game-media information. Namely, in the present invention, the number-of-game-media information may be information indicative of the number of betted coins or the value obtained by multiplying the number of betted coins by a percentage, that is, the cumulative value.

In the present embodiment, there has been described a case where the gaming machine of the present invention is a slot machine. However, the gaming machine of the present invention is not limited to this, and may be a gaming machine in which a card game such as poker, or a game such as a shooting game and a fighting game is played.

Further, in the present embodiment, there has been described a case where the common game is a game in which a game result is determined based on rearranged symbols (normal slot machine game). However, in the present invention, the common game is not limited to the case, and a game different from the slot machine game may be played. For example, a card game such as poker, and a game such as a shooting game and a fighting game may be played. In this case, it is desirable to allow players to play the game against one another. This is because such a configuration can enhance player's senses of competition, thereby further having the players become absorbed in the common game.

For example, a following configuration can be adopted.

Namely, each gaming machine is capable of storing a program for executing such a common game. Each gaming machine reads and executes the program, triggered by a reception of a common-game execution signal. Then, the gaming machine transmits information indicative of the result of the common game to the control device. The control device compares the results of the common game in respective gaming machines, so as to determine the gaming machine, to which a payout of the game media based on the common game is conducted.

(Second Embodiment)

A second embodiment of the present invention is described based on the drawings.

At first, with reference to FIG. 22, there will be given a general description of the present embodiment.

Figure 22:
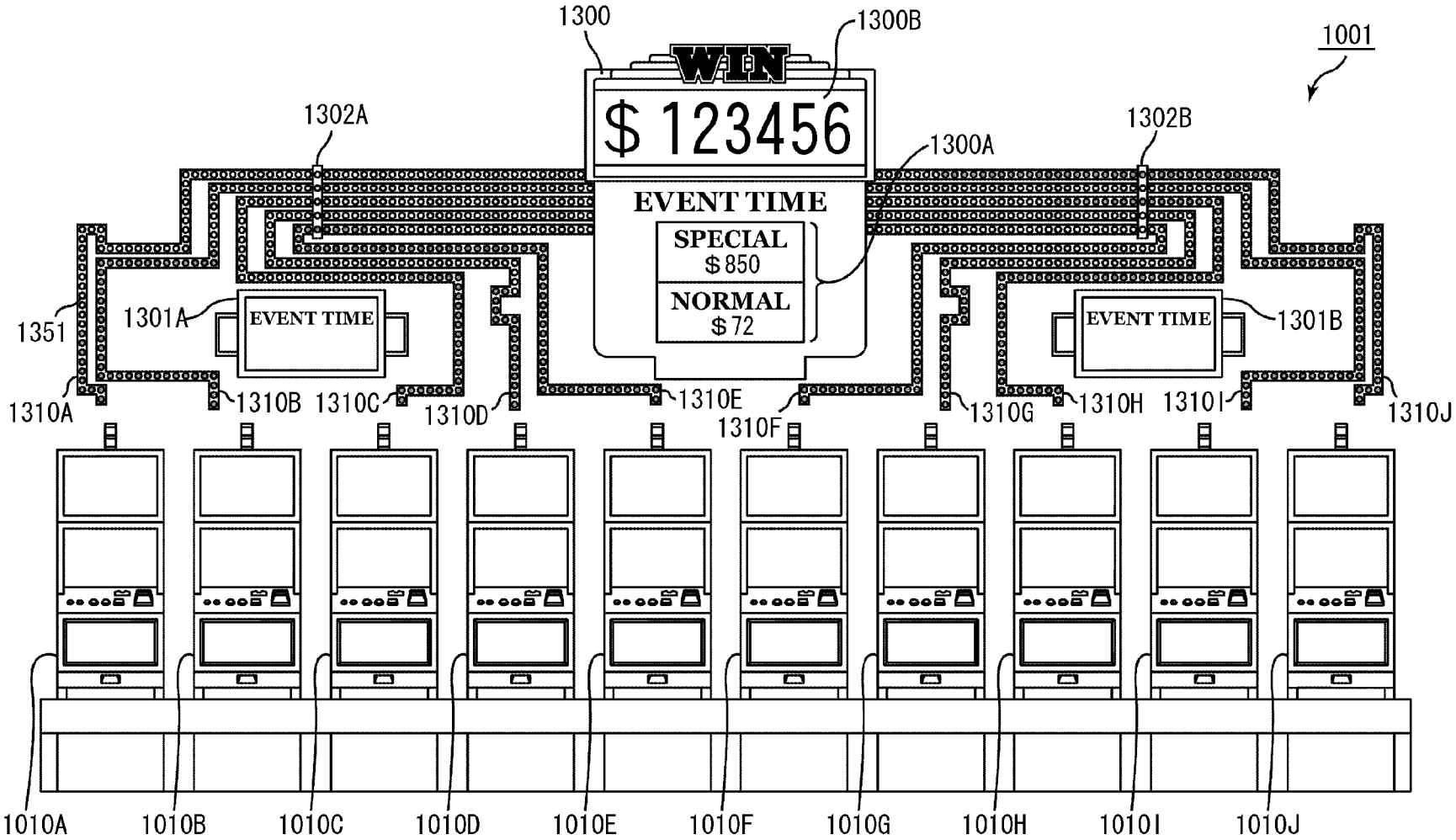
FIG. 22 is a front view schematically illustrating a gaming system according to a second embodiment of a present invention.

FIG. 22 is a front view schematically illustrating a gaming system according to a second embodiment of the present invention.

As illustrated in FIG. 22, a gaming system 1001 includes a plurality of slot machines 1010 (a slot machine 1010A, a slot machine 1010B, a slot machine 1010C, a slot machine 1010D, a slot machine 1010E, a slot machine 1010F, a slot machine 1010G, a slot machine 1010H, a slot machine 1010I, and a slot machine 1010J), a control device 1200 (see FIG. 26), a common large display 1300, and a plurality of common compact displays 1301 (a common compact display 1301A and a common compact display 1301B), which are interconnected through a network.

Further, for the respective slot machines 1010, there are provided coupling illumination lines 1310 (a coupling illumination line 1310A, a coupling illumination line 1310B, a coupling illumination line 1310C, a coupling illumination line 1310D, a coupling illumination line 1310E, a coupling illumination line 1310F, a coupling illumination line 1310G, a coupling illumination line 1310H, a coupling illumination line 1310I, and a coupling illumination line 1310J) which include a plurality of LEDs 1351 arranged from the common large display 1300 to the respective slot machines 1010. The coupling illumination lines 1310 are each formed by a straight portion extending from the common large display 1300 to one of boundary plates 1302 (a boundary plate 1302A and a boundary plate 1302B), and a bent portion extending from one of the boundary plates 1302 to the slot machine 1010.

The slot machine 1010 corresponds to the gaming machine of the present invention.

In the gaming system 1001 according to the present embodiment, a common game and a normal game are executed. There are two kinds of common games. One is a SPECIAL common game and the other is a NORMAL common game. In the gaming system 1001, a part of coins betted in each slot machine 1010 are cumulatively counted as a cumulative value. More specifically, 0.5% of the betted coins are cumulatively counted as a NORMAL cumulative value. Further, 3% of the betted coins are cumulatively counted as a SPECIAL cumulative value. The value of 0.5% is an initial value set as a NORMAL increment rate. Further, the value of 3% is an initial value set as a SPECIAL increment rate. It is to be noted that the NORMAL increment rate and the SPECIAL increment rate can be changed by an input from an input device 1206 (see FIG. 26) provided in the control device 1200.

The NORMAL cumulative value and the SPECIAL cumulative value respectively correspond to the individual cumulative values of the present invention.

Then, an image 1300A showing the NORMAL cumulative value and the SPECIAL cumulative value which have been counted are displayed to the common large display 1300. In FIG. 22, "SPECIAL 850" and "NORMAL 72" are displayed to the common large display 1300. "SPECIAL 850" indicates that the SPECIAL cumulative value is 850. Further, "NORMAL 72" indicates that the NORMAL cumulative value is 72. When the SPECIAL cumulative value has reached a SPECIAL specific value (1000, in the present embodiment), the SPECIAL common game is executed and coins in number corresponding to the SPECIAL specific value are paid out to any of the slot machines 1010. Further, when the NORMAL cumulative value has reached a NORMAL specific value, the NORMAL common game is executed and coins in number corresponding to the NORMAL specific value is paid out to any of the slot machines 1010.

As the NORMAL specific value, 100 is set as an initial value. Further, as the SPECIAL specific value, 1000 is set as an initial value. It is to be noted that the NORMAL specific value and the SPECIAL specific value can be changed by an input from the input device 1206 provided in the control device 1200.

The NORMAL specific value and the SPECIAL specific value correspond to the specific values of the present invention.

As above described, in the gaming system 1001, parts of the betted coins are accumulated in association with the respective two common games individually. When the cumulative value (the SPECIAL cumulative value, the NORMAL cumulative value) has reached the specific value (the SPECIAL specific value, the NORMAL specific value), the common game is generated. Accordingly, generation timing of the two common games are independent of each other. Consequently, it is possible to provide a new-type common game which can make the player have an expectation about which game will be generated at which timing.

Further, in accordance with an input from the input device 1206 provided in the control device 1200, the increment rate and the specific value can be changed. As a result, by setting the increment rate to a lower value or the specific value to a higher value, a generation frequency of the common game can be lowered. Further, by setting the increment rate to a higher value or the specific value to a lower value, the generation frequency of the common game can be raised. Furthermore, by changing the specific value, it is possible to increase or decrease the number of game media to be paid out after the common game.

Further, in the gaming system 1001, 1% of the betted coins are cumulatively counted as a solo-progressive cumulative value, in addition to the NORMAL cumulative value and the SPECIAL cumulative value. Furthermore, an image 1300B indicative of the counted solo-progressive cumulative value is displayed to the common large display 1300. In FIG. 22, "123456" is displayed to the common large display 1300, indicating that the solo-progressive cumulative value is 123456. When the solo-progressive cumulative value has reached a solo-progressive specific value, the normal game in each slot machine 1010 goes into a state that a solo progressive may be generated. In a case where the solo progressive is generated in any of the slot machines 1010, coins are paid out to the slot machine 1010 as a jackpot.

The value of 1% is an initial value set as a solo-progressive increment rate. It is to be noted that the solo-progressive increment rate can be changed by an input from the input device 1206 (see FIG. 26) provided in the control device 1200.

Next, with reference to FIGS. 23A to 23B, there is described a method for determining the slot machine 1010 to which the payout of coins is conducted in the common game.

FIGS. 23A to 23B are views each illustrating an exemplary image displayed to an upper image display panel included in a slot machine forming a gaming system according to the second embodiment.

In the following, when simply "the common game" is referred, both of the SPECIAL common game and the NORMAL common game are included.

As illustrated in FIG. 23A, text images indicative of precautions for an acquisition of the coins in EVENT TIME (the common game) are displayed to an upper image display panel 1033.

A text image 1601 indicates that EVENT TIME (the common game) is generated triggered by the cumulative value for the common game (the NORMAL cumulative value or the SPECIAL cumulative value) having reached the specific value (the SPECIAL specific value or the NORMAL specific value).

A text image 1602 indicates that the LEDs 1351 will be lighted according to the number of points acquired in each slot machine 1010 during EVENT TIME (the common game). It is to be noted that the acquisition of points will be later described by using FIG. 40 and the like.

A text image 1603 indicates that coins in number corresponding to the cumulative value for the common game will be paid out to the slot machine 1010 provided with the coupling illumination line 1310 with all the LEDs 1351 having been lighted.

In the present embodiment, the LEDs 1351 are lighted according to the number of acquired points, in an order starting from the LED 1351 closest to the slot machines 1010. Accordingly, the lines of the lighted LEDs 1351 appear to gradually extend toward the common large display 1300.

FIG. 23B further illustrates lighting of the LEDs 1351.

In the present embodiment, the upper image display panel 1033 is configured to switch the text images displayed thereto from the text images illustrated in FIG. 23A to the text images illustrated in FIG. 23B, triggered by a touch on a predetermined position on a touch panel (not illustrated) provided in the upper image display panel 1033.

A text image 1604 indicates that a number of LEDs included in the coupling illumination line 1310 may be different among the coupling illumination lines 1310.

In the present embodiment, the same number of LEDs 1351 are included in two coupling illumination lines 1310 listed in each of the following groups (I) to (V):

(I) the coupling illumination line 1310A and the coupling illumination line 1310J;

(II) the coupling illumination line 1310B and the coupling illumination line 1310I;

(III) the coupling illumination line 1310C and the coupling illumination line 1310H;

(IV) the coupling illumination line 1310D and the coupling illumination line 1310G; and (V) the coupling illumination line 1310E and the coupling illumination line 1310F.

However, the numbers of LEDs 1351 included in the coupling illumination line listed in the respective groups (I) to (V) are different from each other.

This difference is caused by the difference in the numbers of LEDs 1351 in the bent portions.

The numbers of LEDs 1351 in the straight portions are same in all the coupling illumination lines 1310.

Further, FIG. 22 merely illustrates the gaming system according to the present embodiment schematically, and the number of LEDs 1351 illustrated in FIG. 22 is not related to the number of LEDs 1351 according to the present embodiment.

A text image 1605 indicates that the correspondence relationship between the number of acquired points and the number of LEDs 1351 to be lighted may be different in accordance with the coupling illumination line 1310. More specifically, the correspondence relationships between the number of acquired points and the number of LEDs 1351 to be lighted are different among the respective groups (I) to (V) (see FIGS. 41A and 41B).

Next, a configuration of the slot machine 1010 is described.

Figure 24:
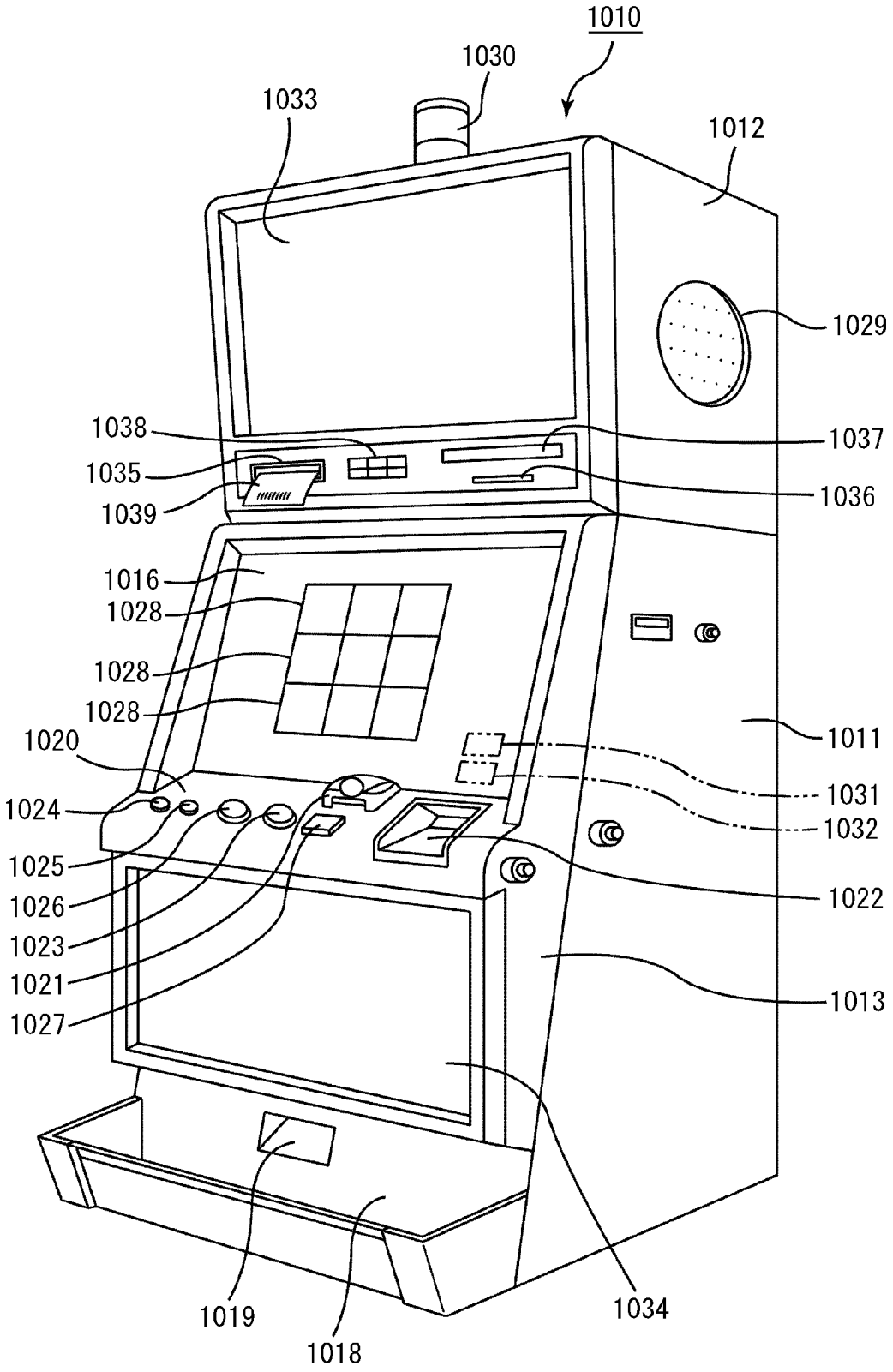
FIG. 24 is a perspective view illustrating an external view of a slot machine forming a gaming system according to the second embodiment.

FIG. 24 is a perspective view illustrating an external view of a slot machine forming the gaming system according to the second embodiment.

In the slot machine 1010, a coin, a bill, or electronic valuable information corresponding to those is used as a game medium. However, in the present invention, the game medium is not particularly limited. Examples of the game medium may include a medal, a token, electronic money and a ticket. It is to be noted that the ticket is not particularly limited, and examples thereof may include a ticket with a barcode as described later.

The slot machine 1010 comprises a cabinet 1011, a top box 1012 installed on the upper side of the cabinet 1011, and a main door 1013 provided at the front face of the cabinet 1011.

On the main door 1013, there is provided a lower image display panel 1016. The lower image display panel 1016 includes a transparent liquid crystal panel which displays nine display blocks 1028 along three columns and three rows. A single symbol is displayed in each display block 1028.

Further, although not illustrated, various types of images relating to an effect, as well as the aforementioned images, are displayed to the lower image display panel 1016.

Further, a number-of-credits display portion 1031 and a number-of-payouts display portion 32 are provided on the lower image display panel 1016. The number-of-credits display portion 1031 displays an image indicative of the number of credited coins. The number-of-payouts display portion 1032 displays an image indicative of the number of coins to be paid out.

Moreover, although not shown, a touch panel 1069 is provided at the front face of the lower image display panel 1016. The player can operate the touch panel 1069 to input a variety of commands.

Below the lower image display panel 1016, there are provided a control panel 1020 including a plurality of buttons 1023 to 1027 with each of which a command according to game progress is inputted by the player, a coin receiving slot 1021 through which a coin is accepted into the cabinet 1011, and a bill validator 1022.

The control panel 1020 is provided with a start button 1023, a change button 1024, a CASHOUT button 1025, a 1-BET button 1026 and a maximum BET button 1027. The start button 1023 is for inputting a command to start scrolling of symbols. The change button 1024 is used for making a request of staff in the recreation facility for exchange. The CASHOUT button 1025 is used for inputting a command to pay out credited coins to a coin tray 1018.

The 1-BET button 1026 is used for inputting a command to bet one coin on a game out of credited coins. The maximum BET button 1027 is used for inputting a command to bet the maximum number of coins that can be bet on one game (3 coins in the present embodiment) out of credited coins.

The bill validator 1022 not only discriminates a regular bill from a false bill, but also accepts the regular bill into the cabinet 1011. It is to be noted that the bill validator 1022 may be configured so as to be capable of reading a later-described ticket 1039 with a barcode. At the lower front of the main door 1013, namely, below the control panel 1020, there is provided a belly glass 1034 on which a character or the like of the slot machine 1010 is drawn.

On the front surface of the top box 1012, there is provided the upper image display panel 1033. The upper image display panel 1033 includes a liquid crystal panel, which displays, for example, images indicative of introductions of the contents of games and explanations about the rules of games as illustrated in FIGS. 23A and 23B.

Further, a speaker 1029 is provided in the top box 1012. Under the upper image display panel 1033, there are provided a ticket printer 1035, a card reader 1036, a data display 1037, and a key pad 1038. The ticket printer 1035 prints on a ticket a barcode as coded data of the number of credits, a date, an identification number of the slot machines 1010, and the like, and outputs the ticket as the ticket 1039 with a barcode. The player can make another slot machine read the ticket 1039 with a barcode to play a game thereon, or exchange the ticket 1039 with a barcode with a bill or the like at a predetermined place in the recreation facility (e.g. a cashier in a casino).

The card reader 1036 reads data from a smart card and writes data into the smart card. The smart card is a card owned by the player, and for example, data for identifying the player and data concerning a history of games played by the player are stored therein. Data corresponding to a coin, a bill or a credit may be stored in the smart card. Further, a magnetic stripe card may be adopted in place of the smart card. The data display 1037 includes a fluorescent display and the like, and displays, for example, data read by the card reader 1036 or data inputted by the player via the key pad 1038. The key pad 1038 is used for inputting a command and data concerning issuing of a ticket, and the like.

Figure 25:
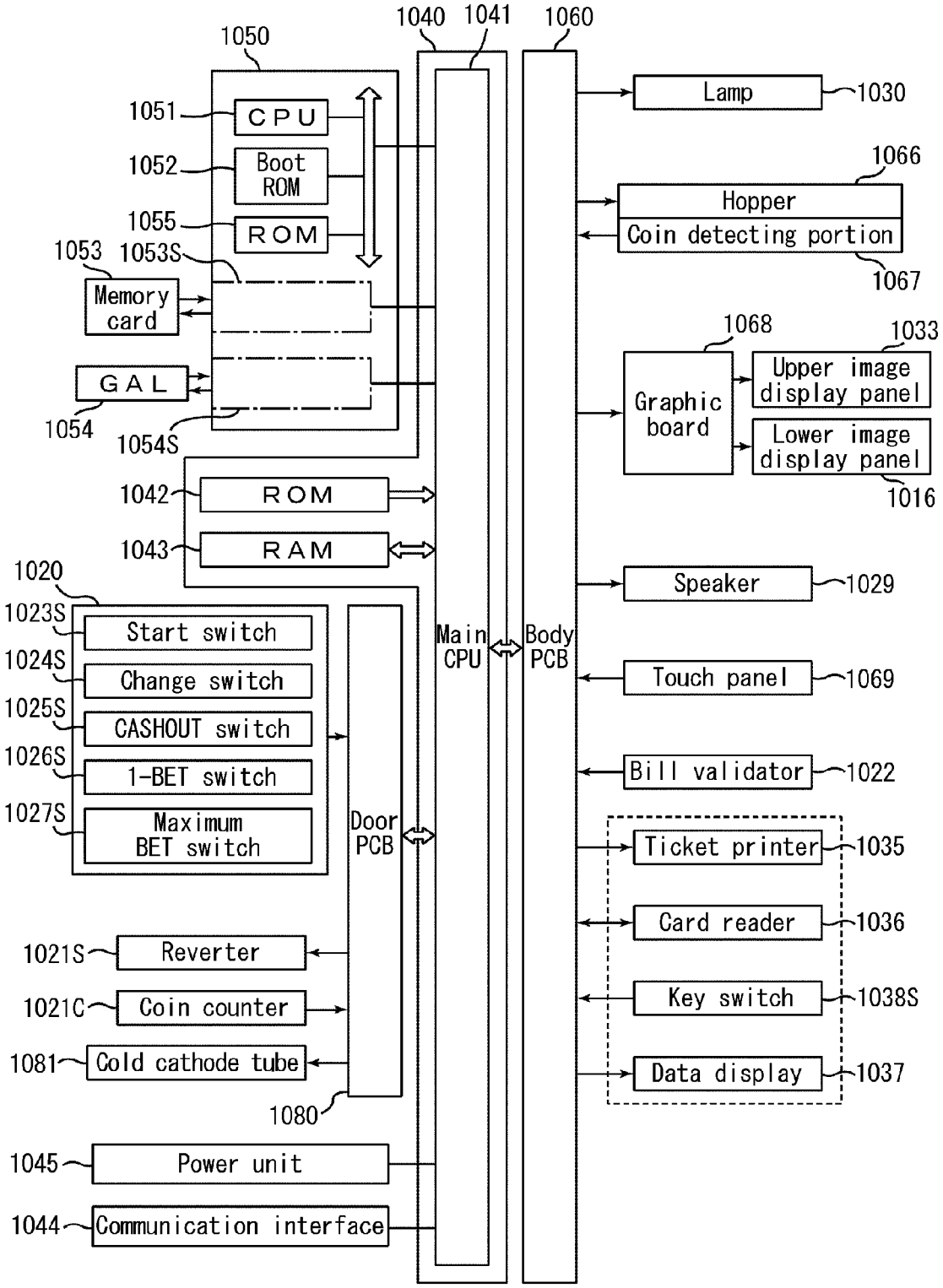
FIG. 25 is a block diagram illustrating an internal configuration of the slot machine shown in FIG. 24.

FIG. 25 is a block diagram showing an internal configuration of the slot machine shown in FIG. 24.

A gaming board 1050 is provided with a CPU (Central Processing Unit) 1051, a ROM 1055, and a boot ROM 1052 which are interconnected to one another by an internal bus, a card slot 1053S corresponding to a memory card 1053, and an IC socket 1054S corresponding to a GAL (Generic Array Logic) 1054.

The memory card 1053 includes a nonvolatile memory such as CompactFlash (registered trade mark), and stores a game program. The game program includes a symbol determination program. The symbol determination program is a program for determining symbols to be rearranged in the display blocks 1028. The symbol determination program includes a symbol determination program for the normal game and a symbol determination program for the common game.

In the normal game, the symbol determination program for the normal game is read and executed. At this time, when the solo-progressive cumulative value has reached the solo-progressive specific value, rearrangement of the symbols is to be conducted based on a later-described symbol array table A (see FIG. 30). When the solo-progressive cumulative value has not reached the solo-progressive specific value, rearrangement of the symbols is to be conducted based on a later-described symbol array table B (see FIG. 31). In the present embodiment, when the number of bets is 3 and "BLUE 7-BLUE 7-BLUE 7" are rearranged along a winning line WL (see FIG. 33), the solo progressive is established (see FIG. 32C). However, according to the symbol array table B, "BLUE 7" is not to be displayed to a center display block. Namely, in the present embodiment, the solo progressive is not to be generated by using the symbol array table B.

Further, in the common game, the symbol determination program for the common game is read and executed. At this time, rearrangement of the symbols is to be conducted based on the symbol array table B. In the present embodiment, a common symbol array table, that is, the symbol array table B is used in the normal game, both in the case where the cumulative value for the solo progressive has not reached the solo-progressive specific value and in the case of the common game. However, in the present invention, different symbol array tables may be used in the case where the solo-progressive cumulative value has not reached the solo-progressive specific value and in the case of the common game.

Further, the game program includes odds data indicative of the correspondence relationship between combinations of the symbols to be rearranged along the winning line WL and the number of coin-outs (see FIGS. 32A to 32C).

Further, the card slot 1053S is configured so as to allow the memory card 1053 to be inserted thereinto or removed therefrom, and is connected to the mother board 1040 by an IDE bus. Therefore, the memory card 1053 can be removed from the card slot 1053S, and then another game program is written into the memory card 1053, and the memory card 1053 can be inserted into the card slot 1053S, to change the type and contents of a game played on the slot machine 1010. The game program includes a program according to progress of the game. Further, the game program includes image data and sound data to be outputted during the game.

The CPU 1051, the ROM 1055 and the boot ROM 1052 interconnected to one another by an internal bus are connected to the mother board 1040 through the PCI bus. The PCI bus not only conducts signal transmission between the mother board 1040 and the gaming board 1050, but also supplies power from the mother board 1040 to the gaming board 1050.

The mother board 1040 is configured using a commercially available general-purpose mother board (a print wiring board on which fundamental components of a personal computer are mounted), and provided with a main CPU 1041, a ROM (Read Only Memory) 1042, a RAM (Random Access Memory) 1043, and a communication interface 1044. The mother board 1040 corresponds to the controller of the present invention.

The ROM 1042 comprises a memory device such as a flash memory, and stores a program such as a BIOS (Basic Input/Output System) executed by the main CPU 1041 and permanent data. When the BIOS is executed by the main CPU 1041, processing for initializing a predetermined peripheral device is conducted, concurrently with start of processing for loading the game program stored in the memory card 1053 via the gaming board 1050. It is to be noted that, in the present invention, the ROM 1042 may or may not be data rewritable one.

The RAM 1043 stores data and a program to be used at the time of operation of the main CPU 1041. Further, the RAM 1043 is capable of storing a game program.

Moreover, the RAM 1043 stores data of the number of credits, the numbers of coin-ins and coin-outs in one game, and the like.

Moreover, the mother board 1040 is connected with a later-described body PCB (Printed Circuit Board) 1060 and a door PCB 1080 through respective USBs. Further, the mother board 1040 is connected with a power supply unit 1045 and the communication interface 1044.

The body PCB 1060 and the door PCB 1080 are connected with an equipment and a device that generate an input signal to be inputted into the main CPU 1041 and an equipment and a device operations of which are controlled by a control signal outputted from the main CPU 1041. The main CPU 1041 executes the game program stored in the RAM 1043 based on the input signal inputted into the main CPU 1041, and thereby executes the predetermined arithmetic processing. Then, the main CPU 1041 stores the result thereof into the RAM 1043, or transmits a control signal to each equipment and device as processing for controlling each equipment and device.

The body PCB 1060 is connected with a lamp 1030, a hopper 1066, a coin detecting portion 1067, a graphic board 1068, the speaker 1029, the touch panel 1069, the bill validator 1022, the ticket printer 1035, the card reader 1036, a key switch 1038S and the data display 1037. The lamp 1030 is lighted in a predetermined pattern based on control signals outputted from the main CPU 1041.

The hopper 1066 is installed inside the cabinet 1011, and pays out a predetermined number of coins based on the control signal outputted from the main CPU 1041, from a coin payout exit 1019 to the coin tray 1018. The coin detecting portion 1067 is provided inside the coin payout exit 1019, and outputs an input signal to the main CPU 1041 in the case of detecting payout of the predetermined number of coins from the coin payout exit 1019.

The graphic board 1068 controls image display to the upper image display panel 1033 and the lower image display panel 1016 based on the control signal outputted from the main CPU 1041. In the respective display blocks 1028 on the lower image display panel 1016, symbols are displayed in a scrolling manner or in a stopped state. The number of credits stored in the RAM 1043 is displayed to the number-of-credits display portion 1031 of the lower image display panel 1016. Further, the number of coin-outs is displayed to the number-of-payouts display portion 1031 of the lower image display panel 1016.

The graphic board 1068 comprises a VDP (Video Display Processor) for generating image data based on the control signal outputted from the main CPU 1041, a video RAM for temporarily storing image data generated by the VDP, and the like. It is to be noted that image data used in generation of the image data by the VDP is included in the game program read from the memory card 1053 and stored into the RAM 1043.

The bill validator 1022 not only discriminates a regular bill from a false bill, but also accepts the regular bill into the cabinet 1011. Upon acceptance of the regular bill, the bill validator 1022 outputs an input signal to the main CPU 1041 based on a face amount of the bill. The main CPU 1041 stores in the RAM 1043 the number of credits corresponding to the face amount of the bill transmitted with the input signal.

The ticket printer 1035, based on the control signal outputted from the main CPU 1041, prints on a ticket a barcode as coded data of the number of credits stored in the RAM 1043, a date, an identification number of the slot machine 1010, and the like, and outputs the ticket as the ticket 1039 with a barcode.

The card reader 1036 reads data from the smart card and transmits the read data to the main CPU 1041, and writes data onto the smart card based on the control signal from the main CPU 1041. The key switch 38S is provided on the key pad 1038, and outputs a predetermined input signal to the main CPU 1041 when the key pad 1038 is operated by the player. The data display 1037 displays data read by the card reader 1036 and data inputted by the player via the key pad 1038, based on the control signal outputted from the main CPU 1041.

The door PCB 1080 is connected with the control panel 1020, a reverter 1021S, a coin counter 1021C, and a cold cathode tube 1081. The control panel 1020 is provided with a start switch 1023S corresponding to the start button 1023, a change switch 1024S corresponding to the change button 1024, a CASHOUT switch 1025S corresponding to the CASHOUT button 1025, a 1-BET switch 1026S corresponding to the 1-BET button 1026, and a maximum BET switch 1027S corresponding to the maximum BET button 1027. Each of the switches 1023S to 1027S outputs an input signal to the main CPU 1041 when each of the buttons 1023 to 1027 corresponding thereto is operated by the player.

The coin counter 1021C is provided inside the coin receiving slot 1021, and discriminates a regular coin from a false coin inserted into the coin receiving slot 1021 by the player. Coins other than the regular coin are discharged from the coin payout exit 1019. Further, the coin counter 1021C outputs an input signal to the main CPU 1041 in detection of the regular coin.

The reverter 1021S operates based on the control signal outputted from the main CPU 1041, and distributes a coin recognized by the coin counter 1021C as the regular coin into a cash box (not shown) or the hopper 1066, which are disposed in the slot machine 1010. Namely, when the hopper 1066 is filled with coins, the regular coin is distributed into the cash box by the reverter 1021S. On the other hand, when the hopper 1066 is not filled with coins, the regular coin is distributed into the hopper 1066. The cold cathode tube 1081 functions as a back light installed on the rear face side of the lower image display panel 1016 and the upper image display panel 1033, and lighted up based on the control signal outputted from the main CPU 1041.

Figure 26:
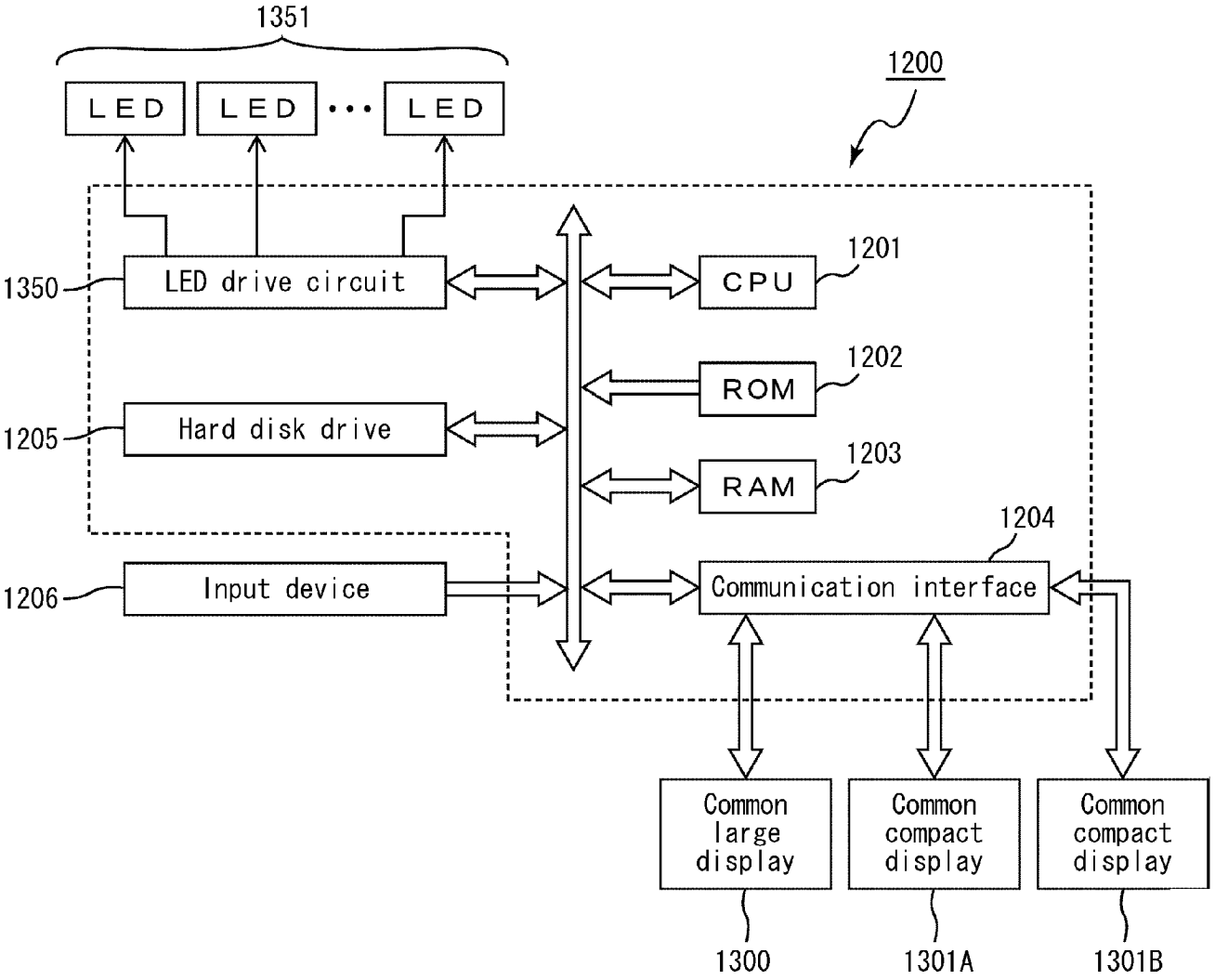
FIG. 26 is a block diagram illustrating an internal configuration of a control device forming the gaming system according to the second embodiment.

FIG. 26 is a block diagram illustrating an internal configuration of a control device forming the gaming system according to the second embodiment.

The control device 1200 includes a CPU 1201, a ROM 1202, a RAM 1203, a communication interface 1204, the input device 1206 a LED drive circuit 1350 and a hard disk drive 1205. The communication interface 1204 is connected, through communication lines 1101, to the communication interfaces 44 in the respective slot machines 1010 and also is connected to the common large display 1300 and the common compact displays 1301 through communication lines 1102. The ROM 1202 stores a system program for controlling the operation of a processor, permanent data, and the like. The input device includes a key board and a mouse.

The RAM 1203 temporarily stores data received from each slot machine 1010. The RAM 1203 is provided with an increment-rate storage area (see FIG. 36), a cumulative-value storage area (see FIG. 37), a specific-value storage area (see FIG. 38), a number-of-lighting determination table storage area (see FIGS. 41A and 41B), and a number-of-lights storage area.

The increment-rate storage area stores a SPECIAL increment rate, a NORMAL increment rate, and a solo-progressive increment rate.

The cumulative-value storage area stores the SPECIAL cumulative value, the NORMAL cumulative value, and the solo-progressive cumulative value.

The increment-rate storage area stores a value selected out of increment-rate candidates (see FIG. 44) stored in the hard disk drive 1205, as the increment rate, in accordance with an input from the input device 1206. Here, at the time of startup of the control device 1200, 0.5% as the SPECIAL increment rate, 3% as the NORMAL increment rate and 1% as the solo-progressive increment rate are stored.

The specific-value storage area stores a value selected out of specific-value candidates (see FIG. 45) stored in the hard disk drive 1205, as the specific value, in accordance with an input from the input device 1206. Here, at the time of startup of the control device 1200, 1000 as the SPECIAL specific value and 100 as the NORMAL specific value are stored.

The number-of-lighting determination table storage area stores number-of-lighting determination table data to be referred in determining the number of LEDs 1351 to be lighted during the common game, in association with the identification numbers of the slot machines 1010.

The number-of-lights storage area stores number-of-lights data indicative of the numbers of LEDs 1351 which have been lighted, out of the LEDs 1351 included in the coupling illumination lines 1310 provided for the respective slot machines 1010, in association with the identification numbers of the slot machines 1010 provided with the corresponding coupling illumination line 1310.

The hard disk drive 1205 stores number-of-lighting determination table data showing a plurality of types of number-of-lighting determination tables (a number-of-lighting determination table for bent portions and a number-of-lighting determination table for straight portions).

Further, the hard disk drive 1205 stores number-of-points determination table data to be referred to in determining the number of points in the common game.

The plurality of LEDs 1351 are connected to the LED drive circuit 1350. The LEDs 1351 are associated with respective identification numbers, and the LED drive circuit 1350 turns on and turns off the LEDs 1351 based on a signal received from the CPU 1201.

Next, there is described processing executed in the slot machines 1010.

The main CPU 1041 proceeds with a slot machine game by reading and executing the game program.

Figure 27:
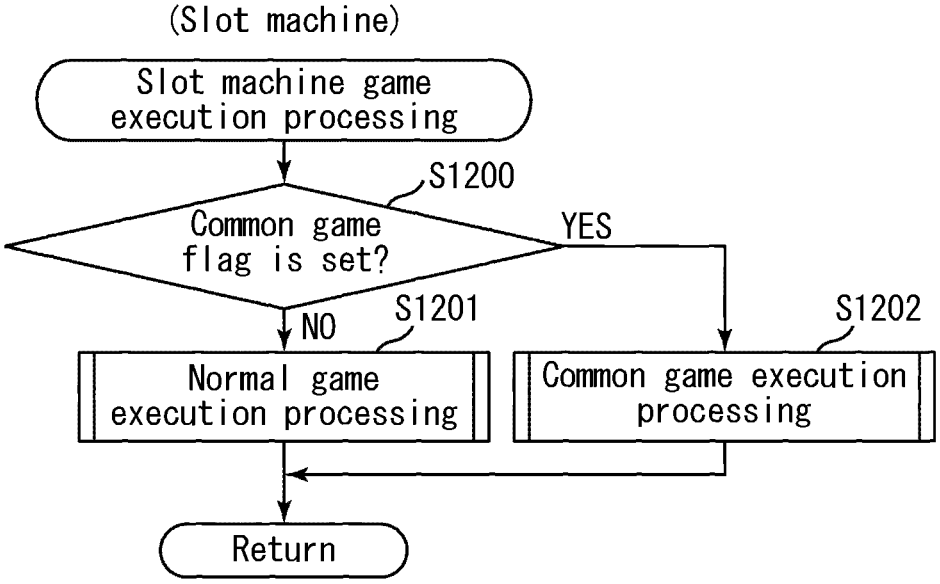
FIG. 27 is a flowchart illustrating slot-machine game execution processing executed in a slot machine in the second embodiment.

FIG. 27 is a flowchart illustrating slot-machine game execution processing executed in the slot machines in the second embodiment.

At first, the main CPU 1041 determines whether or not a common-game flag is set (step S1200). The common-game flag is a flag to be set when the common-game execution signal is received, which is to be transmitted from the control device 1200 triggered by the cumulative value (the NORMAL cumulative value or the SPECIAL cumulative value) having reached the common-game specific value (the NORMAL specific value or the SPECIAL specific value).

When determining in step S1200 that the common-game flag is not set, the main CPU 1041 executes normal game execution processing (step S1201). The normal game execution processing will be described in more detail later with reference to FIG. 29. After executing the processing of step S1201, the main CPU 1041 completes the present subroutine.

On the other hand, when determining that the common-game flag is set, the main CPU 1041 executes common game execution processing (step S1202). The common game execution processing will be described in more detail later with reference to FIG. 34. After executing the processing of step S1202, the main CPU 1041 completes the present subroutine.

Figure 28:
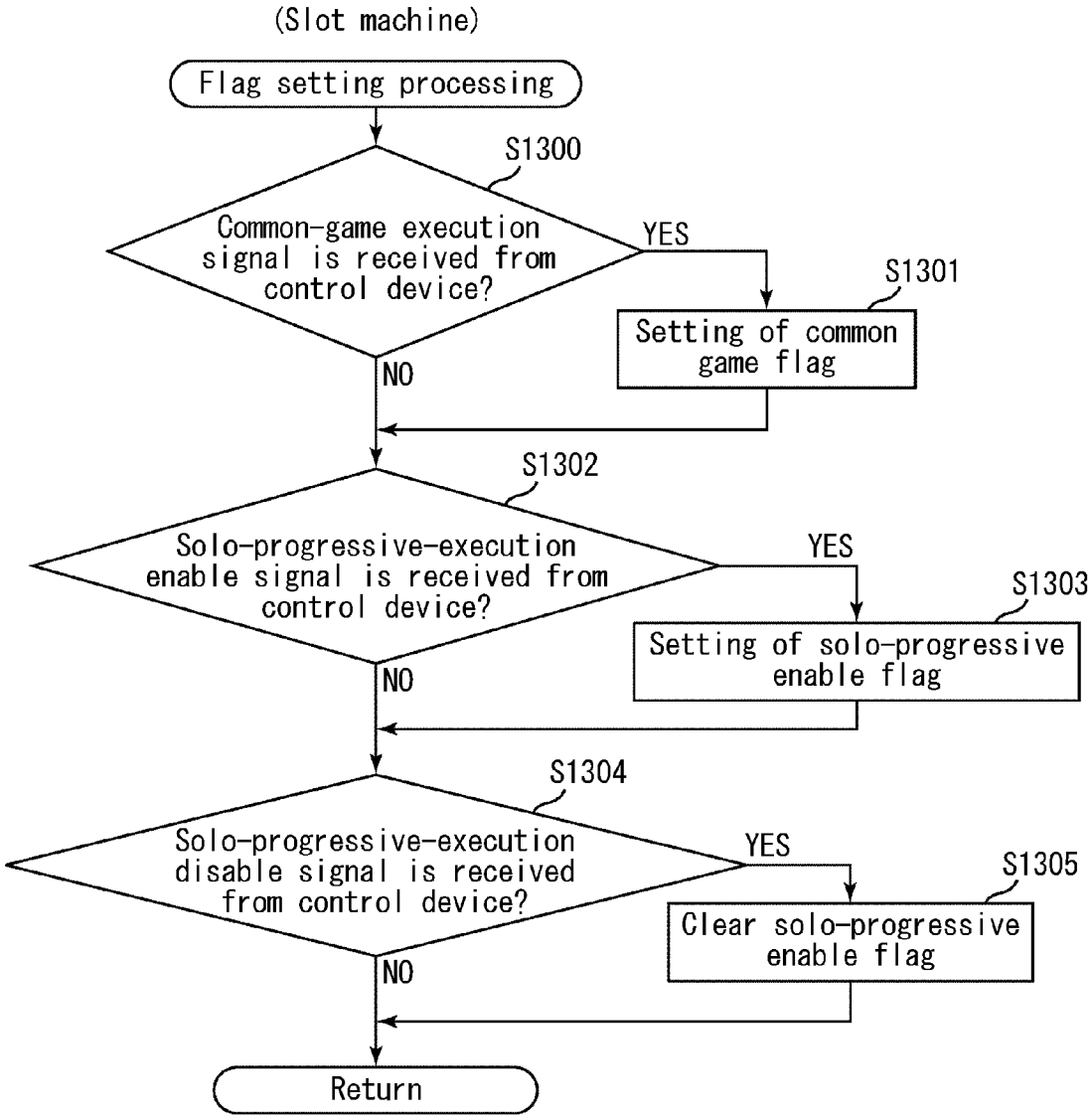
FIG. 28 is a flowchart illustrating a subroutine of flag setting processing in the second embodiment.

FIG. 28 is a flowchart illustrating a subroutine of flag setting processing in the second embodiment.

At first, the main CPU 1041 determines whether or not to have received a common-game execution signal (step S1300). The common-game execution signal is a signal transmitted from the control device 1200 triggered by the common-game cumulative value having reached the common-game specific value (see steps S1104 and S105 in FIG. 35).

When determining to have received the common-game execution signal, the main CPU 1041 sets the common-game flag in a predetermined area of the RAM 1043 (step S1301).

When determining not to have received the common-game execution signal in step S1300, or after the processing of step S1301, the main CPU 1041 determines whether or not to have received a solo-progressive-execution enable signal from the control device 1200 (step S1302). The solo-progressive-execution enable signal is a signal to be transmitted from the control device 1200 triggered by the solo progressive cumulative value having reached the solo-progressive specific value (see steps S1107 and S1108 in FIG. 35).

When determining to have received the solo-progressive-execution enable signal from the control device 1200, the main CPU 1041 sets the solo-progressive enable flag in a predetermined area of the RAM 1043 (step S1303).

When determining not to have received the solo-progressive-execution enable signal from the control device 1200, or after the processing of step S1303, the main CPU 1041 determines whether or not to have received a solo-progressive-execution disable signal from the control device 1200 (step S1304). The solo-progressive-execution disable signal is the signal to be transmitted from the control device 1200 when the solo progressive is generated in any of the slot machines 1010 and the solo-progressive cumulative value becomes smaller than the solo-progressive specific value (see steps S1163 and S1164 in FIG. 42).

When determining to have received the solo-progressive-execution disable signal from the control device 1200, the main CPU 1041 clears the solo-progressive enable flag set in the RAM 1043 and completes the present subroutine. On the other hand, when determining not to have received the solo-progressive-execution disable signal from the control device 1200 in step S1304, the main CPU 1041 completes the present subroutine.

Figure 29:
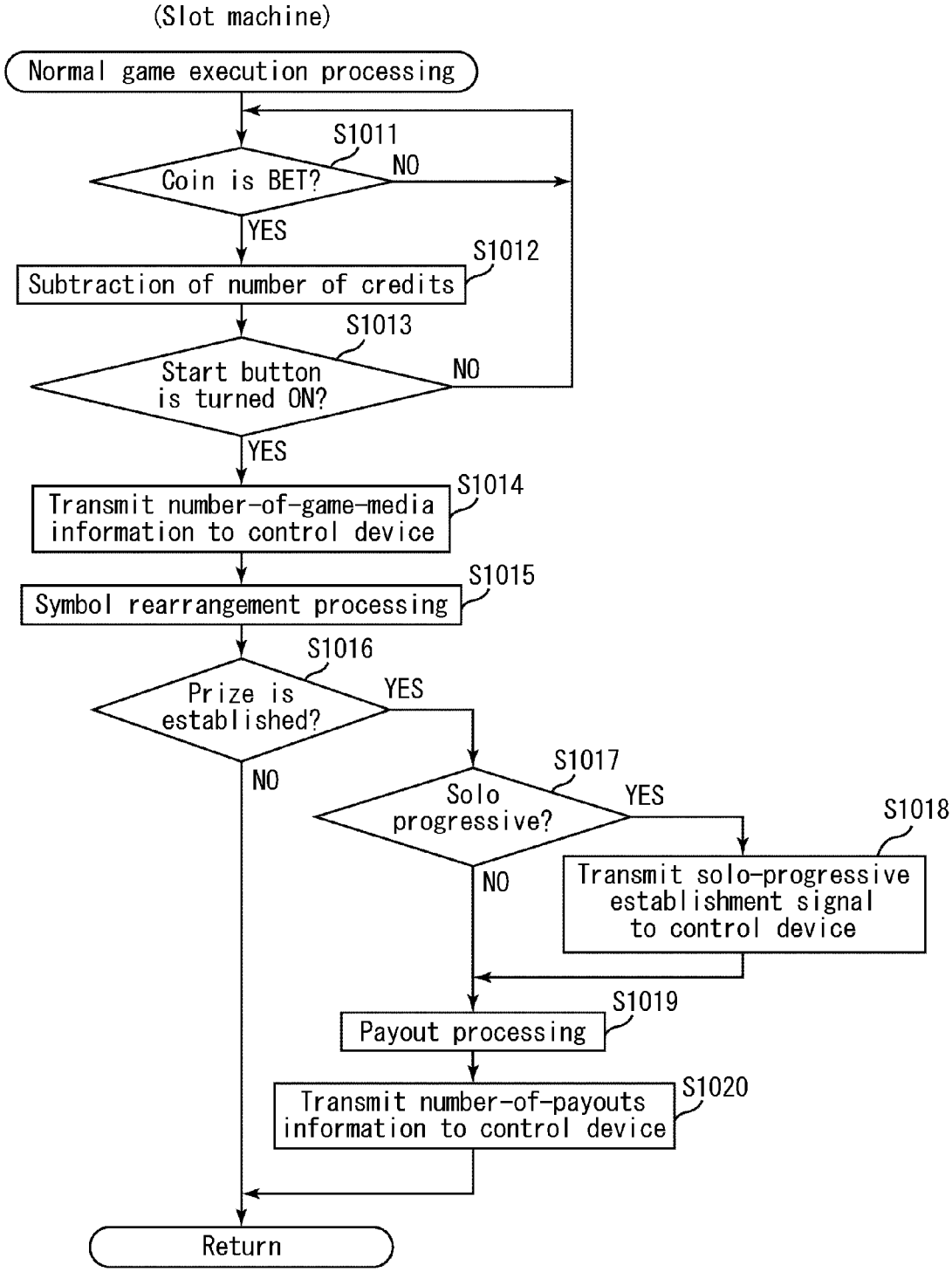
FIG. 29 is a flowchart illustrating a subroutine of normal game execution processing in the second embodiment.

FIG. 29 is a flowchart illustrating a subroutine of normal game execution processing in the second embodiment.

First, the main CPU 1041 determines whether or not a coin has been betted (step S1011). In this processing, the main CPU 1041 determines whether or not to have received an input signal that is outputted from the 1-BET switch 1026S when the 1-BET button 1026 is operated, or an input signal that is outputted from the maximum BET switch 1027S when the maximum BET button 1027 is operated. When the main CPU 1041 determines that the coin has not been betted, the processing is returned to step S1011.

On the other hand, when determining that the coin has been betted in step S1011, the main CPU 1041 conducts processing for making a subtraction from the number of credits stored in the RAM 1043 according to the number of betted coins (step S1012). It is to be noted that, when the number of coins to be betted is larger than the number of credits stored in the RAM 1043, the main CPU 1041 does not conduct the processing for making a subtraction from the number of credits stored in the RAM 1043, and the processing is returned to step S1011. Further, when the number of coins to be betted exceeds the upper limit of the number of coins that can be betted in one game (3 coins in the present embodiment), the main CPU 1041 does not conduct the processing for making a subtraction from the number of credits stored in the RAM 1043, and the processing is proceeded to step S1013.

Next, the main CPU 1041 determines whether or not the start button 1023 has been turned ON (step S1013). In this processing, the main CPU 1041 determines whether or not to have received an input signal that is outputted from the start switch 1023S when the start button 1023 is pressed.

When the main CPU 1041 determines that the start button 1023 has not been turned on, the processing is returned to step S1011. It is to be noted that, when the start button 1023 is not turned ON (e.g. when the start button 1023 is not turned ON and a command to end the game is inputted), the main CPU 1041 cancels a subtraction result in step S1012.

On the other hand, when determining in step S1013 that the start button 1023 has been turned on, the main CPU 1041 transmits number-of-game-media information indicative of the number of betted coins to the control device 1200 (step S1014). The number-of-game-media information includes information indicative of the identification number of the slot machine 1010.

Next, the main CPU 1041 executes symbol rearrangement processing (step S1015). In this processing, at first, the main CPU 1041 starts scrolling-display of normal symbols in the display blocks 1028. Then, the main CPU 1041 executes the aforementioned symbol determination program for the normal game, so as to determine the symbols to be rearranged, and then rearranges the symbols in the display blocks 1028. At this time, when the solo-progressive enable flag is set in the RAM 1043, the symbols are rearranged based on a symbol array table A (see FIG. 30). When the solo-progressive enable flag is not set in the RAM 1043, the symbols are rearranged based on the symbol array table B (see FIG. 31).

FIG. 30 is a view illustrating the symbol array table A in the second embodiment.

FIG. 31 is a view illustrating the symbol array table B in the second embodiment.

In the array tables A and B, symbol columns to be arranged in a left column, a center column, and a right column of the display blocks 1028 are defined. In the array table B, since there is no "BLUE 7"in the symbol column in the center column, "BLUE 7-BLUE 7-BLUE 7" is not to be established. On the other hand, in the array table A, since there are "BLUE 7" in all symbol columns in the left column, the center column, and the right column, it is possible that "BLUE 7-BLUE 7-BLUE 7" is established.

FIGS. 32A to 32C are views each illustrating a corresponding relationship between a combination of symbols and an amount of payout in the second embodiment.

As shown in FIGS. 32A to 32C, in the present embodiment, the relation between the combination of symbols and the number of coin-outs is varied according to the cases where the number of betted coins is one, two, and three.

It is to be noted that in the drawings, "any bar" refers to any symbol among "3 bar", "2 bar", and "1 bar". As shown in FIG. 32C, in the case where the number of betted coins is three and "BLUE 7-BLUE 7-BLUE 7" is established, the solo progressive is generated.

Figure 33:
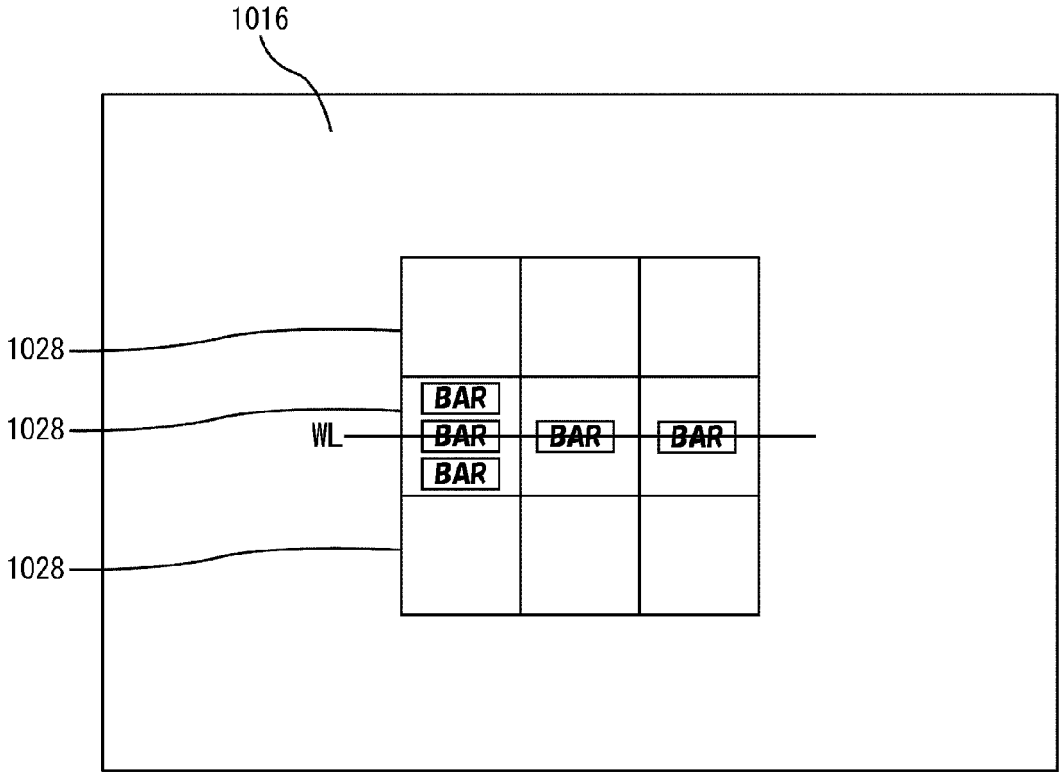
FIG. 33 is an exemplary view illustrating symbols rearranged in display blocks in the second embodiment.

FIG. 33 is an exemplary view illustrating symbols rearranged in display blocks in the second embodiment.

As shown in FIG. 33, the winning line WL is set on the center row of the display blocks 1028. When the symbols in a predetermined combination are rearranged on the winning line WL, a payout of coins is conducted.

After the processing of step S1015 (see FIG. 29), the main CPU 1041 determines whether or not a prize has been established (step S1016). Here, the establishment of the prize refers to an establishment of any combinations of symbols shown in FIGS. 32A to 32C.

When determining that the prize has been established, the main CPU 1041 determines whether or not the prize of the solo progressive is established (step S1017). When determining that the prize of the solo progressive is established, the main CPU 1041 transmits a solo-progressive establishment signal to the control device 1200 (step S1018).

When determining that the prize of the solo progressive has not been established in step S1017, or after the processing of step S1018, the main CPU 1041 executes processing relating to the payout of coins (step S1019). In the processing, the main CPU 1041 determines the amount of payout based on the rearranged symbols with reference to the odds data stored in the RAM 1043. The odds data is data indicative of the correspondence relationship between the symbols rearranged in the display blocks 1028 and the amount of payouts (see FIGS. 32A to 32C). Here, in the case where the prize is the solo progressive, the coins are paid out in number corresponding to the solo-progressive specific value (150000, in the present embodiment).

In the case of accumulating coins, the main CPU 1041 conducts processing for adding the number of credits corresponding to the determined amount of payout to the number of credits stored in the RAM 1043. On the other hand, in the case of paying out coins, the main CPU 1041 transmits a control signal to the hopper 1066 in order to pay out coins in an amount corresponding to the determined amount of payout.

Then, the main CPU 1041 transmits number-of-payout information indicative of the determined amount of payout, that is, the number of paid out coins, to the control device 1200 (step S1020).

When determining in step S1016 that no prize has been established, or after executing the processing of step S1020, the main CPU 1041 completes the present subroutine.

Subsequently, the common game execution processing is described.

Figure 34:
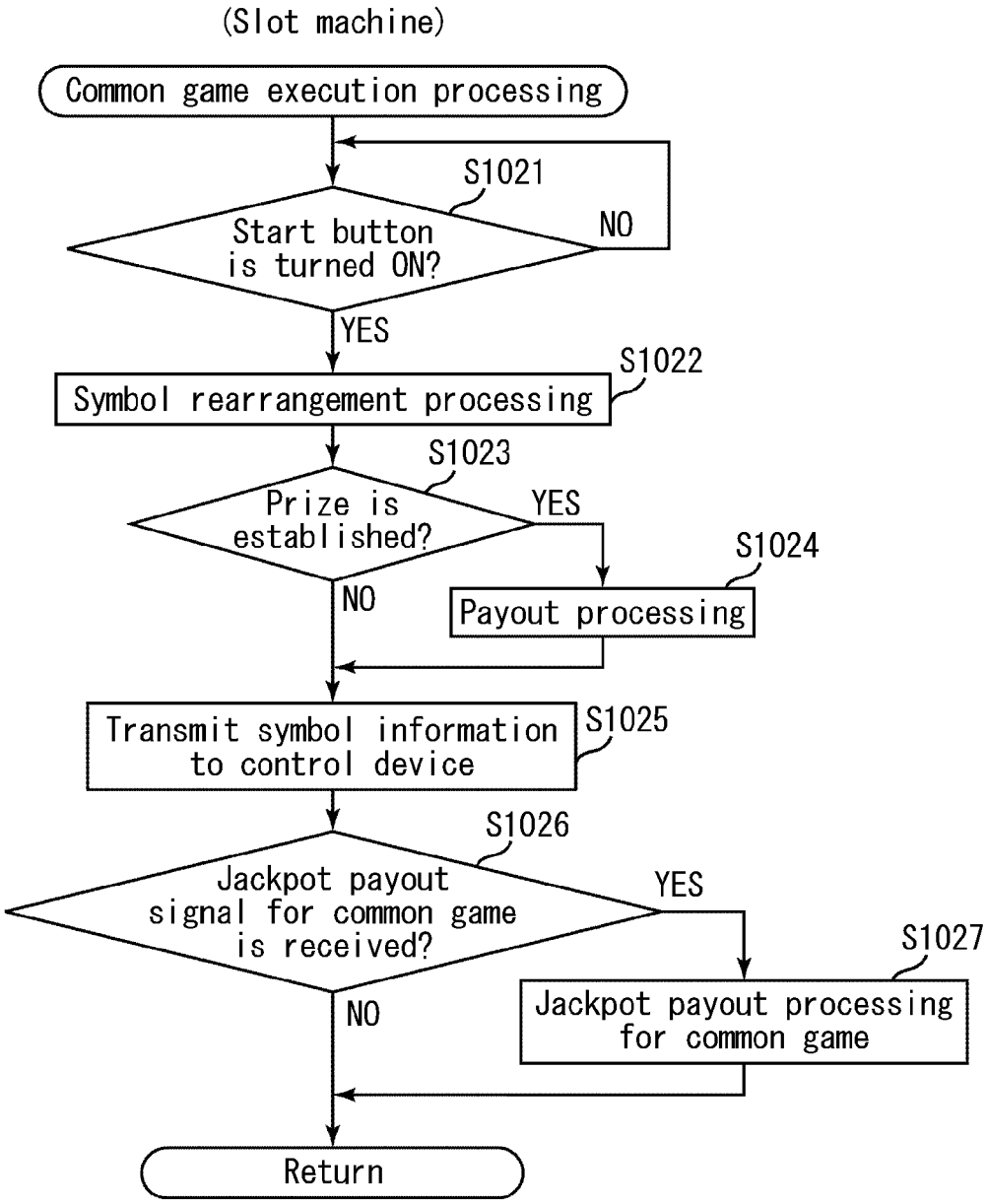
FIG. 34 is a flowchart illustrating a subroutine of common game execution processing in the second embodiment.

FIG. 34 is a flowchart illustrating a subroutine of the common game execution processing in the second embodiment.

At first, the main CPU 1041 executes processing of step S10 S21 to S24, and these processing are substantially the same as the processing of step S1013 and step S10 S15 to S17 in FIG. 29. Here, only a part different from step S1013 and steps S1015 to S1017 in FIG. 29 is described.

There has been described a case where the main CPU 1041 executes the symbol determination program for the normal game in step S1015 in FIG. 29 for determining symbols to be rearranged, and then, rearranges the symbols in the display blocks 1028. On the contrary, in step S1022 in FIG. 34, the main CPU 1041 executes the symbol determination program for the common game for determining symbols to be rearranged, and then, rearranges the symbols in the display blocks 1028.

When determining in step S1023 that no prize has been established or after executing the processing of step S1024, the main CPU 1041 transmits symbol information to the control device 1200 (step S1025). The symbol information is information indicative of the common-game symbols rearranged in step S1022. The symbol information corresponds to common-game result information according to the present invention.

Next, the main CPU 1041 determines whether or not to have received a jackpot payout signal for the common game (step S1026). The jackpot payout signal for the common game is a signal transmitted from the control device 1200 to the slot machine 1010 triggered by all the LEDs 1351 included in the coupling illumination line 1310 provided in any of the slot machines 1010 having been lighted (see steps S1125 to S1126 in FIG. 39). The jackpot payout signal for the common game includes information indicative of the NORMAL specific value or the SPECIAL specific value.

When determining to have received the jackpot payout signal for the common game, the main CPU 1041 executes jackpot payout processing for the common game (step S1027). In this processing, the main CPU 1041 pays out coins in number corresponding to the NORMAL specific value or the SPECIAL specific value, based on the information indicative of the cumulative value included in the jackpot payout signal for the common game. In the present embodiment, the number corresponding to the NORMAL specific value is 100 and the number corresponding to the SPECIAL specific value is 1000.

The processing executed by the main CPU 1041 in step S1027 includes output of an annunciation sound from the speaker 1029, lighting of the lamp 1030, print of the ticket 1039 with a barcode indicative of the number of payouts printed thereon, and the like.

When determining not to have received a jackpot payout signal for the common game in step S1026 or after executing the processing of step S1027, the main CPU 1041 completes the present subroutine.

As above, there has been described the processing which is executed in the slot machines 1010.

Subsequently, processing executed by the control device 1200 is described.

Figure 35:
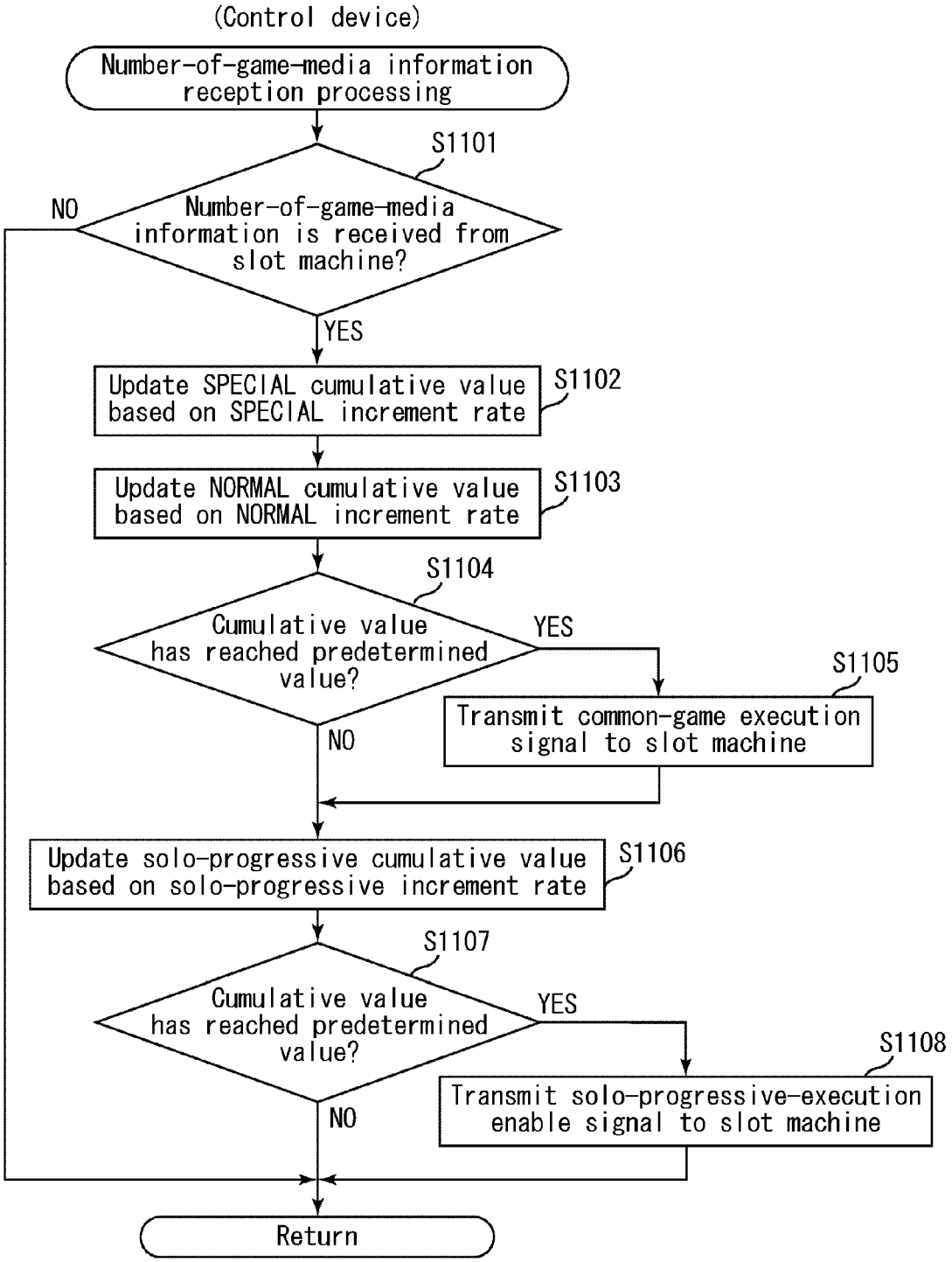
FIG. 35 is a flowchart illustrating a subroutine of number-of-game-media information reception processing in the second embodiment.

FIG. 35 is a flowchart illustrating a subroutine of number-of-game-media information reception processing in the second embodiment.

At first, the CPU 1201 determines whether or not to have received the number-of-game-media information from the slot machine 1010 at a predetermined timing (step S1101). In the present embodiment, the number-of-game-media information is information indicative of the number of coins which have been betted in the slot machine 1010 (see step S1014 in FIG. 29). When determining not to have received the number-of-game-media information, the CPU 1201 completes the present subroutine.

When determining to have received the number-of-game-media information, the CPU 1201 updates the SPECIAL cumulative value based on the SPECIAL increment rate stored in the RAM 1203 (step S1102).

FIG. 36 is a view illustrating an increment-rate storage area in the second embodiment.

As shown in FIG. 36, the RAM 1203 in the control device 1200 is provided with the increment-rate storage area, which stores an increment rate for the SPECIAL common game (the SPECIAL increment rate), an increment rate for the NORMAL common game (the NORMAL increment rate), and an increment rate for the solo progressive (the solo-progressive increment rate). In FIG. 36, 0.5% as the SPECIAL increment rate, 3% as the NORMAL increment rate, and 1% as the solo-progressive increment rate are stored. Here, when there is an input indicating that the increment rate is to be changed from the input device 1206, the SPECIAL increment rate, the NORMAL increment rate, and the solo-progressive increment rate stored in the increment-rate storage area are to be changed in accordance with the input.

Here, the NORMAL increment rate and the SPECIAL increment rate correspond to the predetermined percentages determined for each of the plurality of common games of the present invention.

FIG. 37 is a view illustrating the cumulative-value storage area in the second embodiment.

As shown in FIG. 37, the RAM 1203 in the control device 1200 is provided with the cumulative-value storage area which stores the SPECIAL cumulative value, the NORMAL cumulative value, and the solo-progressive cumulative value.

In the processing of step S1102, the CPU 1201 adds 0.5% of the number of coins shown by the number-of-game-media information to the SPECIAL cumulative value and stores the resulting value. For example, when the number of coins shown by the number-of-game-media information is 3, the CPU 1201 adds 0.015 to the SPECIAL cumulative value and stores the resulting value.

Next, in step S1103, the CPU 1201 updates the NORMAL cumulative value based on the NORMAL increment rate stored in the RAM 1203 (step S1103). In the processing of step S1103, the CPU 1201 adds 3% of the number of coins shown by the number-of-game-media information to the NORMAL cumulative value and stores the resulting value. For example, when the number of coins shown by the number-of-game-media information is 3, the CPU 1201 adds 0.09 to the NORMAL cumulative value and stores the resulting value.

Next, the CPU 1201 determines whether or not the SPECIAL cumulative value has reached the SPECIAL specific value, or the NORMAL cumulative value has reached the NORMAL specific value, with reference to the cumulative-value storage area and the specific-value storage area of the RAM 1203 (see FIG. 38).

FIG. 38 is a view illustrating the specific-value storage area in the second embodiment.

As shown in FIG. 38, the RAM 1203 in the control device 1200 is provided with the specific-value storage area for storing the SPECIAL specific value, the NORMAL specific value and the solo-progressive specific value. In FIG. 38, 1000 as the SPECIAL specific value, 100 as the NORMAL specific value, and 150000 as the solo-progressive specific value are stored. Here, when there is an in put indicating that the specific value is to be changed from the input device 1206, the SPECIAL specific value and the NORMAL specific value stored in the specific-value storage area are to be changed in accordance with the input.

When determining that the SPECIAL cumulative value has reached the SPECIAL specific value or that the NORMAL cumulative value has reached the NORMAL specific value, the CPU 1201 transmits the common-game execution signal to the slot machines 1010 (step S1105). The common-game execution signal is a signal which triggers the execution of the common game in the slot machines 1010. Further, in this processing, the slot machines 1010 to which the common-game execution signal is transmitted from the CPU 1201 are the slot machines 1010 having transmitted number-of-game-media information in a predetermined time.

When determining that the SPECIAL cumulative value has not reached the SPECIAL specific value and that the NORMAL cumulative value has not reached the NORMAL specific value in step S1104, or after the processing of step S1105, the CPU 1201 shifts the processing to step S1106.

In step S1106, the CPU 1201 updates the solo-progressive cumulative value, based on the solo-progressive increment rate stored in the RAM 1203. In the present embodiment, the solo-progressive increment rate is set to be 1% (see FIG. 36).

Next, in step S1107, the CPU 1201 determines whether or not the solo-progressive cumulative value has reached the solo-progressive specific value, with reference to the cumulative-value storage area and the specific-value storage area in the RAM 1203 (see FIG. 38). When determining that the solo-progressive cumulative value has reached the solo-progressive specific value, the CPU 1201 transmits the solo-progressive-execution enable signal to the slot machine 1010 (step S1108). The solo-progressive-execution enable signal is the signal for notifying approval of the generation of the solo progressive in the slot machine 1010. When determining that the solo-progressive cumulative value has not reached the solo-progressive specific value in step S1107, or after the processing of step S1108, the CPU 1201 completes the present subroutine.

Figure 39:
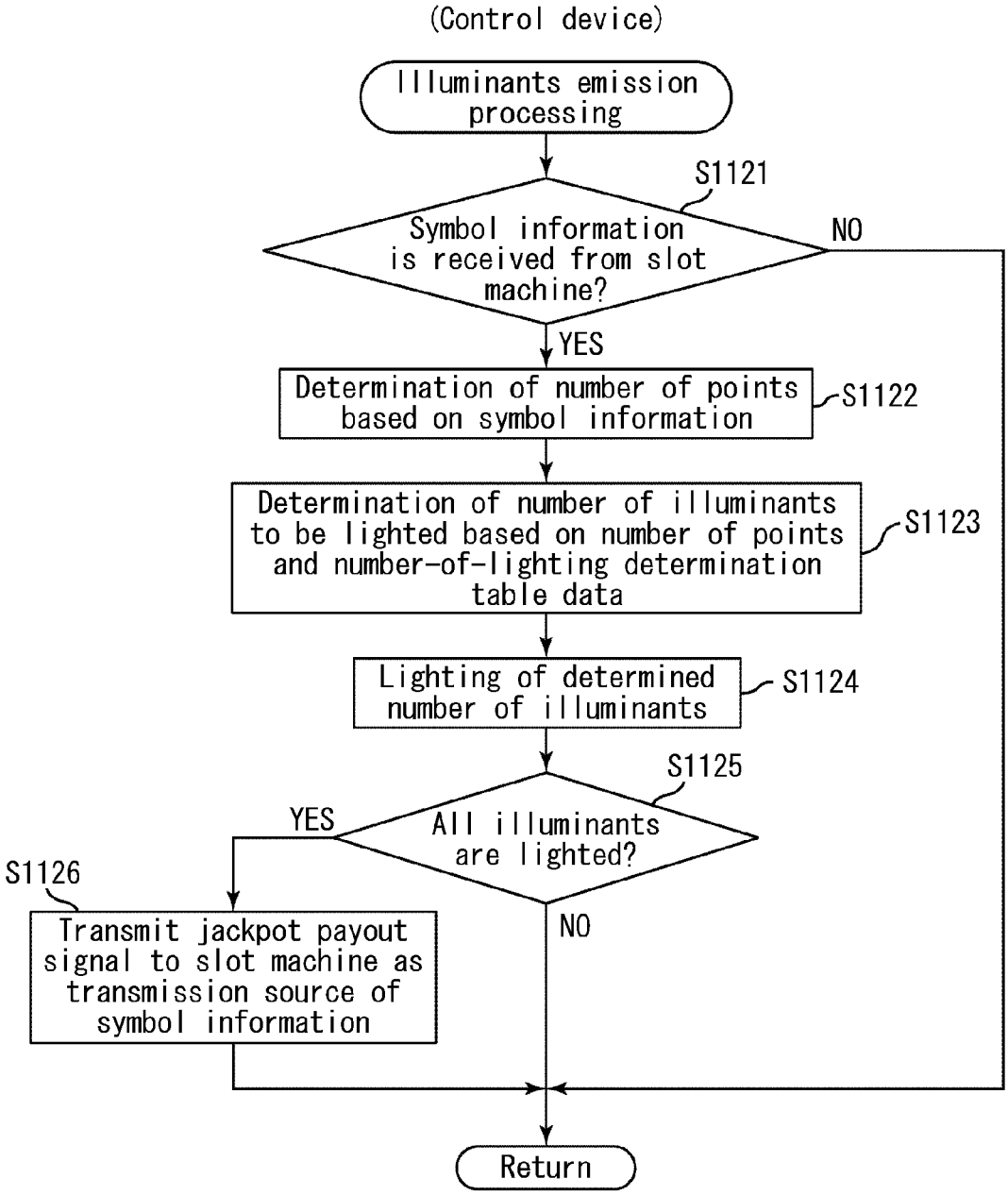
FIG. 39 is a flowchart illustrating a subroutine of illuminants emission processing in the second embodiment.

FIG. 39 is a flowchart illustrating a subroutine of illuminants emission processing in the second embodiment.

At first, the CPU 1201 determines whether or not to have received the symbol information (see step S1025 in FIG. 34) from the slot machine 1010 at a predetermined timing (step S1121).

When determining not to have received the symbol information, the CPU 1201 completes the present subroutine.

On the other hand, when determining to have received the symbol information, the CPU 1201 determines the number of points, based on the symbol information and the number-of-points determination table data stored in the hard disk drive 1205 (step S1122).

FIG. 40 is a view illustrating a number-of-points determination table in the second embodiment.

As shown in FIG. 40, a correspondence relationship between the combination of symbols and the number of points is defined in the number-of-points determination table. When the combination of the symbols rearranged along the winning line WL is the combination of symbols defined in the number-of-points determination table, points corresponding to the combination of the symbols are offered. The number-of-points determination table data is stored in the hard disk drive 1205 in the control device 1200. For example, as shown in FIG. 33, when "3 BAR-1 BAR-1 BAR" are rearranged along the winning line WL in the common game played on a single slot machine 1010, the number of points is determined to be "50" as a total of "30" based on "3 BAR" and "20 (=10+10)" based on two of "1 BAR".

Next, the CPU 1201 determines the number of LEDs 1351 (illuminants) to be lighted (emit light) based on the determined number of points and the number-of-lighting determination table data (step S1123).

FIGS. 41A and 41B are views each illustrating the number-of-lighting determination table in the second embodiment.

The number-of-lighting determination table is a table in which the possible range of the number of points and the number of LEDs 1351 to be lighted are associated with each other. Further, in the number-of-lighting determination tables, the correspondence relationship between the number of points and the number of LEDs 1351 to be lighted is associated with each slot machine 1010.

The number-of-lighting determination table includes the number-of-lighting determination table for bent portions (see FIG. 41A) and the number-of-lighting determination table for straight portions (see FIG. 41B).

In the number-of-lighting determination table for bent portions, correspondence relationships between the number of points and the number of LEDs 1351 to be lighted may be different in accordance with the slot machines 1010.

In the number-of-lighting determination table for straight portions, the correspondence relationships between the number of points and the number of LEDs 1351 to be lighted are the same with respect to all the slot machines 1010.

In the processing of step S1123, at first, the CPU 1201 determines whether or not the number of lights indicated by the number-of-lights data stored in association with the identification number of the slot machine 1010 as a transmission source of the symbol information received in step S1121 is equal to or more than a predetermined number (the number of LEDs 1351 included in the bent portion of the coupling illumination line 1310).

When determining that the number of lights is equal to or more than the predetermined number, the CPU 1201 determines the number of LEDs 1351 to be lighted based on the number-of-lighting determination table for straight portions.

On the other hand, when determining that the number of lights is less than the predetermined number, the CPU 1201 determines the number of LEDs 1351 to be lighted based on the number-of-lighting determination table for bent portions.

Next, the CPU 1201 makes the LEDs 1351 (illuminants) in number determined in step S1123 be lighted (emit light) in the coupling illumination line 1310 provided for the slot machine 1010 as a transmission source of the symbol information received in step S1121 (step S1124).

In this processing, the CPU 1201 identifies the identification numbers of the LEDs 1351 to be lighted, based on the number determined in step S1123 and the number of lights indicated by the number-of-lights data stored in the number-of-lights storage area in the RAM 1203 in association with the identification number of the slot machine 1010. Further, the CPU 1201 transmits to the LED drive circuit 1350 a signal including information indicative of the identified identification numbers. On receiving this signal, the LED drive circuit 1350 lights the LEDs 1351 associated with the identification numbers included in the signal.

Further, after transmitting the signal, the CPU 1201 adds the number determined in step SI 123 to the number of lights indicated by the number-of-lights data stored in the number-of-lights storage area in the RAM 1203 in association with the identification number of the slot machine 1010.

Next, the CPU 1201 determines whether or not all the LEDs 1351 (illuminants) included in the coupling illumination line 1310 provided for the slot machine 1010 as a transmission source of the symbol information received in step S1121 have been lighted (emit light) (step S1125). In the processing, the CPU 1201 determines whether or not the number of lights after the addition of the number determined in step S1123 has reached a predetermined number (the number of LEDs 1351 included in the coupling illumination line 1310), based on the number-of-lights data stored in the RAM 1203.

When determining that all the LEDs 1351 included in the coupling illumination line 1310 provided for the slot machine 1010 as a transmission source of the symbol information received in step S1121 have been lighted, the CPU 1201 transmits the jackpot payout signal for the common game to the slot machine 1010 (step S1126). It is to be noted that the jackpot payout signal for the common game includes information relating to the type of the common game (SPECIAL or NORMAL) and information relating to the specific value (the NORMAL specific value or the SPECIAL specific value).

On receiving the jackpot payout signal for the common game, the slot machine 1010 executes jackpot payout processing for the common game (see step S1027 in FIG. 34).

When determining in step S1125 that not all the LEDs 1351 have been lighted or after executing the processing of step S1126, the CPU 1201 completes the present subroutine.

Figure 42:
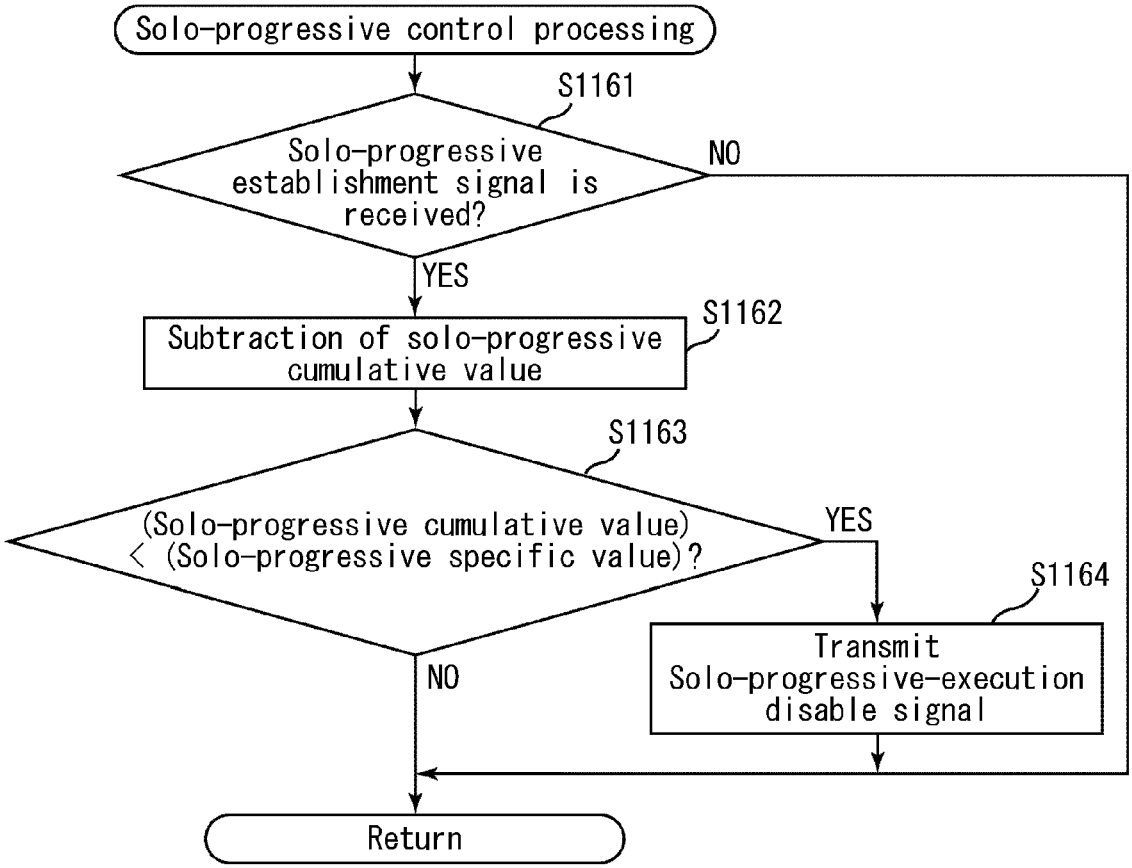
FIG. 42 is a flowchart illustrating a subroutine of solo-progressive control processing in the second embodiment.

FIG. 42 is a flowchart illustrating a subroutine of solo-progressive control processing in the second embodiment.

First, the CPU 1201 determines whether or not to have received the solo-progressive establishment signal from the slot machine 1010 (step S1161). When determining to have received the solo-progressive establishment signal, the CPU 1201 subtracts the solo-progressive specific value from the solo-progressive cumulative value (step S1162).

Next, the CPU 1201 determines whether or not the solo-progressive cumulative value is smaller than the solo-progressive specific value (step S1163). When determining that the solo-progressive cumulative value is smaller than the solo-progressive specific value, the CPU 1201 transmits the solo-progressive-execution disable signal to the slot machine 1010 (step S1164).

When determining not to have received the solo-progressive establishment signal in step S1161, or when determining that the solo-progressive cumulative value is not smaller than the solo-progressive specific value in step S1163, or after the processing of step S1164, the main CPU 1201 completes the present subroutine.

Figure 43:
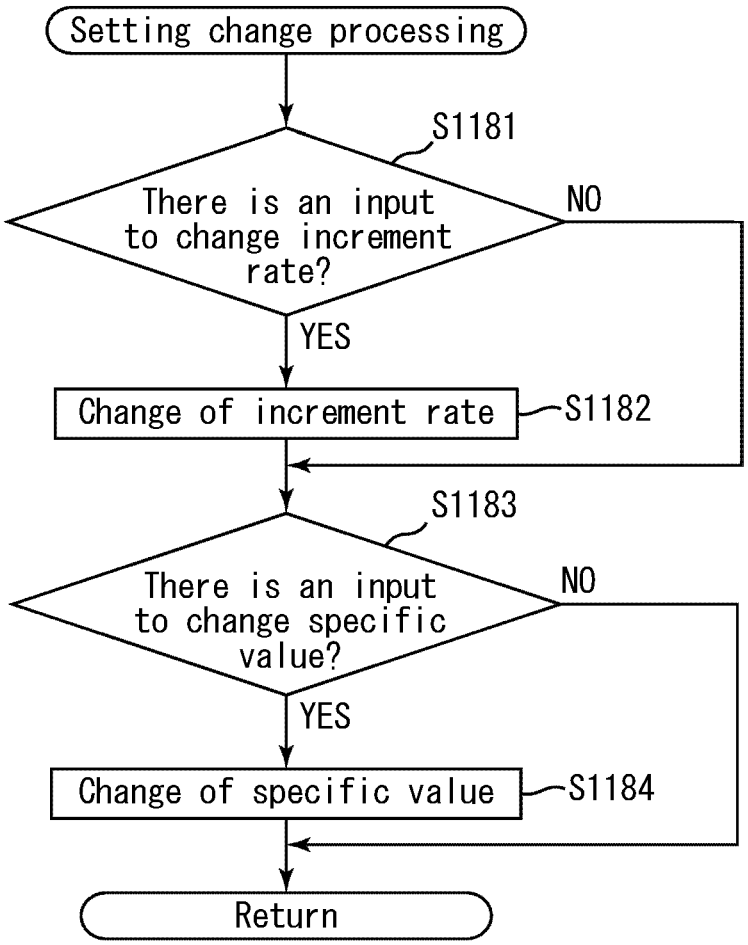
FIG. 43 is a flowchart illustrating a subroutine of setting change processing in the second embodiment.

FIG. 43 is a flowchart illustrating a subroutine of setting change processing in the second embodiment.

First, the CPU 1201 determines whether or not there is an input to change the increment rate in step SI 181. In this processing, the CPU 1201 determines whether or not a single value is selected, out of the increment-rate candidates stored in the hard disk drive 1205, by the input from the input device 205.

FIG. 44 is a view illustrating an increment-rate-candidates storage table in the second embodiment.

As illustrated in FIG. 44, the hard disk drive 1205 stores SPECIAL-increment-rate candidates, NORMAL-increment-rate candidates and solo-progressive-increment-rate candidates.

When determining that there is the input to change the increment rate in step S1181, the CPU 1201 updates the increment rate (step S1182). In this processing, the CPU 1201 changes the increment rate stored in the increment-rate storage area of the RAM 1203 to the inputted value.

When determining that there is not the input to change the increment rate in step S1181, or after the processing of step S1182, the CPU 1201 determines whether or not there is an input to change the specific value (step S1183). In this processing, the CPU 1201 determines whether or not a single value is selected out of the specific-value candidates stored in the hard disk drive 1205.

FIG. 45 is a view illustrating a specific-value-candidates storage table in the second embodiment.

As illustrated in FIG. 45, the hard disk drive 1205 stores SPECIAL-specific-value candidates and NORMAL-specific value candidates.

When determining that there is the input to change the specific value in step S1183, the CPU 1201 updates the specific value (step S1184). In this processing, the CPU 1201 changes the specific value stored in the specific-value storage area of the RAM 1203 to the inputted value.

When determining that there is not the input to change the specific value in step S1183, or after the processing of step S1184, the CPU 1201 completes the present subroutine.

As above, according to the gaming system 1001 and the above-described game control method, two common games (the SPECIAL common game and the NORMAL common game) are provided and the individual cumulative value (the first individual cumulative value, the second individual cumulative value) is counted for each common game. When the NORMAL cumulative value has reached the NORMAL specific value (the specific value), or when the SPECIAL cumulative value has reached the SPECIAL specific value (the specific value), the common game is executed, in which coins in number corresponding to the specific value may be paid out. Since the individual cumulative value is counted individually, respective two common games are generated independently of each other. Accordingly, since the respective individual cumulative values accumulated in the two common games and the specific values are independent of each other, it becomes harder to predict which common game will be generated at which timing. As a result, it is possible to provide a new-type gaming system capable of having a player absorbed in the game.

Further, in accordance with an input from the input device 1206 provided in the control device 1200, the increment rate and the specific value can be changed. As a result, by setting the increment rate to a lower value or the specific value to a higher value, a generation frequency of the common game can be lowered. Further, by setting the increment rate to a higher value or the specific value to a lower value, the generation frequency of the common game can be raised. Furthermore, by changing the specific value, it is possible to increase or decrease the number of game media to be paid out after the common game.

In the present embodiment, there has been described a case where, in the case of conducting the payout of the jackpot for the common game, 100 coins corresponding to the NORMAL specific value are paid out when the NORMAL common game is played, and 1000 coins corresponding to the SPECIAL specific value are paid out when the SPECIAL common game is played. However, in the present invention, the game media in number corresponding to the specific value, which are to be paid out from the gaming machine, are not limited to this, and may be the game media in number corresponding to the individual cumulative value which is cumulatively counted, or the game media in number obtained by subtracting a fixed value from the specific value.

In the present embodiment, there has been described a case where information indicative of the number of betted coins is transmitted from the slot machine 1010 to the control device 1200 and the number is multiplied by the increment rate in the control device. However, the present invention is not limited to this example, and the number of betted coins may be multiplied by the set percentage and the result may be transmitted to the control device as the number-of-game-media information. Namely, in the present invention, the number-of-game-media information may be information indicative of the number of betted coins or the value obtained by multiplying the number of betted coins by a percentage, that is, the cumulative value.

In the present embodiment, there has been described a case where the input device is provided in the control device. However, in the present invention, the input device may be provided in the gaming machine. In this case, information relating to the percentage and/or the specific value inputted in the gaming machine may be transmitted to the control device. In such a case, a variety of buttons and a touch panel provided in the gaming machine may be used as the input device, or alternatively, a key board and a mouse for changing the percentage and/or the specific value may be provided in the cabinet.

In the present embodiment, there has been described a case where the gaming machine of the present invention is a slot machine. However, the gaming machine of the present invention is not limited to this, and may be a gaming machine in which a card game such as poker, or a game such as a shooting game and a fighting game is played.

Further, in the present embodiment, there has been described a case where the common game is a game in which a game result is determined based on rearranged symbols (a normal slot machine game). However, in the present invention, the common game is not limited to the case, and a game different from the slot machine game may be played. For example, a card game such as poker, and a game such as a shooting game and a fighting game may be played. In this case, it is desirable to allow players to play the game against one another. This is because such a configuration can enhance player's senses of competition, thereby further having the players become absorbed in the common game.

For example, a following configuration can be adopted.

Namely, each gaming machine is capable of storing a program for executing such a common game. Each gaming machine reads and executes the program, triggered by a reception of a common-game execution signal. Then, the gaming machine transmits information indicative of the result of the common game to the control device. The control device compares the results of the common game in respective gaming machines, so as to determine the gaming machine, to which a payout of the game media based on the common game is conducted.

(Third Embodiment)

A third embodiment of the present invention is described based on the drawings.

At first, with reference to FIG. 46, there will be given a general description of the present embodiment.

Figure 46:
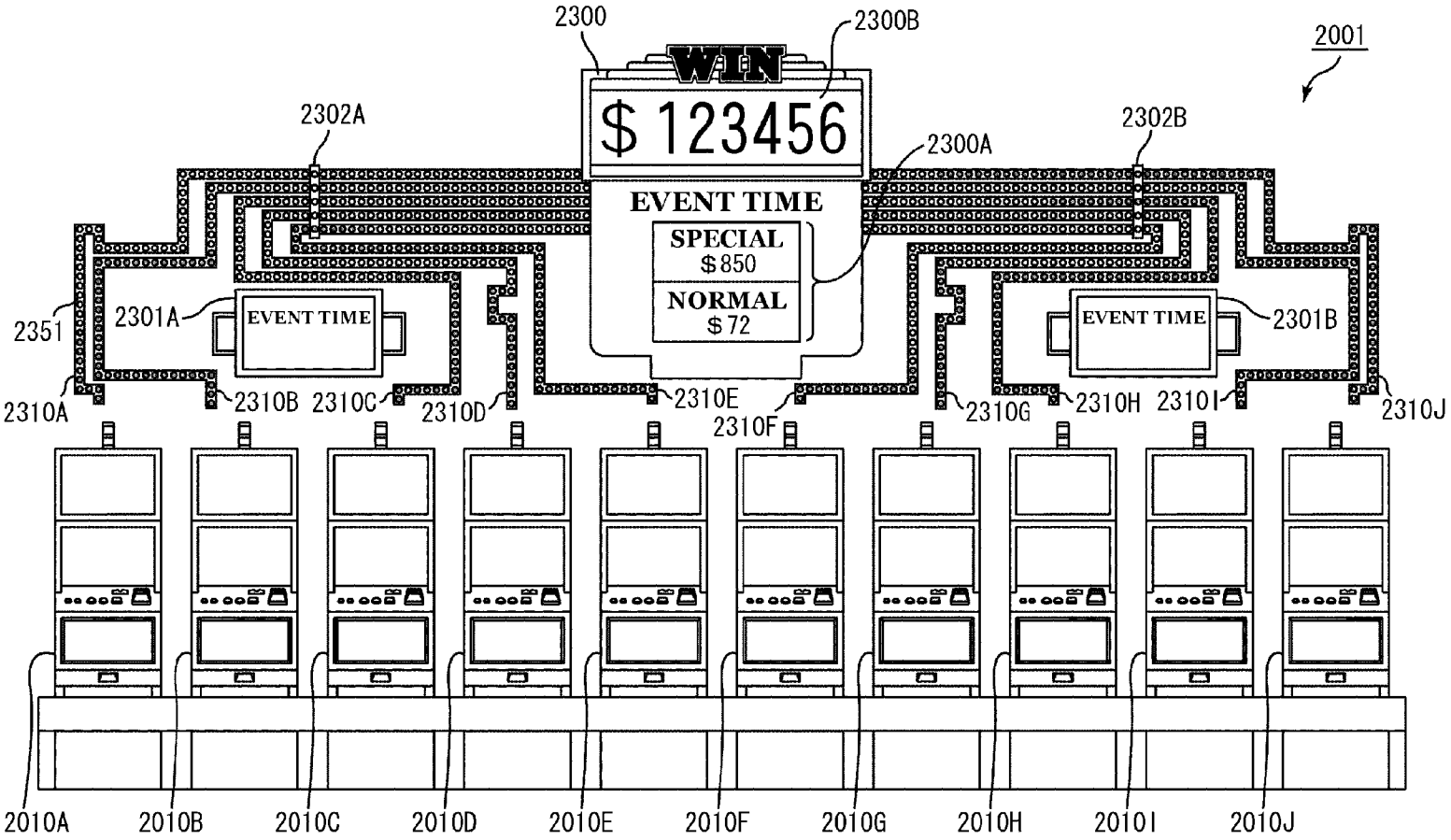
FIG. 46 is a front view schematically illustrating a gaming system according to a third embodiment of a present invention.

FIG. 46 is a front view schematically illustrating a gaming system according to a third embodiment of the present invention.

As illustrated in FIG. 46, a gaming system 2001 includes a plurality of slot machines 2010 (a slot machine 2010A, a slot machine 2010B, a slot machine 2010C,a slot machine 2010D, a slot machine 2010E, a slot machine 2010F, a slot machine 2010G, a slot machine 2010H, a slot machine 2010I, and a slot machine 2010J), a control device 2200 (see FIG. 50), a common large display 2300, and a plurality of common compact displays 2301 (a common compact display 2301A and a common compact display 2301B), which are interconnected through a network.

Further, for the respective slot machines 2010, there are provided coupling illumination lines 2310 (a coupling illumination line 2310A, a coupling illumination line 2310B, a coupling illumination line 2310C, a coupling illumination line 2310D, a coupling illumination line 2310E, a coupling illumination line 2310F, a coupling illumination line 2310G, a coupling illumination line 2310H, a coupling illumination line 2310I, and a coupling illumination line 2310J) which include a plurality of LEDs 2351 arranged from the common large display 2300 to the respective slot machines 2010. The coupling illumination lines 2310 are each formed by a straight portion extending from the common large display 2300 to one of boundary plates 2302 (a boundary plate 2302A and a boundary plate 2302B), and a bent portion extending from one of the boundary plates 2302 to the slot machine 2010.

The slot machines 2010 correspond to the gaming machines of the present invention.

In the gaming system 2001 according to the present embodiment, a common game and a normal game are executed. There are two kinds of common games. One is a SPECIAL common game and the other is a NORMAL common game. In the gaming system 2001, a part of coins betted in each slot machine 2010 are cumulatively counted as a cumulative value. More specifically, 0.5% of the betted coins are cumulatively counted as a NORMAL cumulative value. Further, 3% of the betted coins are cumulatively counted as a SPECIAL cumulative value.

It is to be noted that the NORMAL cumulative value and the SPECIAL cumulative value correspond to the common-game cumulative values of the present invention.

Then, an image 2300A showing the NORMAL cumulative value and the SPECIAL cumulative value which have been counted are displayed to the common large display 2300. In FIG. 46, "SPECIAL 850"and "NORMAL 72" are displayed to the common large display 2300. "SPECIAL 850" indicates that the SPECIAL cumulative value is 850. Further, "NORMAL 72" indicates that the NORMAL cumulative value is 72. When the SPECIAL cumulative value has reached a SPECIAL specific value (1000, in the present embodiment), the SPECIAL common game is executed and coins in number corresponding to the SPECIAL specific value are paid out to any of the slot machines 2010. Further, when the NORMAL cumulative value has reached a NORMAL specific value, the NORMAL common game is executed and coins in number corresponding to the NORMAL specific value is paid out to any of the slot machines 2010.

It is to be noted that the NORMAL specific value and the SPECIAL specific value correspond to the first specific value of the present invention. Further, the NORMAL specific value and the SPECIAL specific value correspond to the specific values of the present invention.

Further, in the gaming system 2001, 1% of the betted coins are cumulatively counted as a solo-progressive cumulative value, in addition to the NORMAL cumulative value and the SPECIAL cumulative value. Furthermore, an image 2300B indicative of the counted solo-progressive cumulative value is displayed to the common large display 2300. In FIG. 46, "123456" is displayed to the common large display 2300, indicating that the solo-progressive cumulative value is 123456. When the solo-progressive cumulative value has reached a solo-progressive specific value (150000, in the present embodiment), the normal game in each slot machine 2010 goes into a state that a solo progressive may be generated. In a case where the solo progressive is generated in any of the slot machines 2010, coins are paid out to the slot machine 2010 as a jackpot.

In the normal game, rearrangement of the symbols is conducted by the symbol determination program for the normal game, and in the common game, rearrangement of the symbols is conducted by the symbol determination program for the common game. Here, the symbol determination program for the common game is programmed not to generate the solo progressive, and therefore, the solo progressive is not to be generated in the common game.

As above, in the gaming system 2001, the solo progressive is programmed not to be generated in the common game. As a result, it is possible to provide a new-type gaming system capable of having the player more concentrated on the common game.

Next, with reference to FIGS. 47A to 47B, there is described a method for determining the slot machine 2010 to which the payout of coins is conducted in the common game.

FIGS. 47A to 47B are views each illustrating an exemplary image displayed to an upper image display panel included in a slot machine forming a gaming system according to the third embodiment.

In the following, when simply "the common game" is referred, both of the SPECIAL common game and the NORMAL common game are included.

As illustrated in FIG. 47A, text images indicative of precautions for an acquisition of the coins in EVENT TIME (the common game) are displayed to an upper image display panel 2033.

A text image 2601 indicates that EVENT TIME (the common game) is generated triggered by the cumulative value for the common game (the NORMAL cumulative value or the SPECIAL cumulative value) having reached the specific value (the SPECIAL specific value or the NORMAL specific value).

A text image 2602 indicates that the LEDs 2351 will be lighted according to the number of points acquired in each slot machine 2010 during EVENT TIME (the common game). It is to be noted that the acquisition of points will be later described by using FIG. 64 and the like.

A text image 2603 indicates that coins in number corresponding to the cumulative value for the common game will be paid out to the slot machine 2010 provided with the coupling illumination line 2310 with all the LEDs 2351 having been lighted.

In the present embodiment, the LEDs 2351 are lighted according to the number of acquired points, in an order starting from the LED 2351 closest to the slot machines 2010. Accordingly, the lines of the lighted LEDs 2351 appear to gradually extend toward the common large display 2300.

FIG. 47B further illustrates lighting of the LEDs 2351.

In the present embodiment, the upper image display panel 2033 is configured to switch the text images displayed thereto from the text images illustrated in FIG. 47A to the text images illustrated in FIG. 47B, triggered by a touch on a predetermined position on a touch panel (not illustrated) provided in the upper image display panel 2033.

A text image 2604 indicates that a number of LEDs included in the coupling illumination line 2310 may be different among the coupling illumination lines 2310.

In the present embodiment, the same number of LEDs 2351 are included in two coupling illumination lines 2310 listed in each of the following groups (I) to (V):

(I) the coupling illumination line 2310A and the coupling illumination line 2310J;

(II) the coupling illumination line 2310B and the coupling illumination line 2310I;

(III) the coupling illumination line 2310C and the coupling illumination line 2310H;

(IV) the coupling illumination line 2310D and the coupling illumination line 2310G; and (V) the coupling illumination line 2310E and the coupling illumination line 2310F.

However, the numbers of LEDs 2351 included in the coupling illumination lines listed in the respective groups (I) to (V) are different from each other.

This difference is caused by the difference in the numbers of LEDs 2351 in the bent portions.

The numbers of LEDs 2351 in the straight portions are same in all the coupling illumination lines 2310.

Further, FIG. 46 merely illustrates the gaming system according to the present embodiment schematically, and the number of LEDs 2351 illustrated in FIG. 46 is not related to the number of LEDs 2351 according to the present embodiment.

A text image 2605 indicates that the correspondence relationship between the number of acquired points and the number of LEDs 2351 to be lighted may be different in accordance with the coupling illumination line 2310. More specifically, the correspondence relationships between the number of acquired points and the number of LEDs 2351 to be lighted are different among the respective groups (I) to (V) (see FIGS. 65A and 65B).

Further, below the text image 2605, a text image indicating that the solo progressive is not to be generated during EVENT TIME is displayed.

Next, a configuration of the slot machine 2010 is described.

Figure 48:
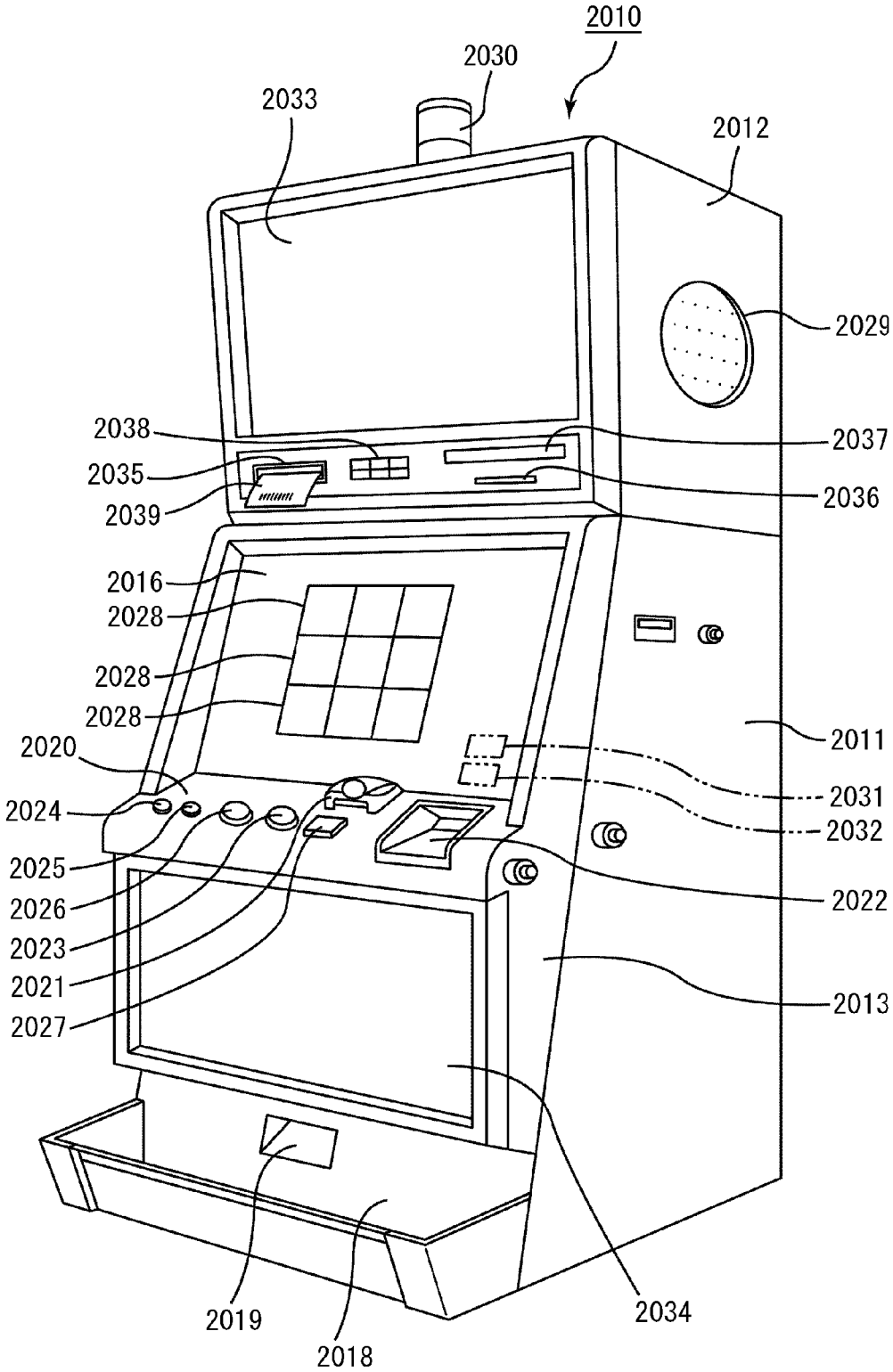
FIG. 48 is a perspective view illustrating an external view of a slot machine forming a gaming system according to the third embodiment.

FIG. 48 is a perspective view illustrating an external view of a slot machine forming the gaming system according to the third embodiment.

In the slot machine 2010, a coin, a bill, or electronic valuable information corresponding to those is used as a game medium. However, in the present invention, the game medium is not particularly limited. Examples of the game medium may include a medal, a token, electronic money and a ticket. It is to be noted that the ticket is not particularly limited, and examples thereof may include a ticket with a barcode as described later.

The slot machine 2010 comprises a cabinet 2011, a top box 2012 installed on the upper side of the cabinet 2011, and a main door 2013 provided at the front face of the cabinet 2011.

On the main door 2013, there is provided a lower image display panel 2016. The lower image display panel 2016 includes a transparent liquid crystal panel which displays nine display blocks 2028 along three columns and three rows. A single symbol is displayed in each display block 2028.

Further, although not illustrated, various types of images relating to an effect, as well as the aforementioned images, are displayed to the lower image display panel 2016.

Further, a number-of-credits display portion 2031 and a number-of-payouts display portion 2032 are provided on the lower image display panel 2016. The number-of-credits display portion 2031 displays an image indicative of the number of credited coins. The number-of-payouts display portion 2032 displays an image indicative of the number of coins to be paid out.

Moreover, although not shown, a touch panel 2069 is provided at the front face of the lower image display panel 2016. The player can operate the touch panel 2069 to input a variety of commands.

Below the lower image display panel 2016, there are provided a control panel 2020 including a plurality of buttons 2023 to 2027 with each of which a command according to game progress is inputted by the player, a coin receiving slot 2021 through which a coin is accepted into the cabinet 2011, and a bill validator 2022.

The control panel 2020 is provided with a start button 2023, a change button 2024, a CASHOUT button 2025, a 1-BET button 2026 and a maximum BET button 2027. The start button 2023 is for inputting a command to start scrolling of symbols. The change button 2024 is used for making a request of staff in the recreation facility for exchange. The CASHOUT button 2025 is used for inputting a command to pay out credited coins to a coin tray 2018.

The 1-BET button 2026 is used for inputting a command to bet one coin on a game out of credited coins. The maximum BET button 2027 is used for inputting a command to bet the maximum number of coins that can be bet on one game (3 coins in the present embodiment) out of credited coins.

The bill validator 2022 not only discriminates a regular bill from a false bill, but also accepts the regular bill into the cabinet 2011. It is to be noted that the bill validator 2022 may be configured so as to be capable of reading a later-described ticket 2039 with a barcode. At the lower front of the main door 2013, namely, below the control panel 2020, there is provided a belly glass 2034 on which a character or the like of the slot machine 2010 is drawn.

On the front surface of the top box 2012, there is provided the upper image display panel 2033. The upper image display panel 2033 includes a liquid crystal panel, which displays, for example, images indicative of introductions of the contents of games and explanations about the rules of games as illustrated in FIGS. 47A and 47B.

Further, a speaker 2029 is provided in the top box 2012. Under the upper image display panel 2033, there are provided a ticket printer 2035, a card reader 2036, a data display 2037, and a key pad 2038. The ticket printer 2035 prints on a ticket a barcode as coded data of the number of credits, a date, an identification number of the slot machines 2010, and the like, and outputs the ticket as the ticket 2039 with a barcode. The player can make another slot machine read the ticket 2039 with a barcode to play a game thereon, or exchange the ticket 2039 with a barcode with a bill or the like at a predetermined place in the recreation facility (e.g. a cashier in a casino).

The card reader 2036 reads data from a smart card and writes data into the smart card. The smart card is a card owned by the player, and for example, data for identifying the player and data concerning a history of games played by the player are stored therein. Data corresponding to a coin, a bill or a credit may be stored in the smart card. Further, a magnetic stripe card may be adopted in place of the smart card. The data display 2037 includes a fluorescent display and the like, and displays, for example, data read by the card reader 2036 or data inputted by the player via the key pad 2038. The key pad 2038 is used for inputting a command and data concerning issuing of a ticket, and the like.

Figure 49:
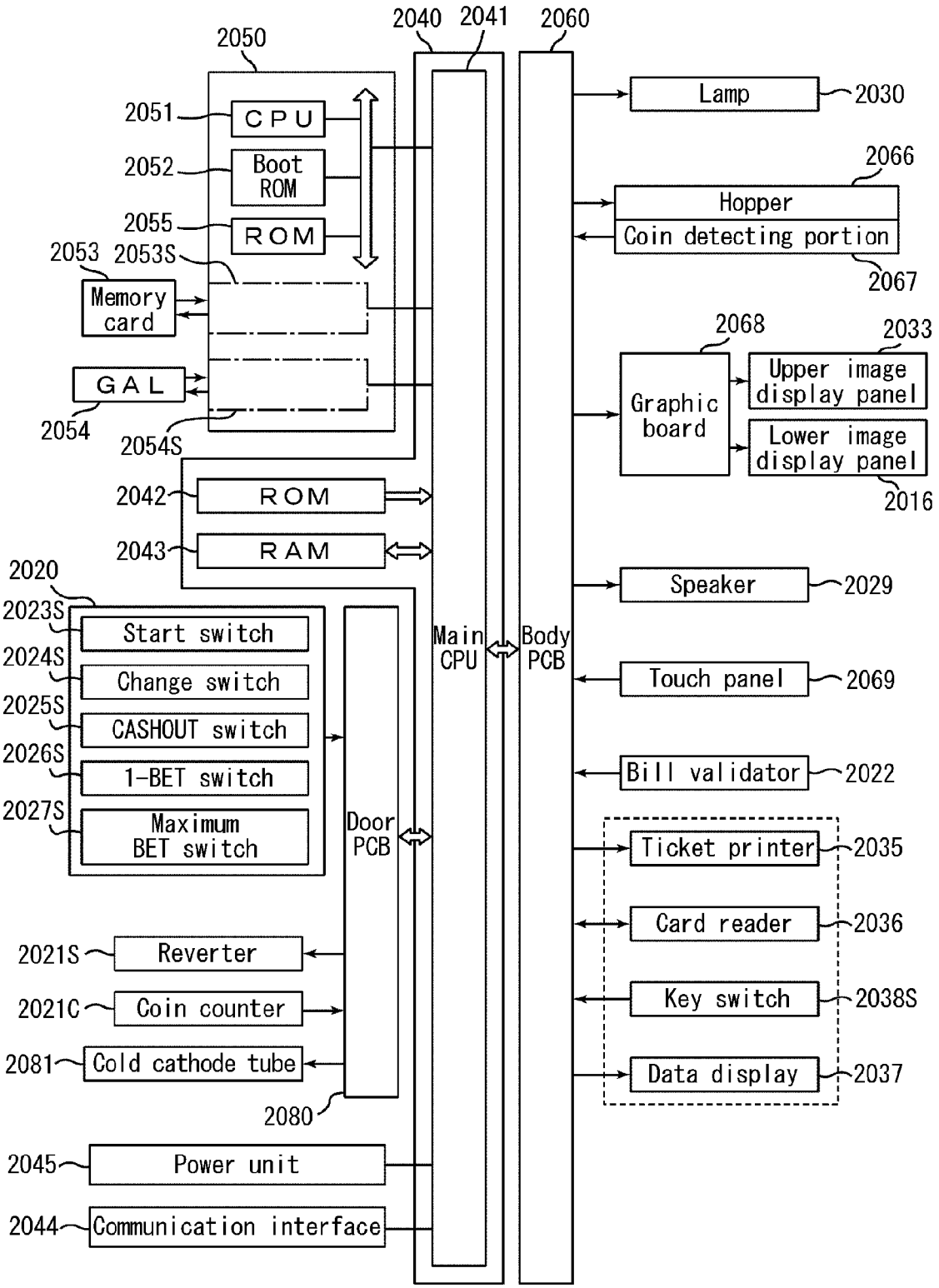
FIG. 49 is a block diagram illustrating an internal configuration of the slot machine shown in FIG. 48.

FIG. 49 is a block diagram showing an internal configuration of the slot machine shown in FIG. 48.

A gaming board 2050 is provided with a CPU (Central Processing Unit) 2051, a ROM 2055, and a boot ROM 2052 which are interconnected to one another by an internal bus, a card slot 2053S corresponding to a memory card 2053, and an IC socket 2054S corresponding to a GAL (Generic Array Logic) 2054.

The memory card 2053 includes a nonvolatile memory such as CompactFlash (registered trade mark), and stores a game program. The game program includes a symbol determination program. The symbol determination program is a program for determining symbols to be rearranged in the display blocks 2028. The symbol determination program includes a symbol determination program for the normal game and a symbol determination program for the common game.

In the normal game, the symbol determination program for the normal game is read and executed. At this time, when the solo-progressive cumulative value has reached the solo-progressive specific value, rearrangement of the symbols is to be conducted based on a later-described symbol array table A (see FIG. 54). When the solo-progressive cumulative value has not reached the solo-progressive specific value, rearrangement of the symbols is to be conducted based on a later-described symbol array table B (see FIG. 55). In the present embodiment, when the number of bets is 3 and "BLUE 7-BLUE 7-BLUE 7" are rearranged along a winning line WL (see FIG. 57), the solo progressive is established (see FIG. 56C). However, according to the symbol array table B, "BLUE 7" is not to be displayed to a center display block. Namely, in the present embodiment, the solo progressive is not to be generated by using the symbol array table B.

Further, in the common game, the symbol determination program for the common game is read and executed. At this time, rearrangement of the symbols is to be conducted based on the symbol array table B. In the present embodiment, a common symbol array table, that is, the symbol array table B is used in the normal game, both in the case where the cumulative value for the solo progressive has not reached the solo-progressive specific value and in the case of the common game. However, in the present invention, different symbol array tables may be used in the case where the solo-progressive cumulative value has not reached the solo-progressive specific value and in the case of the common game.

Further, the game program includes odds data indicative of the correspondence relationship between combinations of the symbols to be rearranged along the winning line WL and the number of coin-outs (see FIGS. 56A to 56C).

Further, the card slot 2053S is configured so as to allow the memory card 2053 to be inserted thereinto or removed therefrom, and is connected to the mother board 2040 by an IDE bus. Therefore, the memory card 2053 can be removed from the card slot 2053S, and then another game program is written into the memory card 2053, and the memory card 2053 can be inserted into the card slot 2053S, to change the type and contents of a game played on the slot machine 2010. The game program includes a program according to progress of the game. Further, the game program includes image data and sound data to be outputted during the game.

The CPU 2051, the ROM 2055 and the boot ROM 2052 interconnected to one another by an internal bus are connected to the mother board 2040 through the PCI bus. The PCI bus not only conducts signal transmission between the mother board 2040 and the gaming board 2050, but also supplies power from the mother board 2040 to the gaming board 2050.

The mother board 2040 is configured using a commercially available general-purpose mother board (a print wiring board on which fundamental components of a personal computer are mounted), and provided with a main CPU 2041, a ROM (Read Only Memory) 2042, a RAM (Random Access Memory) 2043, and a communication interface 2044. The mother board 2040 corresponds to the controller of the present invention.

The ROM 2042 comprises a memory device such as a flash memory, and stores a program such as a BIOS (Basic Input/Output System) executed by the main CPU 2041 and permanent data. When the BIOS is executed by the main CPU 2041, processing for initializing a predetermined peripheral device is conducted, concurrently with start of processing for loading the game program stored in the memory card 2053 via the gaming board 2050. It is to be noted that, in the present invention, the ROM 2042 may or may not be data rewritable one.

The RAM 2043 stores data and a program to be used at the time of operation of the main CPU 2041. Further, the RAM 2043 is capable of storing a game program.

Moreover, the RAM 2043 stores data of the number of credits, the numbers of coin-ins and coin-outs in one game, and the like.

Moreover, the mother board 2040 is connected with a later-described body PCB (Printed Circuit Board) 2060 and a door PCB 2080 through respective USBs. Further, the mother board 2040 is connected with a power supply unit 2045 and the communication interface 2044.

The body PCB 2060 and the door PCB 2080 are connected with an equipment and a device that generate an input signal to be inputted into the main CPU 2041 and an equipment and a device operations of which are controlled by a control signal outputted from the main CPU 2041. The main CPU 2041 executes the game program stored in the RAM 2043 based on the input signal inputted into the main CPU 2041, and thereby executes the predetermined arithmetic processing and stores the result thereof into the RAM 2043, or transmits a control signal to each equipment and device as processing for controlling each equipment and device.

The body PCB 2060 is connected with a lamp 2030, a hopper 2066, a coin detecting portion 2067, a graphic board 2068, the speaker 2029, the touch panel 2069, the bill validator 2022, the ticket printer 2035, the card reader 2036, a key switch 38S and the data display 2037. The lamp 2030 is lighted in a predetermined pattern based on control signals outputted from the main CPU 2041.

The hopper 2066 is installed inside the cabinet 2011, and pays out a predetermined number of coins based on the control signal outputted from the main CPU 2041, from a coin payout exit 2019 to the coin tray 2018. The coin detecting portion 2067 is provided inside the coin payout exit 2019, and outputs an input signal to the main CPU 2041 in the case of detecting payout of the predetermined number of coins from the coin payout exit 2019.

The graphic board 2068 controls image display to the upper image display panel 2033 and the lower image display panel 2016 based on the control signal outputted from the main CPU 2041. In the respective display blocks 2028 on the lower image display panel 2016, symbols are displayed in a scrolling manner or in a stopped state. The number of credits stored in the RAM 2043 is displayed to the number-of-credits display portion 2031 of the lower image display panel 2016. Further, the number of coin-outs is displayed to the number-of-payouts display portion 2031 of the lower image display panel 2016.

The graphic board 2068 comprises a VDP (Video Display Processor) for generating image data based on the control signal outputted from the main CPU 2041, a video RAM for temporarily storing image data generated by the VDP, and the like. It is to be noted that image data used in generation of the image data by the VDP is included in the game program read from the memory card 2053 and stored into the RAM 2043.

The bill validator 2022 not only discriminates a regular bill from a false bill, but also accepts the regular bill into the cabinet 2011. Upon acceptance of the regular bill, the bill validator 2022 outputs an input signal to the main CPU 2041 based on a face amount of the bill. The main CPU 2041 stores in the RAM 2043 the number of credits corresponding to the face amount of the bill transmitted with the input signal.

The ticket printer 2035, based on the control signal outputted from the main CPU 2041, prints on a ticket a barcode as coded data of the number of credits stored in the RAM 2043, a date, an identification number of the slot machine 2010, and the like, and outputs the ticket as the ticket 2039 with a barcode.

The card reader 2036 reads data from the smart card and transmits the read data to the main CPU 2041, and writes data onto the smart card based on the control signal from the main CPU 2041. The key switch 2038S is provided on the key pad 2038, and outputs a predetermined input signal to the main CPU 2041 when the key pad 2038 is operated by the player. The data display 2037 displays data read by the card reader 2036 and data inputted by the player via the key pad 2038, based on the control signal outputted from the main CPU 2041.

The door PCB 2080 is connected with the control panel 2020, a reverter 2021S, a coin counter 2021C, and a cold cathode tube 2081. The control panel 2020 is provided with a start switch 2023S corresponding to the start button 2023, a change switch 2024S corresponding to the change button 2024, a CASHOUT switch 2025S corresponding to the CASHOUT button 2025, a 1-BET switch 2026S corresponding to the 1-BET button 2026, and a maximum BET switch 2027S corresponding to the maximum BET button 2027. Each of the switches 2023S to 2027S outputs an input signal to the main CPU 2041 when each of the buttons 2023 to 2027 corresponding thereto is operated by the player.

The coin counter 2021C is provided inside the coin receiving slot 2021, and discriminates a regular coin from a false coin inserted into the coin receiving slot 2021 by the player. Coins other than the regular coin are discharged from the coin payout exit 2019. Further, the coin counter 2021C outputs an input signal to the main CPU 2041 in detection of the regular coin.

The reverter 2021S operates based on the control signal outputted from the main CPU 2041, and distributes a coin recognized by the coin counter 2021C as the regular coin into a cash box (not shown) or the hopper 2066, which are disposed in the slot machine 2010. Namely, when the hopper 2066 is filled with coins, the regular coin is distributed into the cash box by the reverter 2021S. On the other hand, when the hopper 2066 is not filled with coins, the regular coin is distributed into the hopper 2066. The cold cathode tube 2081 functions as a back light installed on the rear face side of the lower image display panel 2016 and the upper image display panel 2033, and lighted up based on the control signal outputted from the main CPU 2041.

Figure 50:
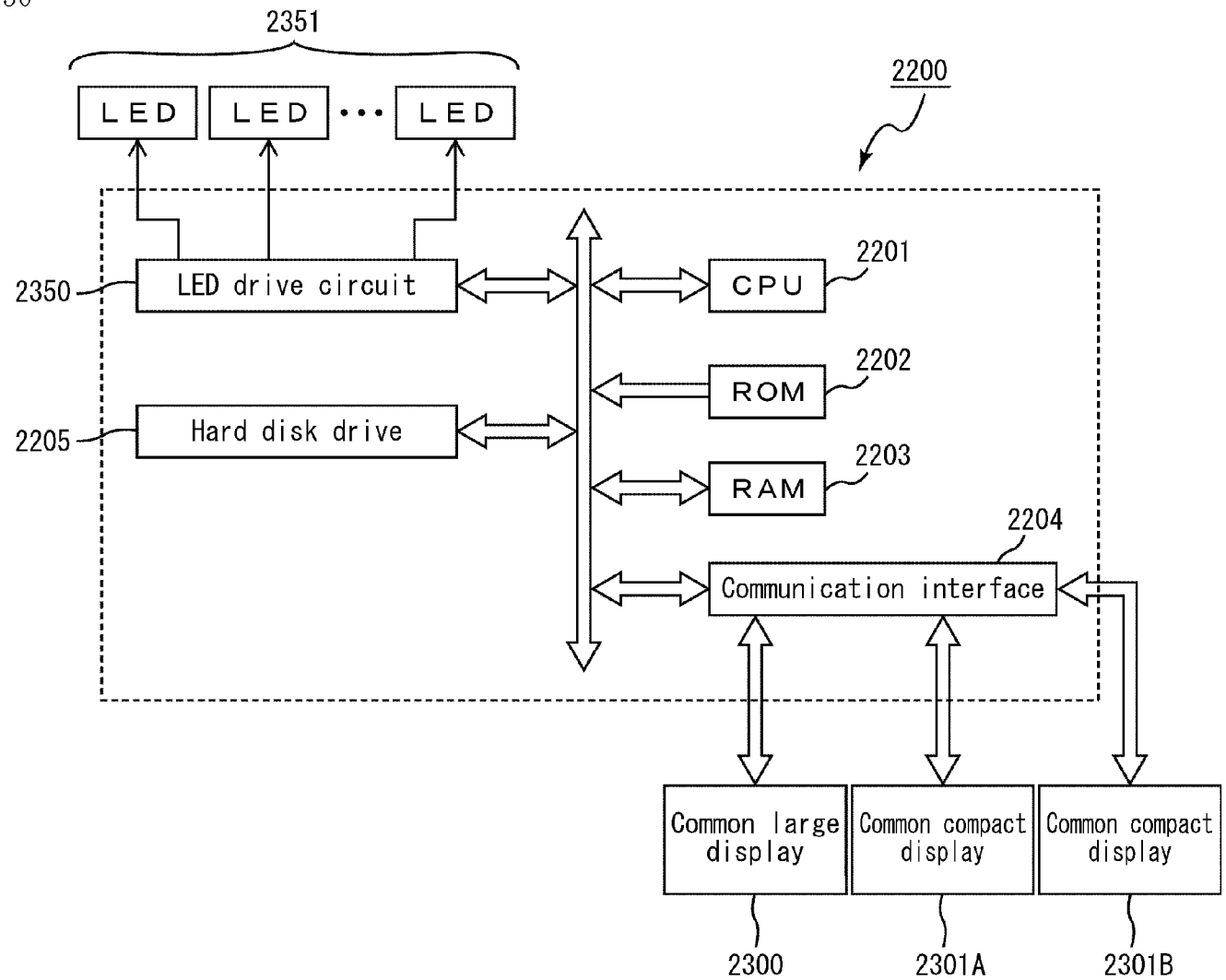
FIG. 50 is a block diagram illustrating an internal configuration of a control device forming the gaming system according to the third embodiment.

FIG. 50 is a block diagram illustrating an internal configuration of a control device forming the gaming system according to the third embodiment.

The control device 2200 includes a CPU 2201, a ROM 2202, a RAM 2203, a communication interface 2204, a LED drive circuit 2350 and a hard disk drive 2205. The communication interface 2204 is connected, through communication lines 2101, to the communication interfaces 2044 in the respective slot machines 2010 and also is connected to the common large display 2300 and the common compact displays 2301 through communication lines 102. The ROM 2202 stores a system program for controlling the operation of a processor, permanent data, and the like.

The RAM 2203 temporarily stores data received from each slot machine 2010. The RAM 2203 is provided with an increment-rate storage area (see FIG. 60), a cumulative-value storage area (see FIG. 61), a specific-value storage area (see FIG.

62), a number-of-lighting determination table storage area (see FIGS. 65A and 65B), and a number-of-lights storage area.

The increment-rate storage area stores a SPECIAL increment rate, a NORMAL increment rate, and a solo-progressive increment rate.

The cumulative-value storage area stores the SPECIAL cumulative value, the NORMAL cumulative value, and the solo-progressive cumulative value.

The number-of-lighting determination table storage area stores number-of-lighting determination table data to be referred in determining the number of LEDs 2351 to be lighted during the common game, in association with the identification numbers of the slot machines 2010.

The number-of-lights storage area stores number-of-lights data indicative of the numbers of LEDs 2351 which have been lighted, out of the LEDs 2351 included in the coupling illumination lines 2310 provided for the respective slot machines 2010, in association with the identification numbers of the slot machines 2010 provided with the corresponding coupling illumination line 2310.

The hard disk drive 2205 stores number-of-lighting determination table data showing a plurality of types of number-of-lighting determination tables (a number-of-lighting determination table for bent portions and a number-of-lighting determination table for straight portions).

Further, the hard disk drive 2205 stores number-of-points determination table data to be referred to in determining the number of points in the common game.

The plurality of LEDs 2351 are connected to the LED drive circuit 2350. The LEDs 2351 are associated with respective identification numbers, and the LED drive circuit 2350 turns on and turns off the LEDs 2351 based on a signal received from the CPU 2201.

Next, there is described processing executed in the slot machines 2010.

The main CPU 2041 proceeds with a slot machine game by reading and executing the game program.

Figure 51:
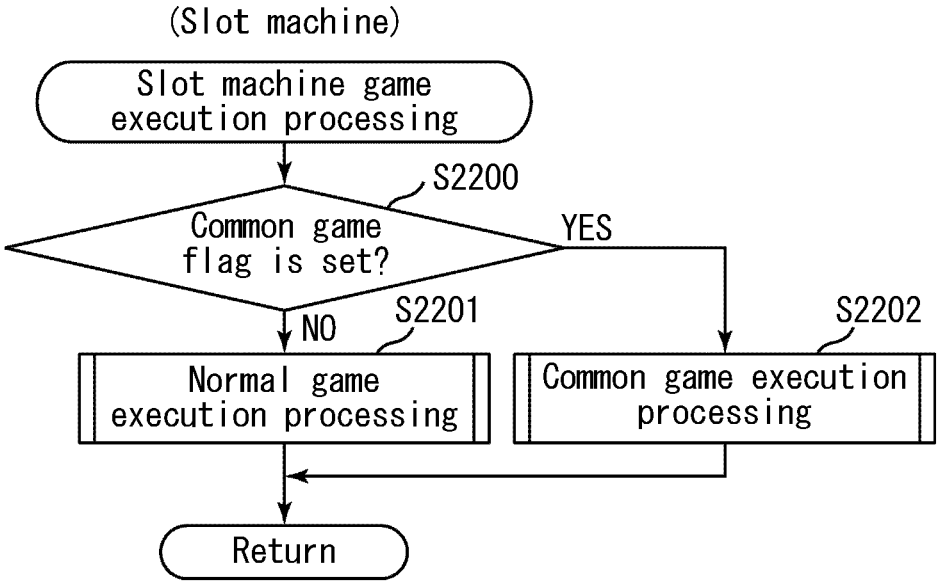
FIG. 51 is a flowchart illustrating slot-machine game execution processing executed in a slot machine in the third embodiment.

FIG. 51 is a flowchart illustrating slot-machine game execution processing executed in the slot machines in the third embodiment.

At first, the main CPU 2041 determines whether or not a common-game flag is set (step S2200). The common-game flag is a flag to be set when the common-game execution signal is received, which is to be transmitted from the control device 2200 triggered by the cumulative value (the NORMAL cumulative value or the SPECIAL cumulative value) having reached the common-game specific value (the NORMAL specific value or the SPECIAL specific value).

When determining in step S2200 that the common-game flag is not set, the main CPU 2041 executes normal game execution processing (step S2201). The normal game execution processing will be described in more detail later with reference to FIG. 53. After executing the processing of step S2201, the main CPU 2041 completes the present subroutine. The processing of step S2201 corresponds to the processing of executing the solo game of the present invention. Here, the normal game corresponds to the solo game of the present invention.

On the other hand, when determining that the common-game flag is set, the main CPU 2041 executes common game execution processing (step S2202). The common game execution processing will be described in more detail later with reference to FIG. 58. After executing the processing of step S2202, the main CPU 2041 completes the present subroutine.

Figure 52:
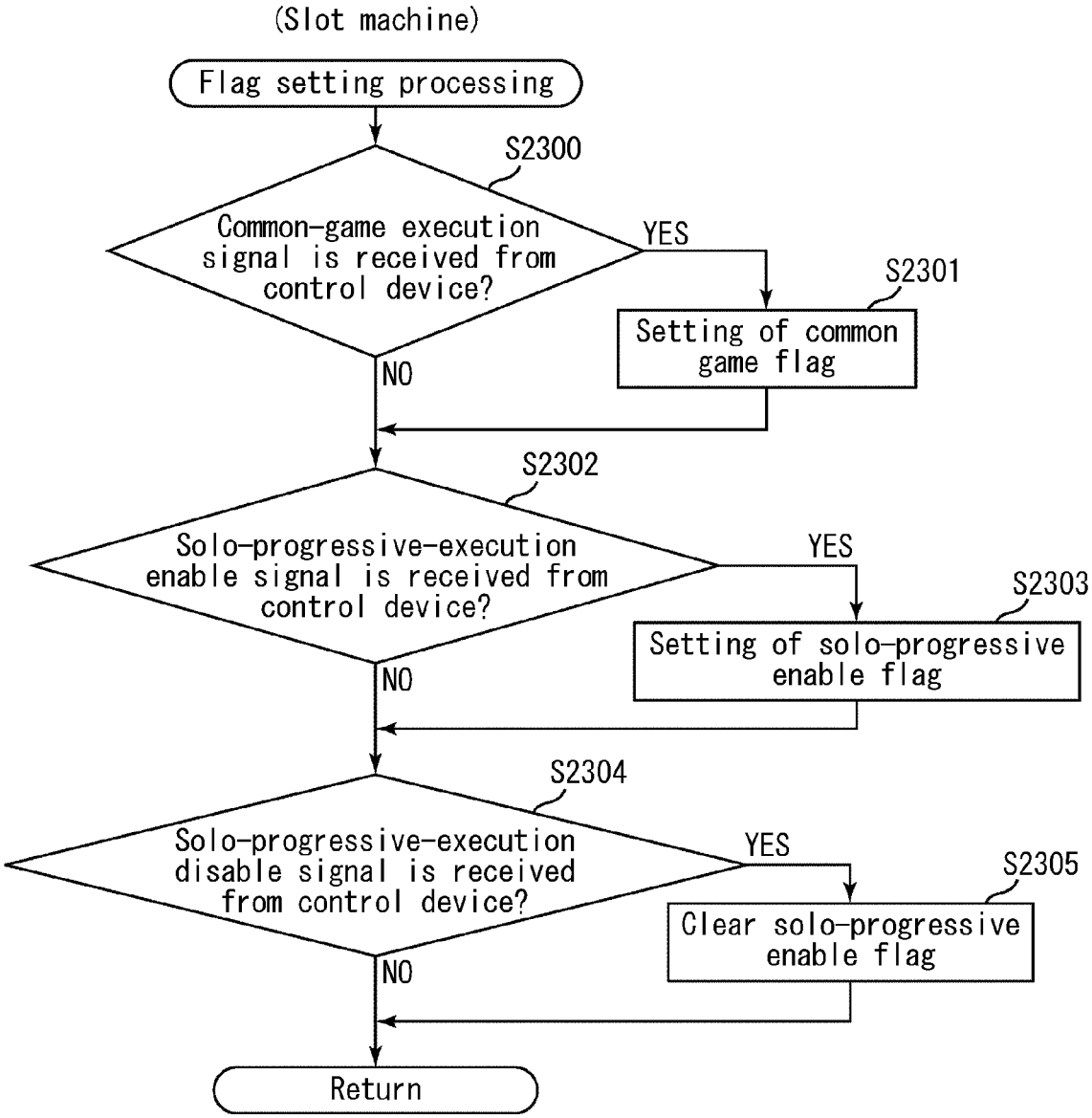
FIG. 52 is a flowchart illustrating a subroutine of flag setting processing in the third embodiment.

FIG. 52 is a flowchart illustrating a subroutine of flag setting processing in the third embodiment.

At first, the main CPU 2041 determines whether or not to have received a common-game execution signal (step S2300). The common-game execution signal is a signal transmitted from the control device 2200 triggered by the common-game cumulative value having reached the common-game specific value (see steps S2104 and S2105 in FIG. 59).

When determining to have received the common-game execution signal, the main CPU 2041 sets the common-game flag in a predetermined area of the RAM 2043 (step S2301).

When determining not to have received the common-game execution signal in step S2300, or after the processing of step S2301, the main CPU 2041 determines whether or not to have received a solo-progressive-execution enable signal from the control device 2200 (step S2302). The solo-progressive-execution enable signal is a signal to be transmitted from the control device 2200 triggered by the solo-progressive cumulative value having reached the solo-progressive specific value (see steps S2107 and S2108 in FIG. 59).

When determining to have received the solo-progressive-execution enable signal from the control device 2200, the main CPU 2041 sets the solo-progressive enable flag in a predetermined area of the RAM 2043 (step S2303).

When determining not to have received the solo-progressive-execution enable signal from the control device 2200, or after the processing of step S2303, the main CPU 2041 determines whether or not to have received a solo-progressive-execution disable signal from the control device 2200 (step S2304). The solo-progressive-execution disable signal is the signal to be transmitted from the control device 2200 when the solo progressive is generated in any of the slot machines 2010 and the solo-progressive cumulative value becomes smaller than the solo-progressive specific value (see steps S2163 and S2164 in FIG. 66).

When determining to have received the solo-progressive-execution disable signal from the control device 2200, the main CPU 2041 clears the solo-progressive enable flag set in the RAM 2043 and completes the present subroutine. On the other hand, when determining not to have received the solo-progressive-execution disable signal from the control device 2200 in step S2304, the main CPU 2041 completes the present subroutine.

Figure 53:
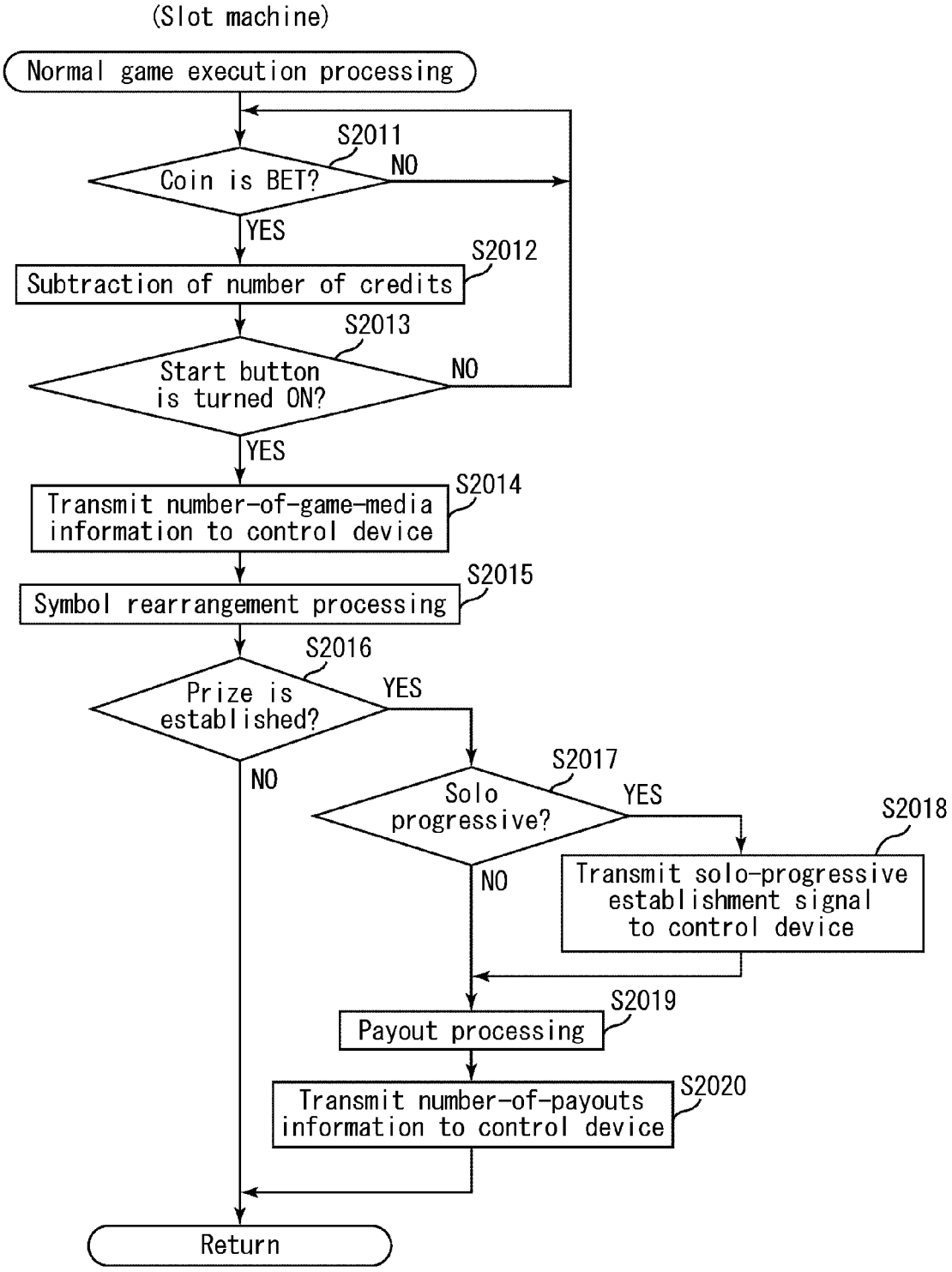
FIG. 53 is a flowchart illustrating a subroutine of normal game execution processing in the third embodiment.

FIG. 53 is a flowchart illustrating a subroutine of normal game execution processing in the third embodiment.

First, the main CPU 2041 determines whether or not a coin has been betted (step S2011). In this processing, the main CPU 2041 determines whether or not to have received an input signal that is outputted from the 1-BET switch 2026S when the 1-BET button 2026 is operated, or an input signal that is outputted from the maximum BET switch 2027S when the maximum BET button 2027 is operated. When the main CPU 2041 determines that the coin has not been betted, the processing is returned to step S2011.

On the other hand, when determining that the coin has been betted in step S2011, the main CPU 2041 conducts processing for making a subtraction from the number of credits stored in the RAM 2043 according to the number of betted coins (step S2012). It is to be noted that, when the number of coins to be betted is larger than the number of credits stored in the RAM 2043, the main CPU 2041 does not conduct the processing for making a subtraction from the number of credits stored in the RAM 2043, and the processing is returned to step S2011. Further, when the number of coins to be betted exceeds the upper limit of the number of coins that can be betted in one game (3 coins in the present embodiment), the main CPU 2041 does not conduct the processing for making a subtraction from the number of credits stored in the RAM 2043, and the processing is proceeded to step S2013.

Next, the main CPU 2041 determines whether or not the start button 2023 has been turned ON (step S2013). In this processing, the main CPU 2041 determines whether or not to have received an input signal that is outputted from the start switch 2023S when the start button 2023 is pressed.

When the main CPU 2041 determines that the start button 2023 has not been turned on, the processing is returned to step S2011. It is to be noted that, when the start button 2023 is not turned ON (e.g. when the start button 2023 is not turned ON and a command to end the game is inputted), the main CPU 2041 cancels a subtraction result in step S2012.

On the other hand, when determining in step S2013 that the start button 2023 has been turned on, the main CPU 2041 transmits number-of-game-media information indicative of the number of betted coins to the control device 2200 (step S2014). The number-of-game-media information includes information indicative of the identification number of the slot machine 2010.

Next, the main CPU 2041 executes symbol rearrangement processing (step S2015). In this processing, at first, the main CPU 2041 starts scrolling-display of normal symbols in the display blocks 2028. Then, the main CPU 2041 executes the aforementioned symbol determination program for the normal game, so as to determine the symbols to be rearranged, and then rearranges the symbols in the display blocks 2028. At this time, when the solo-progressive enable flag is set in the RAM 2043, the symbols are rearranged based on a symbol array table A (see FIG. 54). When the solo-progressive enable flag is not set in the RAM 2043, the symbols are rearranged based on the symbol array table B (see FIG. 55).

FIG. 54 is a view illustrating the symbol array table A in the third embodiment.

FIG. 55 is a view illustrating the symbol array table B in the third embodiment.

In the array tables A and B, symbol columns to be arranged in a left column, a center column, and a right column of the display blocks 2028 are determined. In the array table B, since there is no "BLUE 7" in the symbol column in the center column, "BLUE 7-BLUE 7-BLUE 7" is not to be established. On the other hand, in the array table A, since there are "BLUE 7" in all symbol columns in the left column, the center column, and the right column, it is possible that "BLUE 7-BLUE 7-BLUE 7" is established.

FIGS. 56A to 56C are views each illustrating a corresponding relationship between a combination of symbols and an amount of payout in the third embodiment.

As shown in FIGS. 56A to 56C, in the present embodiment, the relation between the combination of symbols and the number of coin-outs is varied according to the cases where the number of betted coins is one, two, and three.

It is to be noted that in the drawings, "any bar" refers to any symbol among "3 bar", "2 bar", and "1 bar". As shown in FIG. 56C, in the case where the number of betted coins is three and "BLUE 7-BLUE 7-BLUE 7" is established, the solo progressive is generated.

Figure 57:
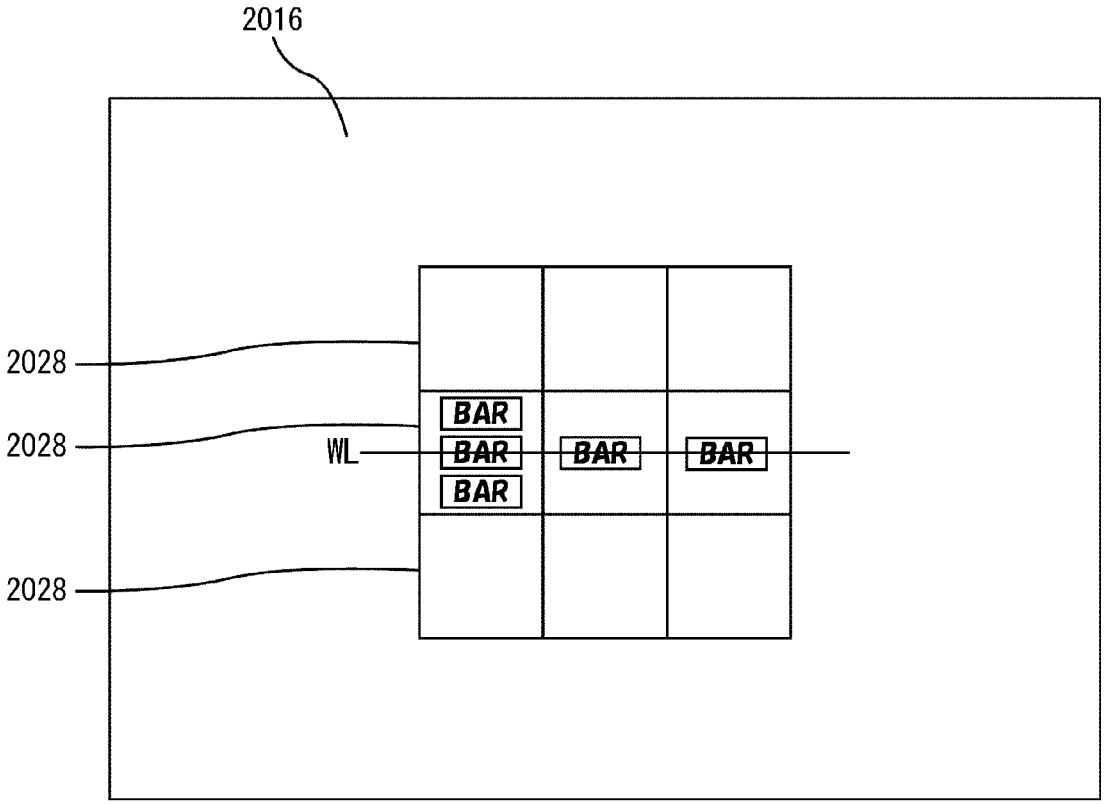
FIG. 57 is an exemplary view illustrating symbols rearranged in display blocks in the third embodiment.

FIG. 57 is an exemplary view illustrating symbols rearranged in display blocks in the third embodiment.

As shown in FIG. 57, the winning line WL is set on the center row of the display blocks 2028. When the symbols in a predetermined combination are rearranged on the winning line WL, payout of coins is conducted. The lower image display panel 2016 for displaying the symbols thereto corresponds to the symbol display of the present invention.

After the processing of step S2015 (see FIG. 53), the main CPU 2041 determines whether or not a prize has been established (step S2016). Here, the establishment of the prize refers to an establishment of any combinations of symbols shown in FIGS. 56A to 56C.

When determining that the prize has been established, the main CPU 2041 determines whether or not the prize of the solo progressive is established (step S2017). When determining that the prize of the solo progressive is established, the main CPU 2041 transmits a solo-progressive establishment signal to the control device 2200 (step S2018).

When determining that the prize of the solo progressive has not been established in step S2017, or after the processing of step S2018, the main CPU 2041 executes processing relating to the payout of coins (step S2019). In the processing, the main CPU 2041 determines the amount of payout based on the rearranged symbols with reference to the odds data stored in the RAM 2043. The odds data is data indicative of the correspondence relationship between the symbols rearranged in the display blocks 2028 and the amount of payouts (see FIGS. 56A to 56C). Here, in the case where the prize is the solo progressive, the coins are paid out in number corresponding to the solo-progressive specific value (150000, in the present embodiment).

In the case of accumulating coins, the main CPU 2041 conducts processing for adding the number of credits corresponding to the determined amount of payout to the number of credits stored in the RAM 2043. On the other hand, in the case of paying out coins, the main CPU 2041 transmits a control signal to the hopper 2066 in order to pay out coins in an amount corresponding to the determined amount of payout.

Then, the main CPU 2041 transmits number-of-payout information indicative of the determined amount of payout, that is, the number of paid out coins to the control device 2200 (step S2020).

When determining in step S2016 that no prize has been established, or after executing the processing of step S2020, the main CPU 2041 completes the present subroutine.

Subsequently, the common game execution processing is described.

Figure 58:
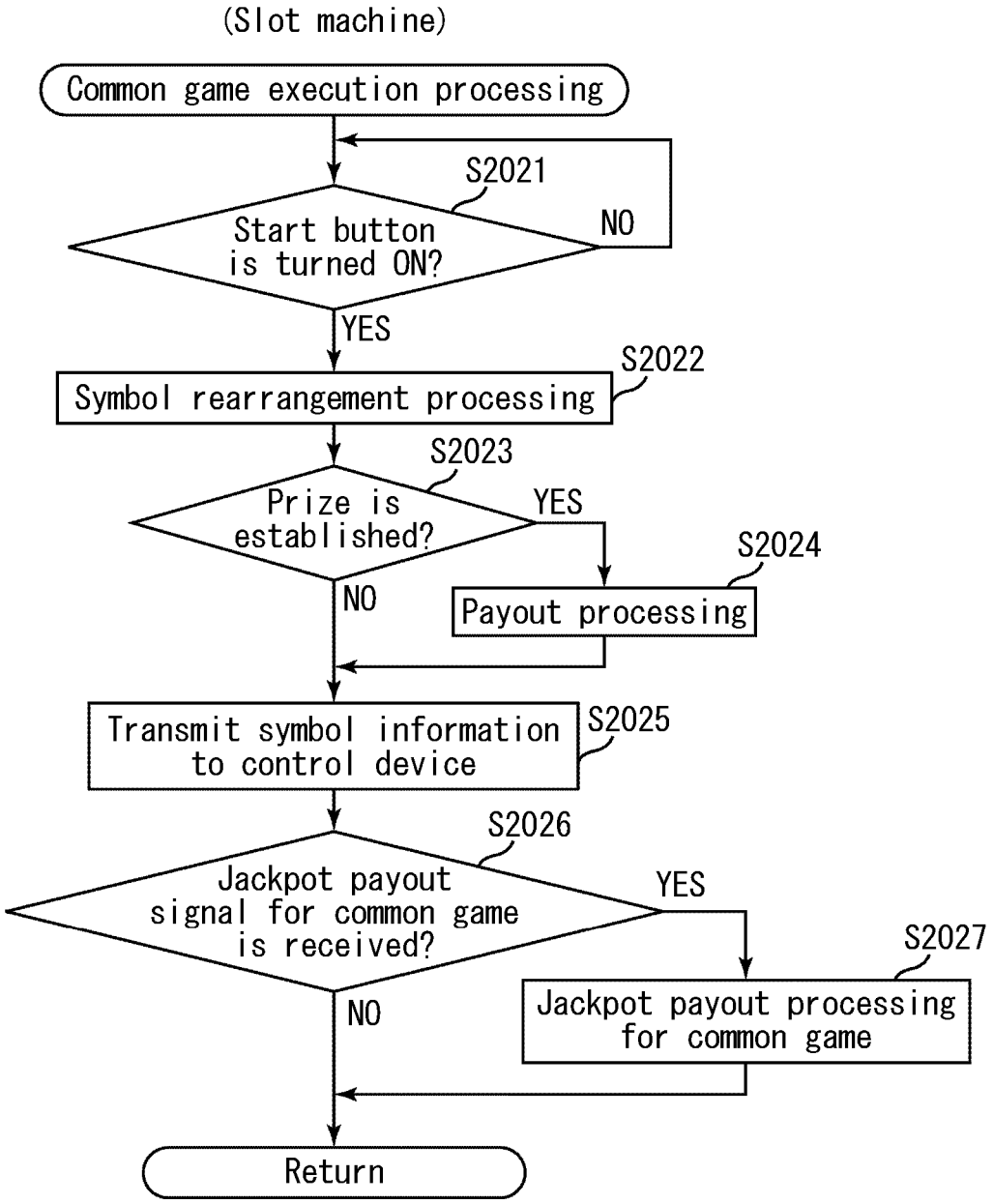
FIG. 58 is a flowchart illustrating a subroutine of common game execution processing in the third embodiment.

FIG. 58 is a flowchart illustrating a subroutine of the common game execution processing in the third embodiment.

At first, the main CPU 2041 executes processing of steps S2021 to S2024, and these processing are substantially the same as the processing of step S2013 and steps S2015 to S2017 in FIG. 53. Here, only a part different from step S2013 and steps S2015 to S2017 in FIG. 53 is described.

There has been described a case where the main CPU 2041 executes the symbol determination program for the normal game in step S2015 in FIG. 53 for determining symbols to be rearranged, and then, rearranges the symbols in the display blocks 2028. On the contrary, in step S2022 in FIG. 58, the main CPU 2041 executes the symbol determination program for the common game for determining symbols to be rearranged, and then, rearranges the symbols in the display blocks 2028.

When determining in step S2023 that no prize has been established or after executing the processing of step S2024, the main CPU 2041 transmits symbol information to the control device 2200 (step S2025). The symbol information is information indicative of the common-game symbols rearranged in step S2022. The symbol information corresponds to common-game result information according to the present invention.

Next, the main CPU 2041 determines whether or not to have received a jackpot payout signal for the common game (step S2026). The jackpot payout signal for the common game is a signal transmitted from the control device 2200 to the slot machine 2010 triggered by all the LEDs 2351 included in the coupling illumination line 2310 provided in any of the slot machines 2010 having been lighted (see steps S2125 to S2126 in FIG. 63). The jackpot payout signal for the common game includes information indicative of the NORMAL specific value or the SPECIAL specific value.

When determining to have received the jackpot payout signal for the common game, the main CPU 2041 executes jackpot payout processing for the common game (step S2027). In this processing, the main CPU 2041 pays out coins in number corresponding to the NORMAL specific value or the SPECIAL specific value, based on the information indicative of the cumulative value which is included in the jackpot payout signal for the common game. In the present embodiment, the number corresponding to the NORMAL specific value is 100 and the number corresponding to the SPECIAL specific value is 1000.

The processing executed by the main CPU 2041 in step S2027 includes output of an annunciation sound from the speaker 2029, lighting of the lamp 2030, print of the ticket 2039 with a barcode indicative of the number of payouts printed thereon, and the like.

When determining not to have received a jackpot payout signal for the common game in step S2026 or after executing the processing of step S2027, the main CPU 2041 completes the present subroutine.

As above, there has been described the processing which is executed in the slot machines 2010.

Subsequently, processing executed by the control device 2200 is described.

Figure 59:
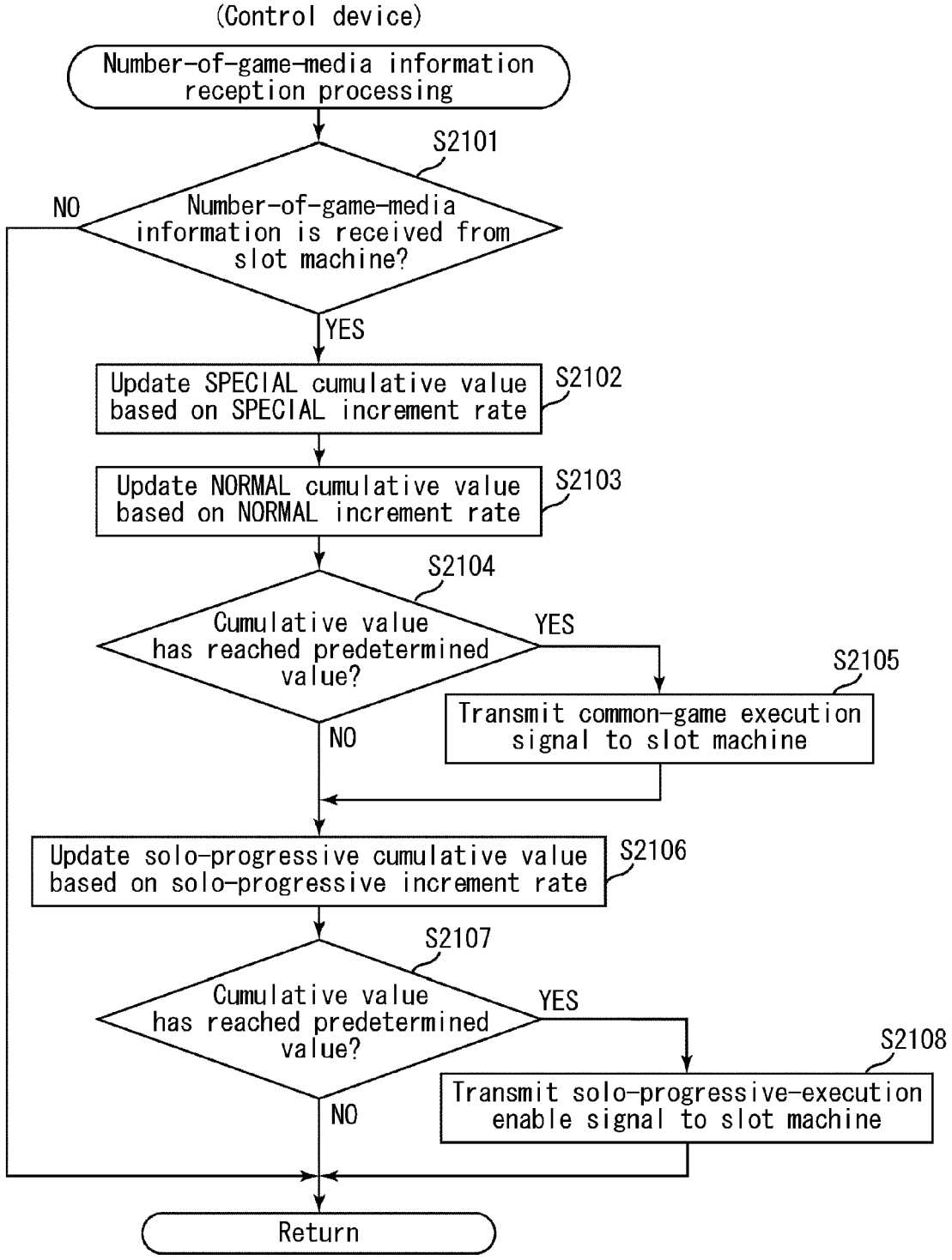
FIG. 59 is a flowchart illustrating a subroutine of number-of-game-media information reception processing in the third embodiment.

FIG. 59 is a flowchart illustrating a subroutine of number-of-game-media information reception processing in the third embodiment.

At first, the CPU 2201 determines whether or not to have received the number-of-game-media information from the slot machine 2010 at a predetermined timing (step S2101). In the present embodiment, the number-of-game-media information is information indicative of the number of coins which have been betted in the slot machine 2010 (see step S2014 in FIG. 53). When determining not to have received the number-of-game-media information, the CPU 2201 completes the present subroutine.

When determining to have received the number-of-game-media information, the CPU 2201 updates the SPECIAL cumulative value based on the SPECIAL increment rate stored in the RAM 2203 (step S2102).

FIG. 60 is a view illustrating an increment-rate storage area in the third embodiment.

As shown in FIG. 60, the RAM 2203 in the control device 2200 is provided with the increment-rate storage area, which stores an increment rate for the SPECIAL common game (SPECIAL increment rate), an increment rate for the NORMAL common game (NORMAL increment rate), and an increment rate for the solo progressive (solo-progressive increment rate). In the present embodiment, 0.5% as the SPECIAL increment rate, 3% as the NORMAL increment rate, and 1% as the solo-progressive increment rate are stored.

FIG. 61 is a view illustrating the cumulative-value storage area in the third embodiment.

As shown in FIG. 61, the RAM 2203 in the control device 2200 is provided with the cumulative-value storage area which stores the SPECIAL cumulative value, the NORMAL cumulative value, and the solo-progressive cumulative value.

In the processing of step S2102, the CPU 2201 adds 0.5% of the number of coins shown by the number-of-game-media information to the SPECIAL cumulative value and stores the resulting value. For example, when the number of coins shown by the number-of-game-media information is 3, the CPU 2201 adds 0.015 to the SPECIAL cumulative value and stores the resulting value.

Next, in step S2103, the CPU 2201 updates the NORMAL cumulative value based on the NORMAL increment rate stored in the RAM 2203 (step S2103). In the processing of step S2103, the CPU 2201 adds 3% of the number of coins shown by the number-of-game-media information to the NORMAL cumulative value and stores the resulting value. For example, when the number of coins shown by the number-of-game-media information is 3, the CPU 2201 adds 0.09 to the NORMAL cumulative value and stores the resulting value.

Next, the CPU 2201 determines whether or not the SPECIAL cumulative value has reached the SPECIAL specific value, or the NORMAL cumulative value has reached the NORMAL specific value, with reference to the cumulative-value storage area and the specific-value storage area of the RAM 2203 (see FIG. 62).

FIG. 62 is a view illustrating the specific-value storage area in the third embodiment.

As shown in FIG. 62, the RAM 2203 in the control device 2200 is provided with the specific-value storage area which stores the SPECIAL specific value and the NORMAL specific value and the solo-progressive specific value. In the present embodiment, 1000 as the SPECIAL specific value, 100 as the NORMAL specific value, and 150000 as the solo-progressive specific value are stored.

When determining that the SPECIAL cumulative value has reached the SPECIAL specific value or that the NORMAL cumulative value has reached the NORMAL specific value, the CPU 2201 transmits the common-game execution signal to the slot machines 2010 (step S2105). The common-game execution signal is a signal which triggers the execution of the common game in the slot machines 2010. Further, in this processing, the slot machines 2010 to which the common-game execution signal is transmitted from the CPU 2201 are the slot machines 2010 having transmitted number-of-game-media information in a predetermined time.

When determining that the SPECIAL cumulative value has not reached the SPECIAL specific value and that the NORMAL cumulative value has not reached the NORMAL specific value in step S2104, or after the processing of step S2105, the CPU 2201 shifts the processing to step S2106.

In step S2106, the CPU 2201 updates the solo-progressive cumulative value, based on the solo-progressive increment rate stored in the RAM 2203 (step S2102). In the present embodiment, the solo-progressive increment rate is set to be 1% (see FIG. 60). For example, when the number of coins shown by the number-of-game-media information is 3, the CPU 2201 adds 0.03 to the solo-progressive cumulative value and stores the resulting value.

Next, in step S2107, the CPU 2201 determines whether or not the solo-progressive cumulative value has reached the solo-progressive specific value, with reference to the cumulative-value storage area and the specific value storage area in the RAM 2203 (see FIG. 62). When determining that the solo-progressive cumulative value has reached the solo-progressive specific value, the CPU 2201 transmits the solo-progressive-execution enable signal to the slot machine 2010 (step S2108). The solo-progressive-execution enable signal is the signal for notifying approval of the generation of the solo progressive in the slot machine 2010. When determining that the solo-progressive cumulative value has not reached the solo-progressive specific value in step S2107, or after the processing of step S2108, the CPU 2201 completes the present subroutine.

Figure 63:
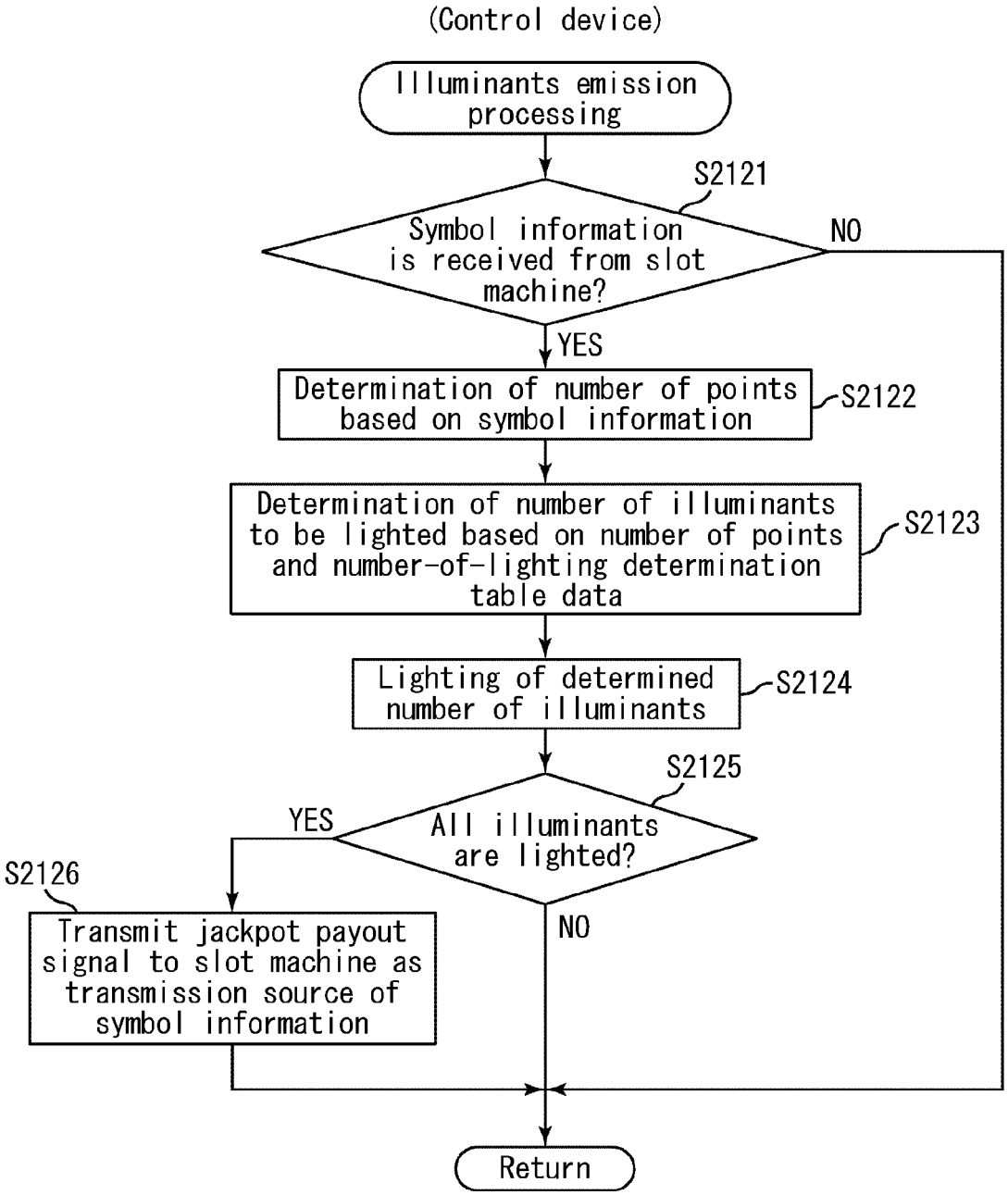
FIG. 63 is a flowchart illustrating a subroutine of illuminants emission processing in the third embodiment.

FIG. 63 is a flowchart illustrating a subroutine of illuminants emission processing in the third embodiment.

At first, the CPU 2201 determines whether or not to have received the symbol information (see step S2025 in FIG. 58) from the slot machine 2010 at a predetermined timing (step S2121).

When determining not to have received the symbol information, the CPU 2201 completes the present subroutine.

On the other hand, when determining to have received the symbol information, the CPU 2201 determines the number of points, based on the symbol information and the number-of-points determination table data stored in the hard disk drive 2205 (step S2122).

FIG. 64 is a view illustrating a number-of-points determination table in the third embodiment.

As shown in FIG. 64, a correspondence relationship between the combination of symbols and the number of points is determined in the number-of-points determination table. When the combination of the symbols rearranged along the winning line WL is the combination of symbols determined in the number-of-points determination table, points corresponding to the combination of the symbols are offered. The number-of-points determination table data is stored in the hard disk drive 2205 in the control device 2200. For example, as shown in FIG. 57, when "3 BAR-1 BAR-1 BAR" are rearranged along the winning line WL in the common game played on a single slot machine 2010, the number of points is determined to be 50 as a total of 30 based on "3 BAR" and 20 (=10+10) based on two of "1 BAR".

Next, the CPU 2201 determines the number of LEDs 2351 (illuminants) to be lighted (emit light) based on the determined number of points and the number-of-lighting determination table data (step S2123).

FIGS. 65A and 65B are views each illustrating the number-of-lighting determination table in the third embodiment.

The number-of-lighting determination table is a table in which the possible range of the number of points and the number of LEDs 2351 to be lighted are associated with each other. Further, in the number-of-lighting determination tables, the correspondence relationship between the number of points and the number of LEDs 2351 to be lighted is associated with each slot machine 2010.

The number-of-lighting determination table includes the number-of-lighting determination table for bent portions (see FIG. 65A) and the number-of-lighting determination table for straight portions (see FIG. 65B).

In the number-of-lighting determination table for bent portions, correspondence relationships between the number of points and the number of LEDs 2351 to be lighted may be different in accordance with the slot machines 2010.

In the number-of-lighting determination table for straight portions, the correspondence relationships between the number of points and the number of LEDs 2351 to be lighted are the same with respect to all the slot machines 2010.

In the processing of step S2123, at first, the CPU 2201 determines whether or not the number of lights indicated by the number-of-lights data stored in association with the identification number of the slot machine 2010 as a transmission source of the symbol information received in step S2121 is equal to or more than a predetermined number (the number of LEDs 2351 included in the bent portion of the coupling illumination line 2310).

When determining that the number of lights is equal to or more than the predetermined number, the CPU 2201 determines the number of LEDs 2351 to be lighted based on the number-of-lighting determination table for straight portions.

On the other hand, when determining that the number of lights is less than the predetermined number, the CPU 2201 determines the number of LEDs 2351 to be lighted based on the number-of-lighting determination table for bent portions.

Next, the CPU 2201 makes the LEDs 2351 (illuminants) in number determined in step S2123 be lighted (emit light) in the coupling illumination line 2310 provided for the slot machine 2010 as a transmission source of the symbol information received in step S2121 (step S2124).

In this processing, the CPU 2201 identifies the identification numbers of the LEDs 2351 to be lighted, based on the number determined in step S2123 and the number of lights indicated by the number-of-lights data stored in the number-of-lights storage area in the RAM 2203 in association with the identification number of the slot machine 2010. Further, the CPU 2201 transmits to the LED drive circuit 2350 a signal including information indicative of the identified identification numbers. On receiving this signal, the LED drive circuit 2350 lights the LEDs 2351 associated with the identification numbers included in the signal.

Further, after transmitting the signal, the CPU 2201 adds the number determined in step S2123 to the number of lights indicated by the number-of-lights data stored in the number-of-lights storage area in the RAM 2203 in association with the identification number of the slot machine 2010.

Next, the CPU 2201 determines whether or not all the LEDs 2351 (illuminants) included in the coupling illumination line 2310 provided for the slot machine 2010 as a transmission source of the symbol information received in step S2121 have been lighted (emit light) (step S2125). In the processing, the CPU 2201 determines whether or not the number of lights after the addition of the number determined in step S2123 has reached a predetermined number (the number of LEDs 2351 included in the coupling illumination line 2310), based on the number-of-lights data stored in the RAM 2203.

When determining that all the LEDs 2351 included in the coupling illumination line 2310 provided for the slot machine 2010 as a transmission source of the symbol information received in step S2121 have been lighted, the CPU 2201 transmits the jackpot payout signal for the common game to the slot machine 2010 (step S2126). It is to be noted that the jackpot payout signal for the common game includes information relating to the type of the common game (SPECIAL or NORMAL) and information relating to the specific value (NORMAL specific value or SPECIAL specific value).

On receiving the jackpot payout signal for the common game, the slot machine 2010 executes jackpot payout processing for the common game (see step S2027 in FIG. 58).

When determining in step S2125 that not all the LEDs 2351 have been lighted or after executing the processing of step S2126, the CPU 2201 completes the present subroutine.

Figure 66:
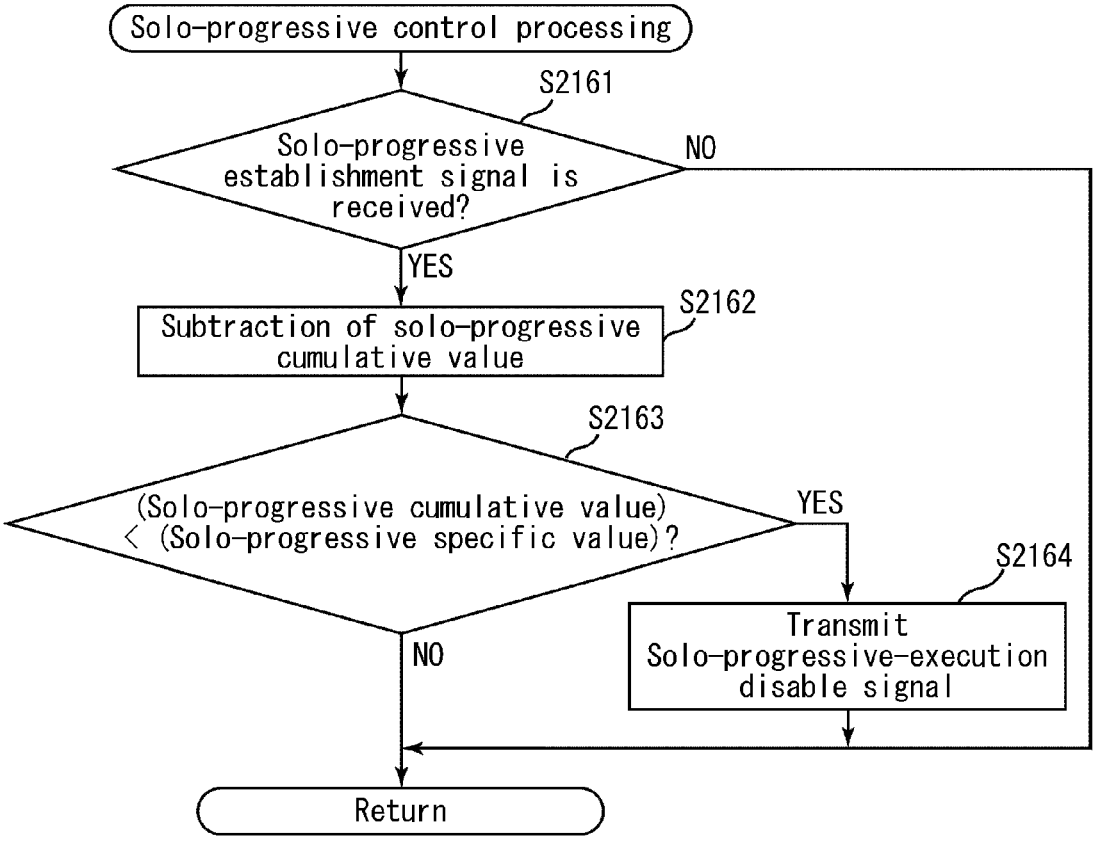
FIG. 66 is a flowchart illustrating a subroutine of solo-progressive control processing in the third embodiment.

FIG. 66 is a flowchart illustrating a subroutine of solo-progressive control processing in the third embodiment.

First, the CPU 2201 determines whether or not to have received the solo-progressive establishment signal from the slot machine 2010 (step S2161). When determining to have received the solo-progressive establishment signal, the CPU 2201 subtracts the solo-progressive specific value from the solo-progressive cumulative value (step S2162).

Next, the CPU 2201 determines whether or not the solo-progressive cumulative value is smaller than the solo-progressive specific value (step S2163). When determining that the solo-progressive cumulative value is smaller than the solo-progressive specific value, the CPU 2201 transmits the solo-progressive-execution disable signal to the slot machine 2010 (step S2164).

When determining not to have received the solo-progressive establishment signal in step S2161, or when determining that the solo-progressive cumulative value is not smaller than the solo-progressive specific value in step S2163, or after the processing of step S2164, the main CPU 2201 completes the present subroutine.

As above, according to the gaming system 2001 and the game control method, a part of the betted coins are cumulatively counted as the common-game cumulative value (the NORMAL cumulative value, the SPECIAL cumulative value) for the common game and another part of the betted game media are cumulatively counted as the solo-game cumulative value (the solo-progressive cumulative value) for the solo game. When the solo-game cumulative value has reached the second specific value (the solo-progressive value), the coins in number corresponding to the second specific value are paid out, on condition that the symbols are stop-displayed in the specific state ("BLUE7-BLUE7-BLUE7) in the solo game (the normal game). On the other hand, when the common-game cumulative value has reached the first specific value (the NORMAL specific value, the SPECIAL specific value), the common game in which the coins in number corresponding to the first specific value (the NORMAL specific value, the SPECIAL specific value) may be paid out is executed in each gaming machine 10. Based on the result of the common game in each gaming machine 10, a single gaming machine 10 is determined and the coins in number corresponding to the first specific value are paid out from the determined single gaming machine 10. Here, the second specific value is larger than the first specific value. Accordingly, in a case where it is possible that the symbols are stop-displayed in the specific state, the player becomes more conscious of whether or not the symbols are stop-displayed in the specific state, than the common game. However, according to the gaming system, the common game is executed by the common-game program programmed not to stop-display the symbols in the specific state. Accordingly, in the common game, payout of the game media based on the symbols stop-displayed in the specific state is not to be conducted. As a result, it is possible to provide a new-type gaming system capable of having the player more concentrated on the common game.

In the present embodiment, there has been described a case where, in conducting the payout of the solo progressive, 150000 coins corresponding to the solo-progressive specific value are paid out. However, in the present invention, the game media in number corresponding to the specific value or the first specific value, which are to be paid out from the gaming machine, are not limited to this, and may be the game media in number corresponding to the solo-game cumulative value which is cumulatively counted, or the game media in number obtained by subtracting a fixed value from the specific value or the first specific value.

In the present embodiment, there has been described a case where the solo-progressive specific value (the second specific value) is larger than the specific value (the first specific value) for the common game. However, the present invention is not limited to this, and the second specific value may be equal to or smaller than the first specific value. The reason for this is that it is possible to have the player concentrated on the common game with the configuration in which the game media in number corresponding to the second specific value are not paid out in the common game, regardless of whether or not the second specific value is equal to or smaller than the first specific value.

In the present embodiment, there has been described a case where the symbols are displayed to the lower image display panel 2016. However, the symbol display in the present invention is not limited to this example, and may be a mechanical reel with symbols drawn on the peripheral face.

In the present embodiment, there has been described a case where information indicative of the number of betted coins is transmitted from the slot machine 2010 to the control device 2200 and the number is multiplied by the increment rate in the control device. However, the present invention is not limited to this example, and the number of betted coins may be multiplied by a predetermined percentage and the result may be transmitted to the control device as the number-of-game-media information. Namely, in the present invention, the number-of-game-media information may be information indicative of the number of betted coins or the value obtained by multiplying the number of betted coins by a percentage, that is, information indicative of the cumulative number.

Although the embodiments of the present invention were described above, they were just illustrations of specific examples, and hence do not particularly restrict the present invention. A specific configuration of each step and the like is appropriately changeable in terms of design. Further, the effects described in the embodiments of the present invention are just recitations of the most suitable effects generated from the present invention. The effects of the present invention are thus not limited to those described in the embodiments of the present invention.

Further, the foregoing detailed descriptions centered the characteristic parts of the present invention in order to facilitate understanding of the present invention. The present invention is not limited to the embodiments in the foregoing specific descriptions but applicable to other embodiments with a variety of application ranges. Further, terms and phrases in the present specification were used not for restricting interpretation of the present invention but for precisely describing the present invention. It is considered easy for the skilled in the art to conceive other configurations, systems, methods and the like included in the concept of the present invention from the concept of the invention described in the specification. Therefore, it should be considered that recitations of the claims include uniform configurations in a range not departing from the range of technical principles of the present invention. Moreover, an object of the abstract is to enable a patent office, a general public institution, an engineer belonging to the technical field who is unfamiliar with patent, technical jargon or legal jargon, and the like, to smoothly determine technical contents and an essence of the present application with simple investigation. Accordingly, the abstract is not intended to restrict the scope of the invention which should be evaluated by recitations of the claims. Furthermore, for thorough understanding of an object of the present invention and an effect specific to the present invention, it is desired to make interpretation in full consideration of documents already disclosed and the like.

The foregoing detailed descriptions include processing executed on a computer or a computer network. Explanations and expressions above are described with the aim of being most efficiently understood by the skilled person in the art. In the specification, each step for use in deriving one result should be understood as the self-consistent processing. Further, in each step, transmission/reception, recording or the like of an electrical or magnetic signal is performed. While such a signal is expressed by using a bit, a value, a symbol, a letter, a term, a number or the like in processing of each step, it should be noted that those are used simply for the sake of convenience in description. While there are cases where processing in each step may be described using an expression in common with that of action of a human, processing described in the specification is essentially executed by a variety of devices. Further, another configuration requested for performing each step should become apparent from the above descriptions.

What is claimed as new and desired to be secured by Letters Patent of the United States is:

1. A gaming system comprising:

a plurality of gaming machines, each including a controller;

a control device including a processor;

a network enabling communication between said plurality of gaming machines and said control device; and a storage device which stores a plurality of individual cumulative values, wherein the plurality of individual cumulative values are associated with a plurality of predetermined percentages and a plurality of specific values, respectively, each of the plurality of predetermined percentages differs from the other predetermined percentages, each of the plurality of specific values differs from the other specific values, each controller is programmed to execute processing of:

(a) transmitting number-of-game media information relating to a number of betted game media to said control device, said processor is programmed to execute processing of:

(A) cumulatively counting a part of the number of betted game media according to the plurality of predetermined percentages, as the plurality of individual cumulative values, triggered by a receipt of said number-of-game media information from one of said plurality of gaming machines;

(B) determining whether or not any one of said plurality of individual cumulative values cumulatively counted in said processing (A) has reached an associated one of the plurality of specific values; and (C) transmitting a common-game execution signal to said one of said plurality of gaming machines to execute a common game, after it is determined in said processing (B) that said one of the plurality of individual cumulative values has reached the associated one of the plurality of specific values, each controller is further programmed to execute processing of:

(b) executing the common game after receiving said common-game execution signal from said control device; and (c) transmitting common-game result information determined based on a result of the common game executed in said processing (b), to said control device, and said processor is further programmed to execute processing of:

(D) selecting a single gaming machine out of the plurality of said gaming machines, based on said common-game result information; and (E) paying out game media, in a number corresponding to said one of the plurality of individual cumulative values, from the single gaming machine selected in said processing (D).

2. The gaming system according to claim 1, wherein said control device further includes an input device, and said processor is further programmed to execute processing of:

(F) changing said plurality of predetermined percentages and/or said plurality of specific values in accordance with an input from said input device.

3. The gaming system according to claim 1, wherein each of said plurality of gaming machines further includes an input device, and each controller is further programmed to execute processing of:

(d) changing said plurality of predetermined percentages and/or plurality of specific values in accordance with an input from said input device.

4. The gaming system according to claim 1, wherein each of said plurality of gaming machines includes a symbol display capable of variably displaying symbols;

said processor is further programmed to execute:

in said processing (A), cumulatively counting another part of the number of betted game media as a solo-game cumulative value for a solo game; and each controller is further programmed to execute processing of:

(d) executing the solo game for stop-displaying said symbols to said symbol display after variably displaying said symbols, based on a solo-game program; and (e) paying out game media, in a number corresponding to said solo-game cumulative value, when said symbols are stop-displayed in a specific state in said solo game, and when said solo-game cumulative value has reached a second specific value which is larger than said specific value.

5. The gaming system according to claim 4, wherein each controller is further programmed to execute:

in the processing (d), executing the solo game for stop-displaying said symbols to said symbol display after variably displaying said symbols, based on a first symbol array table for determination of said symbols stop-displayed, and in the processing (b), as the common game, stop-displaying said symbols on said symbol display after variably displaying said symbols, based on a second array table for determination of said symbols stop-displayed, not to stop-display said symbols in said specific state.

6. The gaming system according to claim 1, wherein, the storage device stores a plurality a the plurality of individual cumulative values corresponding to a plurality of common games, respectively;

the plurality of common games are associated with the plurality of predetermined percentages and the plurality of specific values, respectively;

in the processing (B), the processor is programmed to execute processing of determining whether or not any one of said plurality of individual cumulative values cumulatively counted in said processing (A) has reached an associated one of the plurality of specific values of an associated one of the plurality of common games;

in the processing (C), the processor is programmed to execute processing of transmitting the common-game execution signal to said one of said plurality of gaming machines to execute the associated one of the plurality of common games, after it is determined in said processing (B) that said one of the plurality of individual cumulative values has reached the associated one of the plurality of specific values;

in the processing (b), each controller is programmed to execute processing of executing the associated one of the plurality of common games after receiving said common-game execution signal from said control device; and in the processing (c), each controller is programmed to execute processing of transmitting common-game result information determined based on a result of the associated one of the plurality of common games executed in said processing (b), to said control device.

* * * * *